US005951852A

United States Patent [19]

Fookes

[11] Patent Number: 5,951,852

[45] Date of Patent: Sep. 14, 1999

[54] DESTRUCTION OF HALIDE CONTAINING ORGANICS AND SOLVENT PURIFICATION

[75] Inventor: Christopher John Reginald Fookes, New South Wales, Australia

[73] Assignee: Commonwealth Scientific And Industrial Research Organisation et al., New South Wales, Australia

[21] Appl. No.: 08/464,806

[22] PCT Filed: Dec. 23, 1993

[86] PCT No.: PCT/AU93/00682

§ 371 Date: Aug. 28, 1995

§ 102(e) Date: Aug. 28, 1995

[87] PCT Pub. No.: WO94/14731

PCT Pub. Date: Jul. 7, 1994

[51] Int. Cl.[6] ..... C10G 17/00

[52] U.S. Cl. ..... 208/262.1; 208/262.5; 585/63; 585/6.6; 585/8; 210/909; 588/207; 588/249; 588/206; 588/209

[58] Field of Search ..... 208/262, 262.5; 588/206, 207, 240, 224; 585/63, 66, 8; 210/909

[56] References Cited

U.S. PATENT DOCUMENTS

| | | | |
|---|---|---|---|
| 4,345,983 | 8/1982 | Wan | 204/158 |
| 4,351,718 | 9/1982 | Brunelle | 208/262 |
| 4,351,978 | 9/1982 | Hatano et al. | 585/464 |
| 4,390,719 | 6/1983 | Schwarze et al. | 560/129 |
| 4,400,552 | 8/1983 | Pytlewski et al. | 568/715 |
| 4,623,448 | 11/1986 | O'Connell et al. | 196/46 |
| 4,639,309 | 1/1987 | Lalancette et al. | 208/262 |
| 4,666,587 | 5/1987 | Martin | 196/46 |
| 4,719,007 | 1/1988 | Johnson et al. | 208/251 R |
| 4,749,817 | 6/1988 | George et al. | 507/204 |
| 4,761,221 | 8/1988 | Rossi et al. | 208/262 |
| 4,775,475 | 10/1988 | Johnson | 210/634 |
| 4,810,365 | 3/1989 | Dohler et al. | 208/262.1 |
| 4,816,318 | 3/1989 | Visser et al. | 208/179 |
| 4,923,590 | 5/1990 | Kalnes et al. | 208/85 |
| 4,927,520 | 5/1990 | Kalnes et al. | 208/50 |
| 4,950,833 | 8/1990 | Hawari et al. | 585/469 |
| 4,982,039 | 1/1991 | Benson et al. | 585/469 |
| 5,043,054 | 8/1991 | Halpern et al. | 209/262.5 |
| 5,057,207 | 10/1991 | Basler | 208/262.1 |
| 5,118,429 | 6/1992 | Anderson et al. | 218/758 |
| 5,141,629 | 8/1992 | Pri-Bar et al. | 208/262.1 |
| 5,185,488 | 2/1993 | Hawari et al. | 585/469 |
| 5,196,617 | 3/1993 | Kovenklioglu et al. . | |
| 5,202,102 | 4/1993 | Nguyen | 423/240 |
| 5,288,390 | 2/1994 | Durante | 208/31 |
| 5,290,432 | 3/1994 | Friedman et al. | 208/262.5 |
| 5,527,449 | 6/1996 | Brown et al. | 208/179 |

FOREIGN PATENT DOCUMENTS

| | | | |
|---|---|---|---|
| A0043950 | of 1980 | European Pat. Off. . | |
| 0 099 951 A1 | 12/1982 | European Pat. Off. | C10M 1/60 |
| 0 228 287 A2 | 12/1986 | European Pat. Off. | C08F 8/22 |
| 3623430 | of 1988 | Germany . | |
| WO 85/01955 | 5/1989 | WIPO | C10G 17/00 |

OTHER PUBLICATIONS

Patent Cooperation Treaty—International Search Report for PCT/AU93/00682; PCT/ISA/210 (3 sheets).

Patentschrift, No. 294965 (1916) (1 sheet) No Translation.

*Primary Examiner*—Helane Myers

*Attorney, Agent, or Firm*—Rockey, Milnamow & Katz

[57] ABSTRACT

A process for removal of halide from a halide containing organic compound in a solvent, a process for simultaneous removal of halide from a halide containing organic compound and reduction of an oxygen containing organic compound in a solvent, a process for removal of halide from a halide containing organic compound, a process for reduction of an oxygen containing organic compound in a solvent, a system for removal of halide from a halide containing organic compound in a solvent, a system for simultaneous removal of halide from a halide containing organic compound and the reduction of an oxygen containing organic compound in a solvent, and a system for reducing an oxygen containing organic compound in a solvent are disclosed. The process for simultaneous removal of halide from a halide containing organic compound and reduction of an oxygen containing organic compound in a solvent, includes exposing a solvent having a halide containing organic compound and an oxygen containing organic compound, in the presence of hydrogen and a hydrogen halide scavenger, to a catalyst which is capable, in the presence of hydrogen, of (i) converting the halide in the halide containing organic compound to hydrohalic acid; and (ii) reducing the oxygen containing organic compound; at a pressure and at an elevated temperature and for a time sufficient (a) to convert the halide in the halide containing organic compound to hydrohalic acid; and (b) to reduce the oxygen containing organic compound; and neutralizing the hydrohalic acid formed in (a) with hydrogen halide scavenger.

75 Claims, 15 Drawing Sheets

DESTRUCTION OF HALIDE CONTAINING ORGANICS AND SOLVENT PURIFICATION

TECHNICAL FIELD

The present invention relates to a process for removal of halide from a halide containing organic compound in a solvent, a process for simultaneous removal of halide from a halide containing organic compound and reduction of an oxygen containing organic compound in a solvent, a process for removal of halide from a halide containing organic compound, a process for reduction of an oxygen containing organic compound in a solvent, a system for removal of halide from a halide containing organic compound in a solvent, a system for simultaneous removal of halide from a halide containing organic compound and the reduction of an oxygen containing organic compound in a solvent, and a system for reducing an oxygen containing organic compound in a solvent.

BACKGROUND OF THE INVENTION

Many countries have, or are in the process of, imposing severe limits on the concentration of chlorinated hydrocarbon compounds permitted to be present in a wide range of materials used in industrial and other[]environments. Typical such compounds include polychlorinated biphenyls (PCBs), hexachlorobenzene, DDT and dioxins as well as hydrocarbon oils containing chlorinated aromatic compounds such as polychlorinated biphenyl compounds which are commonly present as one of the waste products in used or spent oils especially transformer oils and other similar liquids. Such materials are commonly destroyed by high temperature incineration, but this route is expensive and not permitted in some countries.

Because hydrocarbon transformer oils represent a large capital investment, any commercial process for the destruction of chlorinated organic compounds therein, and especially PCB contaminants in hydrocarbon transformer oils should, ideally, result in a product oil which can be reused in transformers. In principle, this could be accomplished by devising a process which destroys the PCBs, but which is carried out under reaction conditions which do not significantly alter the chemical composition of the hydrocarbon transformer oil.

Apart from combustion, either direct or catalysed, there are two main types of processes used to remove PCBs from oils. In one, the PCBs are reacted with sodium metal under specialised process conditions. Several variations of this route have been described (1–3). In general, this is a difficult process to scale up, requires routine handling of hazardous chemicals, and is likely to be operated as a batch process. It is uncertain if this approach can routinely result in a hydrocarbon transformer oil product which can be reused.

In another, (4–9) hydrocarbon oil containing the PCBs is reacted with hydrogen over a catalyst. In these processes, the hydrogen chloride formed in the course of the reaction moves through the reactor unchanged, and is washed from the reaction products only after these leave the reactor. These processes were exclusively designed to destroy the PCBs, and were not designed to recover an oil having the specific dielectric and other properties required for a high quality hydrocarbon transformer oil. Indeed, the coexistence of the hydrocarbon transformer oil and the hydrogen chloride gas in the catalytic reactor at high temperatures and pressures is detrimental to the stability of the catalyst and to the chemical composition of the hydrocarbon oil. Its presence, and the reactions the hydrogen chloride can undergo will render the oil unsuitable for subsequent use as hydrocarbon transformer oil.

Over time oils will gradually deteriorate due to oxidation of the hydrocarbons and contamination by other impurities. It is desirable to remove the oxidised species as the presence of these species can significantly reduce the electrical properties of the oil. It is also desirable to remove any organohalogen compounds as they may also affect the properties of oil and acid generated from them can cause a breakdown of the oil if the oil is hydrogenated by standard methods to remove the oxidised species. Particular examples of organohalogen compounds that may generate acids include polychlorinated biphenyls (PCBs), chlorinated napthalenes, chlorinated benzenes and halogenated solvents. Eventually, such degraded and contaminated oil must be withdrawn, as further use greatly reduces the efficiency of transformer operation and can ultimately lead to failure of the transformer. Such degraded oil is generally disposed as low grade fuel oil, valued at less than ¼ its original cost. When the oil is hydrogenated by standard methods significant breakdown of the oil during hydrogenation by standard methods can also be caused by the catalyst itself, usually due to acidic sites on the catalyst support.

Oils such as hydrocarbon transformer oils represent a large capital investment. Accordingly, there is a need to develop a cheap, effective and robust method to regenerate the deteriorated oil. Ideally, the process results in a product oil which can be reused for its original use. For transformer oils, this means regenerating an oil which has electrical properties equivalent to the original oil. Ideally, the process would reverse the oxidation reactions by converting the oxidised species back into hydrocarbons, but which is carried out under reaction conditions which do not significantly alter the chemical composition of the oil.

The total transformer oil inventory in use throughout Australia is around 240 million liters. At a cost of about $1000/tonne, this material has a replacement value of approximately $214 million.

In the recent Australian report of the Independent Panel on Intractable Waste (1992) estimated that about 67,000 tonnes of this oil, valued at almost $60 million, is contaminated with PCBs (polychlorinated biphenyls). State and Federal Governments are currently developing legislation to restrict the further use, storage and disposal of transformer oil contaminated with toxic PCBs, and are committed to the removal of these materials from the environment. The treatment or disposal of this oil poses a serious problem for its owners in the light of the decision of the federal government to abandon plans for construction of a toxic waste incinerator in Australia, and also to ban export of PCB contaminated materials to overseas incinerators. These decisions virtually force the development of an indigenous technology for the destruction of such toxic materials.

The transformer oil inventory in Australia and elsewhere clearly constitutes a major resource within the electricity generating and distribution industries. At present, there is no process available which can economically regenerate the dielectric properties of degraded transformer oils and at the same time remove any PCB contamination.

Further, there is a need for a process capable of destroying halogenated hydrocarbons generally.

OBJECTS OF INVENTION

Objects of the present invention are to provide a process for removal of halide from a halide containing organic compound in a solvent, a process for simultaneous removal of halide from a halide containing organic compound and reduction of an oxygen containing organic compound in a solvent, a process for removal of halide from a halide containing organic compound, a process for reduction of an oxygen containing organic compound in a solvent, a system for removal of halide from a halide containing organic compound in a solvent, a system for simultaneous removal of halide from a halide containing organic compound and the reduction of an oxygen containing organic compound in a solvent, and a system for reducing an oxygen containing organic compound in a solvent.

DISCLOSURE OF THE INVENTION

According to a first embodiment of the present invention, there is provided a process for removal of halide from a halide containing organic compound in a solvent, the process comprising:

exposing a solvent having a halide containing organic compound, in the presence of hydrogen and a hydrogen halide scavenger, to a catalyst which is capable, in the presence of hydrogen, of converting the halide in the halide containing organic compound to hydrohalic acid, at a pressure and at an elevated temperature and for a time sufficient to convert the halide in the halide containing organic compound to hydrohalic acid; and neutralising the hydrohalic acid so formed with the hydrogen halide scavenger.

Examples of reactions included within (but not restricting) the scope of the process of the first embodiment are as follows:

Destruction of Chlorinated Organics $$\text{Solvent} + R^1Cl + H_2 \xrightarrow[\text{Catalyst}]{\Delta} \text{Solvent} + R^1H + HCl \quad \text{(I)}$$

Neutralisation of Hydrochloric Acid $$HCl + NH_3 \longrightarrow NH_4Cl \quad \text{(Ia)}$$

$$HCl + R^2NH_2 \longrightarrow R^2NH_3Cl + H_2 \xrightarrow[\text{Catalyst}]{\Delta} NH_4Cl + R^2H \quad \text{(Ib)}$$

$$HCl + R^3R^4NH \longrightarrow R^3R^4NH_2Cl + H_2 \xrightarrow[\text{Catalyst}]{\Delta} NH_4Cl + R^3H + R^4H \quad \text{(Ic)}$$

$$HCl + R^5R^6R^7N \longrightarrow R^5R^6R^7NHCl + H_2 \xrightarrow[\text{Catalyst}]{\Delta} NH_4Cl + R^5H + R^6H + R^7H \quad \text{(Id)}$$

where $R^1$–$R^7$ are organic moieties which may be the same or independently different from one another. Further all or part of the added amines in equations (Ib), (Ic) and (Id) may react with hydrogen to give less substituted amines and/or ammonia:

$$H_2 + R^2NH_2 \xrightarrow[\text{Catalyst}]{\Delta} + R^2H \quad \text{(Ib')}$$

-continued $$H_2 + R^3R^4NH \xrightarrow[\text{Catalyst}]{\Delta} R^3H + R^4NH_2 \quad \text{(Ic')}$$

$$2H_2 + R^3R^4NH \xrightarrow[\text{Catalyst}]{\Delta} R^3H + R^4H + NH_3 \quad \text{(Ic'')}$$

$$H_2 + R^5R^6R^7N \xrightarrow[\text{Catalyst}]{\Delta} R^5H + R^6R^7NH \quad \text{(Id')}$$

$$2H_2 + R^5R^6R^7N \xrightarrow[\text{Catalyst}]{\Delta} R^5H + R^6H + R^7NH_2 \quad \text{(Id'')}$$

$$3H_2 + R^5R^6R^7N \xrightarrow[\text{Catalyst}]{\Delta} R^5H + R^6H + R^7H + NH_3 \quad \text{(Id''')}$$

Clearly the basic products of (Ib') to (Id''') are also hydrogen chloride scavengers. Hydrogen halide scavengers are not restricted to ammonia and amines as many nitrogen-containing substance which will generate ammonia or an amine under the conditions of the process will suffice. For example:

$$3H_2 + R^{20}NO_2 \xrightarrow[\text{Catalyst}]{\Delta} R^{20}NH_2 + 2H_2O \quad \text{(I')}$$

$$4H_2 + R^{20}NO_2 \xrightarrow[\text{Catalyst}]{\Delta} R^{20}H + 2H_2O + NH_3 \quad \text{(I'')}$$

$$3H_2 + R^{21}CONH_2 \xrightarrow[\text{Catalyst}]{\Delta} R^{21}CH_3 + H_2O + NH_3 \quad \text{(I''')}$$

According to a second embodiment of the present invention, there is provided a process for simultaneous removal of halide from a halide containing organic compound and reduction of an oxygen containing organic compound in a solvent, the process comprising:

exposing a solvent having a halide containing organic compound and an oxygen containing organic compound, in the presence of hydrogen and a hydrogen halide scavenger, to a catalyst which is capable, in the presence of hydrogen, of:

(i) converting the halide in the halide containing organic compound to hydrohalic acid; and (ii) reducing the oxygen containing organic compound;

at a pressure and at an elevated temperature and for a time sufficient:

(a) to convert the halide in the halide containing organic compound to hydrohalic acid; and (b) to reduce the oxygen containing organic compound; and neutralising the hydrohalic acid formed in (a) with hydrogen halide scavenger.

Examples of reactions included within (but not restricting) the scope of the process of the second embodiment are as follows:

Simultaneous Purification of Solvent and Destruction of Chlorinated Organics $$\text{Solvent} + R^1Cl + R^8COOH + H_2 \xrightarrow[\text{Catalyst}]{\Delta} \text{Solvent} + R^1H + R^8H + HCl + CO_2 \quad \text{(II)}$$

Neutralisation of Hydrochloric Acid $$HCl + NH_3 \longrightarrow NH_4Cl \quad \text{(Ia)}$$

$$HCl + R^2NH_2 \longrightarrow R^2NH_3Cl + H_2 \xrightarrow[\text{Catalyst}]{\Delta} NH_4Cl + R^2H \quad \text{(Ib)}$$

$$HCl + R^3R^4NH \longrightarrow R^3R^4NH_2Cl + H_2 \xrightarrow[\text{Catalyst}]{\Delta} NH_4Cl + R^3H + R^4H \quad \text{(Ic)}$$

$$HCl + R^5R^6R^7N \longrightarrow R^5R^6R^7NHCl + H_2 \xrightarrow[\text{Catalyst}]{\Delta} NH_4Cl + R^5H + R^6H + R^7H \quad \text{(Id)}$$

where $R^1$–$R^8$ are organic moieties which may be the same or independently different from one another.

According to a third embodiment of the present invention, there is provided a process for removal of halide from a halide containing organic compound, the process comprising:

dissolving the halide containing organic compound in a solvent;

exposing the solvent having a halide containing organic compound, in the presence of hydrogen and a hydrogen halide scavenger, to a catalyst which is capable, in the presence of hydrogen, of converting the halide in the halide containing organic compound to hydrohalic acid, at a pressure and at an elevated temperature and for a time sufficient to convert the halide in the halide containing organic compound to hydrohalic acid; and neutralising the hydrohalic acid so formed with the hydrogen halide scavenger.

Generally in the first to third embodiments the step of:

neutralising any catalyst acid sites with the hydrogen halide scavenger;

is also part of the process.

Examples of reactions included within (but not restricting) the scope of the process of the third embodiment are as shown for the first embodiment.

According to a fourth embodiment of the present invention, there is provided a process for reduction of an oxygen containing organic compound in a solvent, the process comprising:

exposing a solvent having an oxygen containing organic compound, in the presence of hydrogen and acid scavenger, to a catalyst which is capable, in the presence of hydrogen, of:

(i) reducing the oxygen containing organic compound;

at a pressure and at an elevated temperature and for a time sufficient to:

(a) reduce the oxygen containing organic compound; and neutralising any acid in the exposed solvent and any catalyst acid sites with the acid scavenger.

Examples of reactions included within (but not restricting) the scope of the process of the fourth embodiment are as follows:

Purification of Solvent $$\text{Solvent} + R^9COOH + H_2 \xrightarrow[\text{Catalyst}]{\Delta} \text{Solvent} + R^9CH_3 + HX \quad \text{(III)}$$

Neutralisation of Acidity $$HX + NH_3 \longrightarrow NH_4X \quad \text{(IIIa)}$$

$$HX + R^2NH_2 \longrightarrow R^2NH_3X + H_2 \xrightarrow[\text{Catalyst}]{\Delta} NH_4X + R^2H \quad \text{(IIIb)}$$

$$HX + R^3R^4NH \longrightarrow R^3R^4NH_2X + H_2 \xrightarrow[\text{Catalyst}]{\Delta} NH_4X + R^3R^4NH \quad \text{(IIIc)}$$

$$HX + R^5R^6R^7N \longrightarrow R^5R^6R^7NHX + H_2 \xrightarrow[\text{Catalyst}]{\Delta} NH_4X + R^5R^6R^7N \quad \text{(IIId)}$$

where $R^2$–$R^7$ and $R^9$ are organic moieties which may be the same or independently different from one another and X is an anion either free or incorporated into the catalyst active sites or both. Typically, X includes either oxygen or sulphur.

According to a fifth embodiment of the present invention, there is provided a system for removal of halide from a halide containing organic compound in a solvent, the system comprising:

a reactor having an inlet and outlet and a catalyst which is capable, in the presence of hydrogen, of converting halide in a halide containing organic compound to hydrohalic acid, for exposing a solvent having the halide containing organic compound, in the presence of hydrogen and a hydrogen halide scavenger, to the catalyst, at a pressure and at an elevated temperature and for a time sufficient to convert the halide in the halide containing organic compound to hydrohalic acid; and for neutralising the hydrohalic acid so formed with the hydrogen halide scavenger wherein the neutralising results in a neutralisation product(s), that does not substantially precipitate on the catalyst;

means for heating the reactor to an elevated temperature wherein the neutralisation product(s) does not substantially precipitate on the catalyst, the means for heating being operatively associated with the reactor; and means for feeding the hydrogen, the hydrogen halide scavenger and the solvent into the inlet the means for feeding being operatively associated with the inlet.

According to a sixth embodiment of the present invention, there is provided a system for simultaneous removal of halide from a halide containing organic compound and the reduction of an oxygen containing organic compound in a solvent, the system comprising:

a reactor having an inlet and outlet and a catalyst which is capable, in the presence of hydrogen, of converting halide in a halide containing organic compound to hydrohalic acid, and reducing an oxygen containing organic compound, for exposing a solvent having the halide containing organic compound and the oxygen containing organic compound, in the presence of hydrogen and a hydrogen halide scavenger, to the catalyst, at a pressure and at an elevated temperature and for a time sufficient to convert the halide in the halide containing organic compound to hydrohalic acid and to reduce the oxygen containing compound, and for neutralising the hydrohalic acid so formed with the hydrogen halide scavenger wherein the neutralising results in a neutralisation product(s), that does not substantially precipitate on the catalyst;

means for heating the reactor to an elevated temperature wherein the neutralisation product(s) does not substantially precipitate on the catalyst, the means for heating being operatively associated with the reactor; and means for feeding the hydrogen, the hydrogen halide scavenger and the solvent into the inlet the means for feeding being operatively associated with the inlet.

The systems of the fifth and sixth embodiments may further comprise:

means for removing the exposed solvent from the reactor the means for removing being operatively associated with the outlet; and means for separating non solvent materials from the exposed solvent, the means for separating being operatively associated with the means for removing.

According to a seventh embodiment of the present invention, there is provided a system for reducing an oxygen containing organic compound in a solvent, the system comprising:

a reactor having an inlet and outlet and a catalyst which is capable, in the presence of hydrogen, of reducing an oxygen containing organic compound, for exposing a solvent having the oxygen containing organic compound, in the presence of hydrogen and an acid scavenger, to the catalyst, at a pressure and at an elevated temperature and for a time sufficient to reduce the oxygen containing compound, and for any acid in the solvent and any catalyst acid sites with the acid scavenger wherein the neutralising results in a neutralisation product(s), that does not substantially precipitate on the catalyst;

means for heating the reactor to an elevated temperature wherein the neutralisation product(s) does not substantially precipitate on the catalyst, the means for heating being operatively associated with the reactor; and means for feeding the hydrogen, the acid scavenger and the solvent into the inlet the means for feeding being operatively associated with the inlet.

The system of the seventh embodiment may further comprise:

means for removing the exposed solvent from the reactor the means for removing being operatively associated with the outlet; and means for separating non solvent materials from the exposed solvent, the means for separating being operatively associated with the means for removing.

The means for heating the reactor may heat the reactor itself by for example an electrical heater or a steam jacket. Alternatively, the solvent may be preheated prior to entering the reactor and the reactor may be insulated against loss of heat.

The reduction of the oxygen containing organic compound may be decarboxylating a carboxylic acid, reducing a carboxylic acid, reducing an alcohol, reducing a peroxide, reducing a hydroperoxide, reducing an ester, reducing an acid halide, reducing a ketone, decarbonylating an aldehyde, reducing an aldehyde and/or reducing an ether, for example (for other examples of possible reduction of oxygen containing organic compounds see J. March, *Advanced Organic Chemistry,* 3rd Edition (John Wiley & Sons, New York, 1985), D. C. Liotta and M. Volmer, eds, *Organic Syntheses Reaction Guide* (John Wiley & Sons, Inc., New York, 1991) and R. C. Larock, *Comprehensive Organic Transformations* (VCH, New York, 1989).

One aspect of the invention, is concerned with mild hydrogenation of an oil (such as a transformer oil) in a packed bed catalytic reactor. Under these conditions hydrogen reacts with heteroatoms in the oil itself, and also with PCBs, HCBs and other chlorinated hydrocarbons present. Oxygen present in compounds resulting from ageing of the oil in service is converted to water. Any PCBs, HCBs and other chlorinated species are converted to hydrogen chloride and light hydrocarbons. A basic nitrogen containing compound additive (eg trimethylamine, triethylamine and/or $NH_3$) is fed to the reactor to ensure that the hydrochloric acid produced does not lead to degradation of the catalyst and to reduce hydrocarbon cracking reactions by reacting with the hydrogen chloride to form ammonium chloride or the like. The pressure and elevated temperature in the reactor are such that ammonium chloride or the like does not substantially precipitate on the catalyst in the catalytic reactor. On leaving the catalytic reactor, the downstream process typically involves separation of gases and light hydrocarbons from the regenerated transformer oil, and washing stages for the product oil to remove chlorides formed as a reaction product of PCB, HCB and other chloro-organics destruction.

More particularly, the processes of the first to third embodiments result in the reduction of the halogenated hydrocarbons to the corresponding hydrocarbon and the formation of ammonium halide or similar ammonium compound. In a further embodiment of the invention the processes comprise the additional step of separating the reaction product(s) of the hydrogen halide scavenger and hydrogen halide, separating the reaction product(s) of the hydrogen and contaminants such as oxygen containing organics, and any unused gaseous hydrogen and unused hydrogen halide scavenger from the solvent. In other words, the processes of the first to third embodiments may further comprise: separating reaction products resulting from the exposing of the solvent and the neutralising of the hydrohalic acid, from the solvent.

In a preferred embodiment unused gaseous hydrogen can be recycled.

The processes of the first to third embodiments may further comprise:

neutralising any catalyst acid sites with the hydrogen halide scavenger.

The processes of the first to fourth embodiments may further comprise:

removing the exposed solvent from the catalyst; and separating non solvent materials from the exposed solvent.

The processes of the first to third embodiments are generally conducted wherein at the pressure and the elevated temperature:

the neutralising of the hydrohalic acid formed with hydrogen halide scavenger results in a neutralisation product (s) that does not substantially precipitate on the catalyst, and the processes further comprise:

removing the exposed solvent from the catalyst; and separating non solvent materials from the exposed solvent.

More particularly, the processes of the first to third embodiments are generally conducted wherein at the pressure and the elevated temperature:

the neutralising of the hydrohalic acid formed with hydrogen halide scavenger results in a neutralisation product (s) comprising a neutralisation product(s) selected from the group consisting of vapourised ammonium halide and dissociated ammonia and gaseous hydrohalic acid, that does not substantially precipitate on the catalyst, and the processes further comprise:

removing the exposed solvent from the catalyst; and separating non solvent materials from the exposed solvent.

Generally in the processes of the first to third embodiments the halide is selected from the group consisting of fluoride, chloride, bromide and iodide. Typically the halide is chloride.

In particularly preferred processes of the first to third embodiments the pressure is in the range 1 MPa–10 MPa and the elevated temperature is in the range 300–375° C., the solvent comprises transformer oil, the halide is chloride and the hydrogen halide scavenger comprises ammonia.

The processes of the first to third embodiments are particularly useful for the destruction of chlorinated organics generally including dioxin, polychlorinated biphenyl compounds (PCBs—for examples of different types of PCBs and PCB derivatives see U.S. Pat. No. 5,145,790, the contents of which are incorporated by cross reference) and hexachlorobenzene (HCB) in hydrocarbon oils wherein a hydrocarbon oil containing a polychlorinated biphenyl compound is fed to a catalytic reactor with gaseous hydrogen and at least one hydrogen chloride scavenger.

Any catalyst which is capable, in the presence of hydrogen, of converting the halide in the halide containing organic compound to hydrohalic acid, or which is capable of converting the halide in the halide containing organic compound to hydrohalic acid and reducing the oxygen containing organic compound may be used in the process of the invention. Generally the catalyst is used in the form of a catalyst bed. The catalyst may be a typical hydrotreating catalyst having an active metal chosen from molybdenum, tungsten, chromium, iron, cobalt, nickel, Raney nickel, platinum, palladium, iridium, osmium, ruthenium, copper, manganese, silver, rhenium, rhodium, technetium, vanadium, nickel/molybdenum, nickel/tungsten, nickel/chromium, nickel/iron, nickel/cobalt, nickel/platinum, nickel/palladium, nickel/iridium, nickel/copper, nickel/manganese, nickel/silver, nickel/rhenium, nickel/osmium, nickel/rhodium, nickel/ruthenium, nickel/technetium, nickel/vanadium, Raney nickel/molybdenum, Raney nickel/tungsten, Raney nickel/chromium, Raney nickel/iron, Raney nickel/cobalt, Raney nickel/platinum, Raney nickel/palladium, Raney nickel/iridium, Raney nickel/copper, Raney nickel/manganese, Raney nickel/silver, Raney nickel/rhenium, Raney nickel/osmium, Raney nickel/rhodium, Raney nickel/ruthenium, Raney nickel/technetium, Raney nickel/vanadium, molybdenum/tungsten, molybdenum/chromium, molybdenum/iron, molybdenum/cobalt, molybdenum/platinum, molybdenum/palladium, molybdenum/iridium, molybdenum/copper, molybdenum/manganese, molybdenum/silver, molybdenum/rhenium, molybdenum/osmium, molybdenum/rhodium, molybdenum/ruthenium, nickel/tungsten, molybdenum/technetium, molybdenum/vanadium, nickel/molybdenum/platinum, nickel/molybdenum/palladium, nickel/molybdenum/palladium/platinum, Raney nickel/molybdenum/platinum, Raney nickel/molybdenum/palladium, Raney nickel/molybdenum/palladium/platinum, sulfided forms of the foregoing catalysts, and mixtures and alloys thereof (for other examples of catalysts see "Sulphide Catalysts, Their Properties and Applications", 0. Weisser and S. Landa, Pergamon Press, New York, J. B. Hendrickson et al., "Organic Chemistry", New York, McGraw Hill (1970), P. Dini et al., J. Chem Soc. Perkin, II:1479–1482 (1975), R. B. Pierre et al., J. Catalysis, 52:59–71 (1978), Pierre et al., J. Catalysis, 52:230–238 (1978), and B. Coq et al. React. Kinet. Catal. Lett., 27(1):157–161 (1985), the contents of all of which are incorporated by cross reference). Catalyst activation is typically carried out under a pressure of 0.1–50 MPa, more typically 1–20 MPa, even more typically 3–10 MPa, and yet even more typically about 5 MPa, typically at a temperature in the range 100° C.–500° C., more typically 200° C.–400° C., and yet even more typically 225° C.–375° C. by subjecting the catalyst to either $H_2S$ in hydrogen (typically 1 vol %–30 vol %, more typically 3 vol %–10 vol % of $H_2S$ in hydrogen) or a hydrocarbon solvent (eg see list of hydrocarbon solvents in this specification) having a sulphided hydrocarbon dissolved therein such as di($C_1$–$C_6$alkyl)disulphide, di($C_2$–$C_6$alkylene)disulphide or di($C_2$–$C_6$alkyne)disulphide (eg dimethyldisulphide) or indeed any substance which can be converted into hydrogen sulphide by reaction with hydrogen. A typical process for sulphiding the catalyst is as follows: (a) After pressurising the system and establishing the hydrogen flow, feed was introduced at a rate of 25–250 $ghr^{-1}$. The temperature is then incremented in stages of 10–50° C., typically 25° C., every 15–120 minutes, typically every 30 minutes to 200° C.–275° C., typically 250° C., and held at this point until hydrogen sulfide can be detected in the off-gas (eg by using Drager tubes). After detection of the hydrogen sulfide, the temperature is increased in stages of 10–50° C., typically 25° C., (ensuring a breakthrough of $H_2S$ each time) to 320–400° C., typically 350° C. The temperature is held at 320–400° C., typically 350° C., for 1–4 hours, typically 2 hours, and then decreased to 100–250° C., typically 200° C., at which point the feed and heaters are turned off and the catalyst allowed to cool slowly under a steady hydrogen flow or under an atmosphere of hydrogen (eg for 5–36 hours, typically 12 hours under 0.1–50 MPa, more typically 1–20 MPa, even more typically 3–10 MPa, and yet even more typically about 1–5 MPa and further even more typically 3.5 MPa).

Typically when two catalysts are used, they are used in molar ratios in the range 1:99 to 99:1, more typically, 10:90 to 90:10, even more typically 25:75 to 75:25 and yet more typically 50:50. Typically when three catalysts are used, they are used in molar ratios in the range 1:1:98 to 1:98:1 to 98:1:1, more typically, 10:10:80 to 10:80:10 to 80:10:10, even more typically 33.3:33.3:33.3. Typically when four catalysts are used, they are used in molar ratios in the range 1:1:1:97 to 1:1:97:1 to 1:97:1:1 to 97:1:1:1, more typically, 25:25:25:25. Particularly preferred commercially available catalysts are sulfided Ni/Mo (1–6% Ni/2–15% Mo, typically 2% Ni/7% Mo) supported on γ alumina, platinum supported on γ alumina, and palladium on γ alumina (the latter two catalysts may be simply reduced in hydrogen at elevated temperatures (200–800° C.) prior to use).

The processes of the first to third embodiments may further comprise:

monitoring the hydrogen halide scavenger content in the solvent after exposing the solvent to the catalyst and adjusting the amount of hydrogen halide scavenger in the solvent exposed to the catalyst and/or the temperature during the exposure and/or the pressure during the exposure whereby there is a detectable amount of hydrogen halide scavenger in the solvent after exposing the solvent to the catalyst such that the amount of hydrogen halide scavenger in the solvent at the time of exposing of the solvent to the catalyst is an amount effective to completely neutralise hydrogen halide and any other acids in the solvent and any acids formed during the exposure of the solvent to the catalyst including neutralising any catalyst acid sites.

The processes of the first to third embodiments may further comprise:

monitoring the halide content in the solvent prior to exposing the solvent to the catalyst and adjusting the amount of hydrogen halide scavenger and/or hydrogen exposed to the catalyst and/or the temperature during the exposure and/or the pressure during the exposure whereby there is a detectable amount of hydrogen halide scavenger in the solvent after exposing the solvent to the catalyst such that the amount of hydrogen halide scavenger in the solvent at the time of exposing of the solvent to the catalyst is an amount effective to completely neutralise hydrogen halide and any other acids in the solvent and any acids formed during the exposure of the solvent to the catalyst including neutralising any catalyst acid sites.

The process of the fourth embodiment may further comprise:

monitoring the acid scavenger content in the solvent after exposing the solvent to the catalyst and adjusting the amount of acid scavenger in the solvent exposed to the catalyst and/or the temperature during the exposure and/or the pressure during the exposure whereby there is a detectable amount of acid scavenger in the solvent after exposing the solvent to the catalyst such that the amount of acid scavenger in the solvent at the time of exposing of the solvent to the catalyst is an amount effective to completely neutralise any acids in the solvent and any acids formed during the exposure of the solvent to the catalyst including neutralising any catalyst acid sites.

The oxygen containing organic compound is typically a compound resulting from ageing/oxidation of the solvent (eg transformer oil).

Advantageously in the processes of the first to fourth embodiments of the invention the hydrogen halide scavenger or the acid scavenger is a basic nitrogen containing compound which is chosen such that the step of neutralising the hydrohalic acid with the basic nitrogen containing compound results in a gaseous or volatile compound under the conditions in the catalytic reactor (which in the case of the first to third embodiments is a function of pressure, temperature and halide content in the reactor and in the case of the fourth embodiment is a function of pressure, temperature and anion content in the reactor) such that the compound does not precipitate in the catalytic reactor and can be readily removed from the catalyst and the catalytic reactor. Any suitable nitrogen compound which is a base or is transformed into a base and which will neutralise hydrogen halide under the reaction conditions of the process of the invention and which under the reaction conditions of the exposure to the catalyst, can be readily removed from the catalyst, may be used in the process of the invention. Typically the hydrogen halide scavenger comprises a nitrogen containing compound which is a base or which is transformed into a base (such as ammonia) in the reactor. The gaseous hydrogen being added to the catalytic reactor may itself independently contain a basic compound such as ammonia. It is particularly desirable to use ammonia gas and/or a nitrogen containing organic basic compound whereby under process conditions, ammonium halide is formed in such a way that it does not substantially precipitate on the catalyst (i.e. it remains dissociated as ammonia and HCl or stays in gaseous phase etc.). Examples of suitable basic nitrogen containing compounds include tri ($C_1$–$C_7$alkyl)amines including trimethylamine, triethylamine, tripropylamine, or tributylamine etc., di($C_1$–$C_7$alkyl)amines including dimethylamine, diethylamine, dipropylamine, dibutylamine, diisobutylamine, or diisopropylamine, etc., $C_1$–$C_7$ alkylamines including methylamine, ethylamine, propylamine, butylamine, isopropyl-amine, isobutylamine, etc., $C_2$–$C_9$ primary, secondary and tertiary alkylideneamines, $C_3$–$C_9$ cycloalkylamines including cyclohexylamine, cyclopentylamino and cycloheptylamino, $C_6$–$C_{12}$ arylamino, $C_7$–$C_{14}$ aralkylamino aniline, ammonia and nitrobenzene or mixtures thereof. A basic nitrogen-containing heterocyclic which may be a 5-, 6-, 7-, 8-, 9- or 10-membered monocyclic, bicyclic or polycyclic ring containing from one to three nitrogen heteroatoms and includes any group in which a heterocyclic ring is fused to a benzene ring. Examples of such heterocycles are pyrryl, pyrimidinyl, quinolinyl, isoquinolinyl, indolyl, piperidinyl, pyridinyl, imidazolyl, imidazolidinyl, morpholinyl, pyrrolidinyl, pyrazolyl, pyrazolinyl, tetrazolyl, triazolyl, benzimidazolyl, pyrrolinyl, quinuclidinyl, azanorbornyl, isoquinuclidinyl and the like. e.g. tertiary amines such as trialkyl amines (trimethylamine, triethylamine, pyridines and pyridine bases (4-dimethylaminopyridine, 4-pyrrolidylaminopyridine etc.). The lower alkylamino includes alkylamino having straight or branched chain alkyl moiety having 1–6 carbon atoms, The di- and tri-lower alkylaminos include amino substituted by the same or different and straight or branched chain alkyl moiety having 1–6 carbon atoms. Other examples of amine organic bases include n-amylamine, n-hexylamine, n-octylamine, n-decylamine, laurylamine, palmitylamine, dibutylamine, tributylamine, N,N-dimethyl-benzylamine, N,N,-dimethyl-p-toluidine, phenethyldibutyl-amine, N,N,N',N'-tetramethylhexamethylenediamine, N,N,N'N'-tetramethylpropylenediamine, N'N-diethylbenzylamine, ethylaniline, methylaniline, propylaniline, diethylaniline, dimethylaniline, dipropylaniline, triethylaniline, trimethylaniline, tripropylaniline, N,N-dibutylbenzylamine, phenethyldiethylamine, N,N'di(t-butyl)ethylene-diamine, N-methylmorpholine, N,N-dimethylaminopyridine, N,N-dimethylbutylamine, di(n-butyl)amine, triethylamine, diethylamine, picoline, 2-picoline, 3-picoline, 4-picoline, 2,4-lutidine, 2,6-lutidine, quinoline, pyridines (including pyridine), pyrimidines, quinoxalines, tri-n-propyl-amine, triisopropylamine, and dimethylisoproplamine. The gaseous hydrogen being added to the reactor may also contain a basic nitrogen containing compound. For example the gaseous hydrogen may also contain ammonia.

As used herein, the term "alkyl" includes within its meaning straight and branched chain alkyl groups. Examples of such groups are methyl, ethyl, propyl, isopropyl, butyl, isobutyl, sec-butyl, tert-butyl, amyl, isoamyl, sec-amyl, 1,2-dimethylpropyl, 1,1-dimethylpropyl, hexyl, 4-methylpentyl, 1-methylpentyl, 2-methylpentyl, 3-methylpentyl, 1,1-dimethylbutyl, 2,2-dimethylbutyl, 3,3-dimethylbutyl, 1,2-dimethylbutyl, 1,3-dimethylbutyl, 1,2,2-trimethylpropyl, 1,1,2-trimethylpropyl, and the like.

As used herein, the term "cycloalkyl" refers to mono- or polycyclic alkyl groups, or alkyl substituted cyclic alkyl groups. Examples of such groups include cyclopropyl, methylcyclopropyl, cyclobutyl, methylcyclobutyl, cyclopentyl, methylcyclopentyl, ethylcyclopentyl, cyclohexyl, methylcyclohexyl, ethylcyclohexyl, cycloheptyl, cyclooctyl, cyclononyl, cyclodecyl, cycloundecyl, cyclododecyl and the like.

As used herein, the term "alkylidene" includes reference to unsaturated divalent alkyls. Examples of such radicals are $CH_2{=}CH{-}$, $HC({=}CH_2)CH_2{-}$, $CH_3CH{=}CH{-}$, $CH_3CH_2CH{=}CH{-}$, and $CH_3CH{=}CHCH_2$. The term also refers to such radicals in which one or more of the bonds of the radical from part of a cyclic system and at least one of the cyclic atoms is nitrogen. Examples of such radicals are groups of the structure

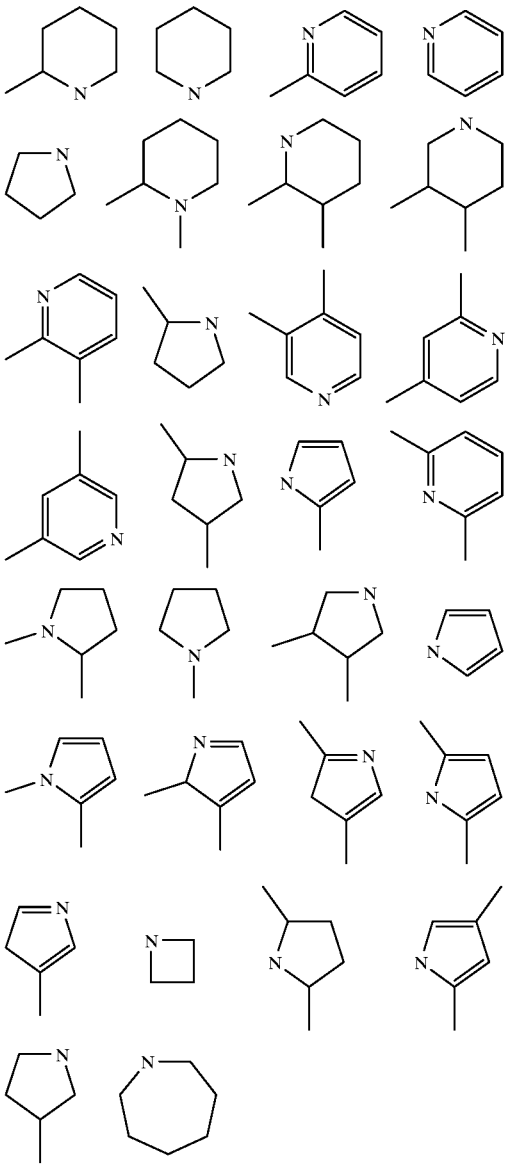

As used herein, the term "aryl" refers to single, polynuclear and fused residues of aromatic hydrocarbons or aromatic heterocyclic ring systems. Examples of such groups are phenyl, biphenyl, naphthyl, pyridyl, thienyl, furyl, pyrryl, indolyl, pyridazinyl, pyrazolyl, pyrazinyl, thiazolyl, pyrimidinyl, quinolinyl and isoquinolinyl.

As used herein, the term "aralkyl" refers to alkyl groups substituted with one or more aryl groups as previously defined. Examples of such groups are benzyl, 2-phenylethyl and 1-phenylethyl.

The concentration and amount of hydrogen halide scavenger compound added to the reactor will depend upon the concentration of halide containing organic compound(s) such as PCBs in the solvent (such as hydrocarbon oil) and the actual hydrogen halide scavenger compound being used. Ideally, the amount and concentration of hydrogen halide scavenger compound present is generally sufficient to react with all the hydrogen halide formed as a result of the reduction of the halide containing organic compound(s) present in the solvent (i.e. of hydrogen halide scavenger compound present is generally at least stoichiometric or greater than stoichiometric of the amount of HCl formed). This will depend upon the hydrogen halide scavenger compound selected and its ability to react with hydrogen halide. Generally the amount of hydrogen halide scavenger is at least equal to or greater than stoichiometric (i.e. Cl (corresponding to total Cl content of solvent mixture) :hydrogen halide scavenger is generally 1M:1M or 1M:>1M (typically between 1M and 100M, more typically between 1M and 10M and more typically between 1M and 3M).

The hydrogen halide scavenger compound may be added to the solvent such as, for example, contaminated transformer oil, prior its being added to a catalytic reactor or it may be added directly to the reactor or it may be added to the gaseous hydrogen entering the reactor. Alternatively the hydrogen halide scavenger may be added to the gaseous hydrogen prior to it being introduced to the catalytic reactor.

Generally the reaction takes place under elevated temperature and pressure in a catalytic reactor. The operating temperature and pressure are adjusted to take into account the halide content of the feed solvent (which can be monitored, batchwise or continuously) so that deposition of $NH_4Cl$ formed as a consequence of the hydrogen halide scavenger reacting with HCl in the reactor is minimised or substantially prevented in the reactor.

Any suitable solvent capable of dissolving the relevant halogenated organic compound(s) and which can substantially withstand reaction conditions in the catalytic reactor may be used (the suitability of a solvent may be determined by simple trial and error). Clearly the choice of solvent will be dependent upon the type of halogenated organic compound to be destroyed such that the halogenated organic compound is able to be dissolved in said solvent. These solvents include aromatic compounds, cycloaliphatic compounds, aliphatic-substituted aromatic compounds, cycloaliphatic-substituted aromatic compounds, aliphatic-substituted cycloaliphatic compounds, and mixtures thereof. These compounds include substantially hydrocarbon compounds as well as purely hydrocarbon compounds. The term "substantially hydrocarbon" is used herein to mean that the compounds contain no non-hydrocarbon substituents or non-carbon atoms that significantly affect the hydrocarbon characteristics or properties of such compounds relevant to their use herein as solvents. The aromatic compounds can be mononuclear or polynuclear. The aliphatic substituents on the aromatic compounds can be straight chain hydrocarbon groups of 1 to about 7 carbons, cyclic groups of about 3 to about 9 carbons, or mixtures thereof. The aromatic compounds can be mono-substituted or poly-substituted. The poly-substituted aromatic compounds are-preferably di-substituted. The cycloaliphatic compounds can have from about 3 to about 9 ring carbon atoms, preferably 5 or 6 ring carbon atoms, and can be saturated or unsaturated. Examples include cyclopropane, cyclobutane, cyclopentane, cyclopentene, 1,3-cyclopentadiene, cyclohexane, cyclohexene, 1,3-cyclo-hexadiene, etc. The aliphatic substituents on the aliphatic-substituted cycloaliphatic compounds can be Straight chain hydrocarbon groups of 1 to about 7 carbon atoms, preferably 1 to about 3 carbon atoms. The rings of the cycloaliphatic compounds can be mono-substituted or poly-substituted. The poly-substituted compounds are preferably di-substituted. Examples include methylcyclopentane, methylcyclohexane, 1,3-dimethylcyclohexane, 3-ethylcyclopentene, 3,5-dimethylcyclopentene, etc. Typically the solvent is a liquid hydrocarbon solvent. Suitable liquid hydrocarbons include diesel oil, straight run distillates, kerosene, transformer oil, motor oil, aromatics such as benzene, tetralin, pseudocumene, o-xylene, m-xylene, p-xylene, ethylbenzene, isopropylbenzene, mesitylene, naphthalene, anthracene, styrene, 1-methylnaphthalene, 1,2-dimethylnaphthalene, 1,6-dimethylnaphthalene, 1,2,3,4-tetrahydronaphthalene, butylbenzene, sec-butylbenzene, isobutylbenzene, tert-butylbenzene, cyclohexylbenzene, p-cymene, cumene, 4-tert-butyltoluene, and toluene, or aliphatics such as cyclohexane, cyclohexene, dipentene, d-limonene, 1-limonene, octane, methylcyclohexane, ethylcyclohexane, mesitylene, hexane, 2-pinene, 2(10)-pinene, 1-pentene, 2-pentene, cis-2-pentene, trans-2-pentene, 1-hexene, 1-heptene, 1-octene, 2-octene, cis-2-octene, trans-2-octene, 1-nonene, 1-decene, 1-dodecene, 1-tridecene, propane, butane, 2-methylpropane, cyclopentane, pentane, 2-methylbutane, 2,2-dimethylpropane, methylcyclopentane, 2-methylpentane, 3-methylpentane, 2,2-dimethylbutane, 2,3-dimethylbutane, 2-methylhexane, 2,2,3-trimethylpentane, 2,2,4-trimethylpentane, 2,2,3,3-tetramethylbutane, nonane, decane, 1,1'-bicyclohexyl, dodecane, tridecane, 2,2,5-trimethylhexane, decahydronaphthalene, trans-decahydronaphthalene, cis-decahydronaphthalene, 3-methylhexane, 2,3-dimethylpentane, 2,4-dimethylpentane, 1,2-dimethylcyclohexane, cis-1,2-dimethylcyclohexane, trans-1,2-dimethylcyclohexane, heptane, or mixtures of any of the foregoing. Alternatively, the solvent may be an oil such as a mineral oil eg paraffin oil, (including an oil used in transformers), a vegetable oil eg arachis oil, olive oil, sesame oil, groundnut oil, peanut oil or coconut oil, a fish oil eg tuna oil, mackeral oil, sand eel oil, menhaden oil, anchovy oil, sardine oil, horse mackeral oil, salmon oil, herring oil, cod oil, capelin oil, pilchard oil, sprat oil, whale oil, Pacific oyster oil, Norway pout oil, seal oil and sperm whale oil or a plant oil eg pine oil, wheat germ oil and linseed oil). Further examples of solvents that may dissolve halogenated organic compounds may be found in "Chemical Safety Data Sheets", Volume 1: Solvents, The Royal Society of Chemistry, Thomas Graham House, Science Park, Milton Road, Cambridge, United Kingdom and Techniques of Chemistry, Volume II, "Organic Solvents", J. A. Riddick, W. B. Bunger and T. K. Sakano, 4th edition, A. Weissberger editor, J. Wiley & Sons, New York, 1986, the contents of both of which are incorporated herein by cross reference.

Ideally enough solvent is mixed with the halogenated organic compound such that all of the halogenated hydrocarbon is dissolved. The amount of solvent will accordingly depend upon the ability of said solvent to dissolve the halogenated organic compound. In a preferred embodiment the concentration of halogenated organic compound in the solution formed in step one is up to 35 wt %, typically up to 10 wt %, more typically 0.1–5 wt %. Alternatively, in terms of ppm the concentration of halogenated organic compound is typically 0.1 ppm to 10,000 ppm, more typically 1 ppm–1000 ppm.

The amount of gaseous hydrogen added to the reactor will depend on the level of halogenated organic compound(s) to be destroyed and other contaminants present in the oil and may varied by altering the pressure in the reactor during the exposure (in particular this can be generally achieved by adjusting the input the hydrogen pressure and ammonia pressure) or the hydrogen to oil ratio or both. The pressure (and elevated temperature) are generally chosen such that the reaction product of the hydrogen halide scavenger and hydrogen halide (or in the case of the fourth embodiment the reaction product of the acid scavenger and acid catalyst sites or other acids) does not substantially precipitate onto the catalyst during the exposure. Typically the pressure at which hydrogen is delivered to the catalytic reactor (or if another gas such as ammonia is also added to the reactor, the pressure of ammonia and hydrogen added to the reactor) is such that the pressure in the reactor during the exposure is in the range of 0.01–50 MPa, more typically 1–20 MPa, even more typically 2–10 MPa, yet even more preferably 3–7 MPa. A more typical pressure during the exposure in the catalytic reactor is in the range 3–5 MPa. The pressure in the catalytic reactor during the exposure is generally monitored with a pressure gauge.

The elevated temperature will typically depend upon the catalyst being used and the level of halogenated organic compound(s) present in the contaminated oil. The elevated temperature (and pressure) are generally chosen such that the reaction product of the hydrogen halide scavenger and hydrogen halide (or in the case of the fourth embodiment the reaction product of the acid scavenger and acid catalyst sites or other acids) does not substantially precipitate onto the catalyst during the exposure. Typically the elevated temperature is in the temperature range 200–550° C. more typically, 200–500° C. More typically the temperature of the reaction is in the range 250–350° C. Ideally the process of the invention in conducted at a temperature which maximises the destruction of the halogenated hydrocarbons while minimising thermal destruction of the solvent. In a preferred embodiment the catalytic reactor is maintained at a temperature of more typically 275–375° C. and even more typically 300–350° C.

The efficiency of reduction of halogenated organic compound(s) and/or oxidised organics present in the solvent is dependent upon a number of factors. One of the important factors is the residency of the solvent to be purified in relation to catalyst. Ideally, the residency time is sufficiently long so that substantial conversion of all the required halogenated organic compound(s) and/or oxidised organics present in the solvent to be occurs so that they are substantially reduced. The optimum residency time of the gas is dependent on a number of factors including the type of solvent to be purified, the catalyst selected, the temperature selected and the impurities to be removed.

The hourly space velocity (i e. grams of solvent fed to the reactor per gram or catalyst per hour) of solvent fed to the catalytic reactor will depend upon the level of halogenated organic compound(s) and/or oxidised organics present in the solvent and the type of reactor being used and the level of other variants. A preferred hourly space velocity is in the range of 0.1 to 10 grams of solvent per gram of catalyst per hour. Hourly space velocities (GHSV at STP) typically between 1 and 3600, more typically 3 and 2400 liter feed solvent per kg of catalyst per hour (l/kg/hr), typically 1 to 1800 l/kg/hr, more typically 20 to 500 l/kg/hr and even more typically 50 to 275 l/kg/hr. Typically the contact time of the solvent with the catalyst is between 1 sec and 5 minutes, more typically 0.15 seconds and 20 seconds and even more typically between 0.25 and 5 seconds. Typically the solvent is preheated prior to contact with the catalyst.

To optimise the residency time a number of features may be altered. These include the path length of the gas over the catalyst, pressure, temperature of the reactor, the flow rate of the gas and the volume of the reactor.

The catalyst may be in the form of powder, granules, discs, pellets, monoliths or other suitable form. The catalyst may be in the form of pure catalyst or alternatively it may be held together with a binder and/or may be coated or deposited on a support or carrier by techniques well known in the art (e.g. by vacuum deposition, impregnation, electrodeposition). Suitable binders or support materials include but are not limited to alumina including α-alumina, mullite, cordierite, mullite aluminium titanate, magnesia, zirconia, zirconia spinels, titania, silica-alumina including amorphous silica-alumina, and clays and mixtures thereof. Small amounts of other materials such as zirconia, titania, magnesia and/or silica may be present. The amount of binder may be 3–50 wt % of the catalyst, more typically 5 to 30 wt % base on the total weight of the catalyst. Typically, the catalyst has a surface area to volume ratio of at least 0.5 $m^2$/gm, more typically between 25 and 500 $m^2$/g, and even more typically between 50 and 250 $m^2$/g.

The reactor may be a single pass reactor packed with the catalyst, such as for example a particulate catalyst disposed in a fixed bed within the reactor or a catalyst deposited on or impregnated in a ceramic foam carrier (e.g. ceramic foams made from the aforementioned refractory oxides particularly alumina and α-alumina) disposed within the reactor, or a multiple pass reactor packed with the catalyst. The catalyst may be arranged fixedly within the reactor so as to provide a high tortuosity for the feed gas (typically between 1.0 and 10.0, more typically 1.3 to 4.0; "tortuosity" with reference to a fixed catalyst bed is the ratio of the pathlength of gas flowing through the bed to the length of the shortest straight line through the bed). Alternatively, the catalyst may be in the form of a fluidised bed. The reactor may be operated so that the feed gas contacts the catalyst under isothermal conditions or adiabatic conditions ("adiabatic" referring to reaction conditions wherein substantially all heat loss and radiation from the catalyst bed is prevented except for the heat leaving in the exit gas from the reactor).

As far as removal of PCB and other chlorinated organics as well as regeneration of transformer oils are concerned, the process of the second embodiment is typically able to provide a processed transformer oil having (a) A dielectric dissipation factor of $5–6\times10^{-3}$ (max); (b) A resistivity >200 Gohmm; (c) A dielectric strength >60 kV; (d) An acidity of 0.01 to 0.03 mg KOH/g (max); (e) Interfacial tension of >30 mN/M; and (f) PCB content <0.1 mg/kg.

Advantages of the process of the invention are as follows:

(i) High temperature incineration has been a widely used method for disposing of toxic wastes overseas. However, the potential formation of dioxins during incineration is the single most important factor raised in public opposition to incineration as a solution to toxic waste destruction in Australia. A significant benefit of this new processes is that the experimental conditions make the formation of dioxins totally impossible.

(ii) Apart from their ability to destroy PCB contamination and other chlorinated organic contamination, the processes of the invention offer an entirely new approach for the regeneration and recycling of oxidised, and therefore unusable, transformer oils. As already indicated, these are a valuable component of the national electricity grid.

BRIEF DESCRIPTION OF DRAWINGS

Preferred embodiments of the invention are described below with reference to the following drawings in which.

BEST MODE AND OTHER MODES OF CARRYING OUT THE INVENTION

The process described may be configured as a mobile transformer oil treatment unit capable of processing 10,000 liters per day in continuous operation.

It is anticipated that such a unit will be suitable for on-site retreatment of oils in transformers containing 10,000 liters of oil or greater. The maximum oil volumes in transformers on the New South Wales supply system are around 110,000 liters with around 94% of network and 42% of distribution transformer oil volume in units greater than 10,000 liters. It is envisaged that in treating transformer oils on-site the particular transformer will be taken off-line and its oil transferred to a transportable storage tank of suitable volume that is also brought on-site. Oil will be processed from this tank through the hydrogenation unit and regenerated oil transferred to a transportable product oil tank. Regenerated oil will then be returned to the transformer via a vacuum de-gassing unit. The treatment plant described here does not include the de-gassing unit, mobile units for this purpose being already in existence within the power authorities.

Retreatment of transformer oils on site will require the assembly of the following facilities in the vicinity of the transformer: (a) Spent oil and regenerated oil tankage; (b) Hydrogenation process module; (c) Hydrogen supply module; (d) Hydrogenation control and monitoring unit; and (e) Vacuum de-gassing unit.

Figure 1:
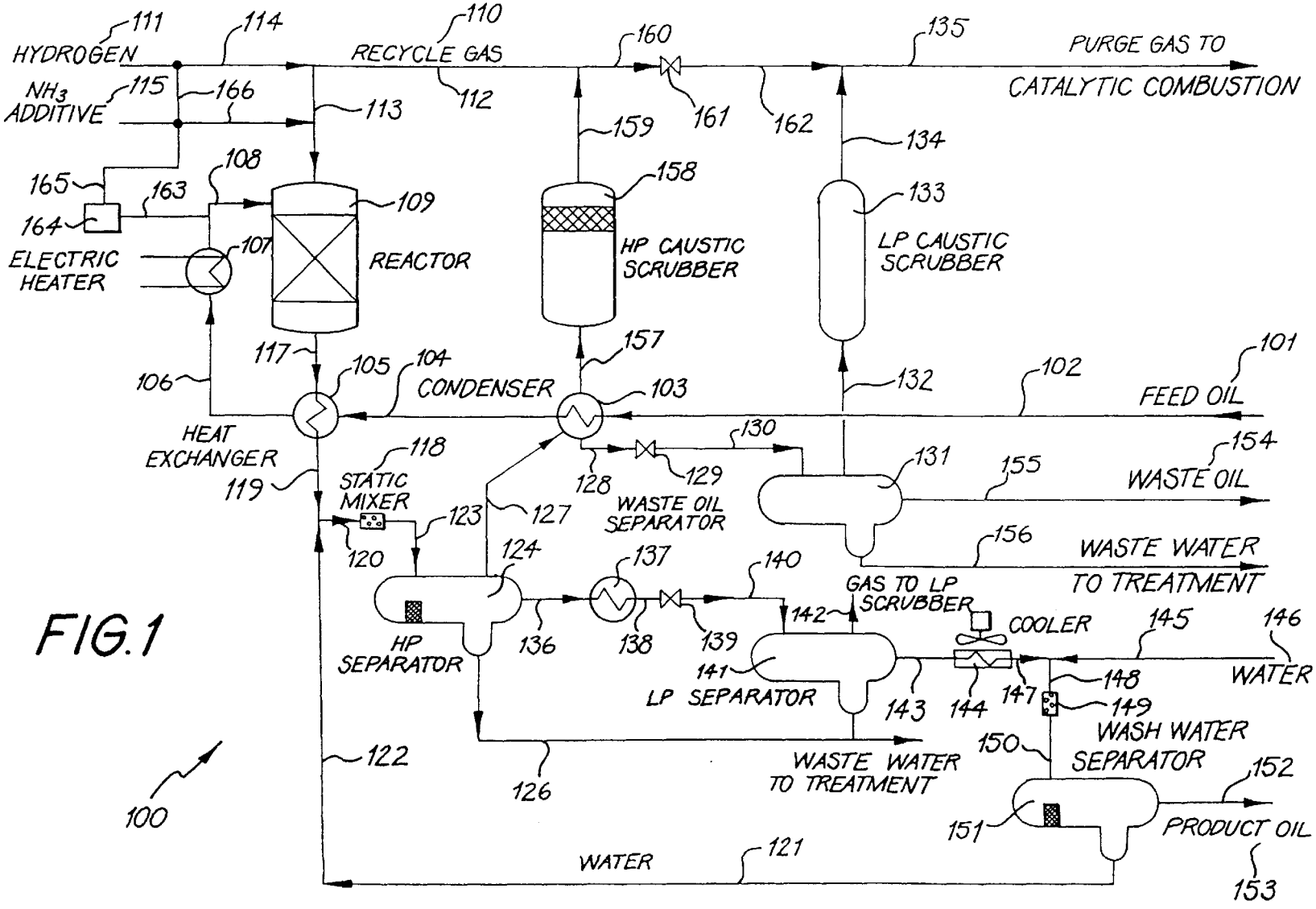
FIG. 1 depicts schematically a system for the simultaneous removal of chlorine from a chlorine containing organic compound and the reduction of oxygen containing organic compounds in spent transformer feed oil.

FIG. 1 depicts a system 100 for the simultaneous removal of chlorine from a chlorine containing organic compound and the reduction of oxygen containing organic compounds in spent transformer feed oil 101. Spent feed oil 101 from an on-site storage tank (not shown) is introduced to process 100 via a positive displacement charge pump (not shown) where the oil pressure is raised to around 4.3 MPa. Feed oil 101 passes via line 102 through high pressure vent condenser 103. Feed oil 101 passes in turn via line 104 to product oil heat exchanger 105 where it is heated to 285° C. Feed oil 101 then passes via line 106 to final feed heater 107, where it is raised to a temperature of 355° C. Heater 107 is an electrical element immersion heater designed to limit maximum oil contact temperatures to around 380° C. Feed oil 101 then passes into reactor 109 via line 108. Recycle hydrogen 110 and fresh hydrogen 111 are introduced into reactor 109 via lines 112 and 113, and 114 and 113 respectively. Ammonia 115 is also introduced into reactor 109 via lines 116 and 113. The chlorine (and/or oxygen content) of feed oil 101 may be monitored by monitor 164 via line 163 which in turn may make appropriate adjustments to the amount of input hydrogen chloride scavenger and input hydrogen via lines 165 and 166 (the amount of chlorine exiting the reactor as ammonium chloride may also be independently or simultaneously monitored by monitor 164 via an appropriate line (not shown) which in turn may make appropriate adjustments to the amount of input hydrogen chloride scavenger and input hydrogen via lines 165 and 166). The combination reacts in reactor 109 at approximately 330° C. and 3.5 MPa. The reactor comprises a single packed bed of a conventional hydrotreating catalyst (which has been sulphided) operating as a trickle bed. At the reaction conditions approximately 7% of the transformer oil enters the vapour phase and around 2.5% of the hydrogen is dissolved in the oil.

During reaction nitrogen and sulphur present as heteroatoms in feed oil 101 are converted to ammonia and hydrogen sulphide. Conversion rates are around 44% and 91% respectively. Chlorine present in the oil is derived primarily from PCB contamination of the oil. Chlorine is converted to HCl with a conversion level of 99.7%. Oxygenated degradation products present in the feed oil 101 are also hydrogenated with the oxygen being removed as water. Generally the quantities of water produced are small. Ammonia 115, introduced to reactor 109 to inhibit catalyst deactivation by HCl, and the HCl itself remains dissociated in the gas phase at the reactor conditions of temperature and pressure. Generally reactor 101 is designed so that at the potential pressures of these components in the reactor effluent vapour phase for a typical chlorine content in feed oil, deposition of solid $NH_4Cl$ does not occur above approximately 240° C.

In addition to extraction of heteroatoms and hydrodechlorination of PCBs, hydrogen is consumed in hydrogenating the oil itself to a small degree. This results in the generation of some light hydrocarbon vapours and liquids in the boiling range below that of the parent oil and these are subsequently separated out within the hydrotreating system and the separate vacuum de-gassing unit.

Effluent leaving reactor 109 passes first to heat exchanger 105 via line 117 where it is cooled to 235° C. against incoming feed oil. This temperature is marginally above that estimated for the onset of $NH_4Cl$ deposition and permits maximum cooling of the oil prior to contact with wash water. Under these conditions partial deposition of solid $NH_4Cl$ may occur and some fraction of this material could then remain in exchanger 105 as a fouling deposit. As the total quantity of $NH_4Cl$ available for deposition is small, approximately 2.75 kg or 1.8 liters over the course of processing the maximum 110,000 L transformer volume, and only a small fraction of this may deposit in exchanger 105, appropriate configuration of exchanger 105 to account for this possibility wil permit runs of this volume to be satisfactorily completed.

Cooled reactor effluent from heat exchanger 105 then passes in-line static mixer 118 via lines 119 and 120 where it is then contacted directly with wash water from the final product oil wash stage via lines 121, 122 and 120. The mixed stream is then passed from in-line static mixer 118 to high pressure separator 124 via line 123. Oil, water and gas phases are split in separator 124 which operates at 174° C. and 3.3 MPa.

Sufficient wash water is introduced to ensure that a liquid phase is present to dissolve $NH_4Cl$ as it is precipitated while minimising the quantity of aqueous effluent to be discharged from the plant. Wash water is used in the system at a rate of 27 kg/h representing a wash water to feed oil 101 rate of 7.46×10−2 kg/kg feed oil. In excess of 90% of this water leaves separator 124 in the vapour stream with $H_2S$, trace HCl, light hydrocarbons and some transformer oil vapours. The separator waste water phase containing $NH_4Cl$, $NH_3$ and $H_2S$ is sent to a neutraliser drum (not shown) via line 126 for treatment. Oil from the high pressure separator 124 passes to heat exchanger 137, via line 136, where it is cooled to 122° C. (which can be arranged (not shown) so that it is against incoming feed oil 101).

Product oil leaving condenser 137 passes to a let-down valve 139 via line 138 where the pressure is reduced to 221 kPa ahead of low pressure separator 141 to which it passes via line 140. Overhead vapours from this flash stage contain the majority of water and dissolved non-condensable hydrocarbons in the oil reducing the non-condensables load on the final de-gassing plant. These vapours additionally contain $NH_3$ and $H_2S$ and pass to low pressure caustic scrubber 133 via line 142 prior to venting to catalytic oxidation unit (not shown) via lines 134 and 135.

A very small liquid water flow is separated in the flash drum comprising low pressure separator 141 and the main product oil flow passes to air cooled product cooler 144 via line 143 where its temperature is reduced to 50° C. Fresh demineralised water 146 is introduced via line 145 into the product oil stream in line 147 and the combined flow passes via line 148 through in-line mixer 149 and line 150 to wash water Separator 151. Washed product oil 153 is then removed from separator 151 to an oil storage tank (not shown) via line 152 ahead of de-gassing. Separated water is passed back to the primary wash stage in high pressure separator 124 via lines 121, 122 and 120, static mixer 118 and line 123. A small vapour flow from the wash water separator 151 is passed to the low pressure caustic scrubber 133 (via a line not shown).

Vapour from the high pressure separator 124 passes to the high pressure vent condenser 103 via line 127 where it is cooled to 50° C. against incoming feed oil 101. Condensate, which is mainly water and small quantities of condensable hydrocarbons, is passed to waste oil separator 131 via line 128, valve 129 and line 130. Separated waste oil 154 is collected via line 155 in a drum for separate off-site disposal. Vent gases from separator 131 are passed to the low pressure caustic scrubber 133 via line 132. Separated water is passed to a waste water neutraliser (not shown) via line 156.

Non-condensable gases from the high pressure vent condenser 103 comprise mainly hydrogen, light hydrocarbons, $H_2S$ and $NH_3$. These are passed to the high pressure caustic scrubber 158 via line 157 where $H_2S$ is removed and collected into the caustic solution.

Gases pass counter-current to caustic solution in a packed tower. $H_2S$ is removed with the recirculated solution becoming saturated in $NH_3$. A sufficient quantity of caustic is provided to contain the $H_2S$ generated in a 110,000 liter transformer run with spent caustic disposed of to appropriate waste processing facilities off-site. Scrubbed gas from scrubber 158 is recycled via lines 159, 112 and 113 to reactor at around 3.27 MPa. Non-condensable gases produced in reactor 109 are removed from the system by taking a purge gas flow prior to compression. Purge gases are passed via lines 159, 160, valve 161, lines 162 and 135 to a catalytic oxidation unit (not shown) for combustion and combustion gases released to the atmosphere.

Recycle goes comprising $H_2$, light hydrocarbons, $NH_3$ and water are recompressed to 4.1 MPa and pass back to reactor 109.

Water streams from the HP and LP Separators 158 and 133 and waste oil separator 131 contain dissolved $H_2S$, $NH_4Cl$, trace HCl and trace $H_2$. These pass to waste water neutraliser (not shown) after neutralisation with HCl solution. Neutralised water is stripped with a flow of scrubbed purge gas in a packed tower on the inlet to the waste water neutralise. Separated water from this drum is passed to drain with its dissolved $NH_4Cl$. Any hydrocarbon liquids captured accumulate in the drum and are removed periodically. Stripper gas is passed back to the vent gas flow leaving the low pressure caustic scrubber 133.

Purge gas from the high pressure gas recirculation loop and all scrubbed vent gases pass together to the catalytic oxidation unit (not shown) where they are burnt at approximately 600° C. with approximately 400% excess air. Incoming air is provided with electrical pre-heating for start-up and for trimming catalyst bed temperature control if required.

Optimum operating conditions for catalytic reactor 109 in terms of $H_2$ and hydrogen chloride scavenger (eg $NH_3$) to feed ratios, reactor temperature and pressure may be adjusted to suit the particular solvent composition (eg transformer oil composition) being treated, particularly, in relation to its chlorine content. Deposition of $NH_4Cl$ in the reactor effluent heat exchanger 105 is possible. However, reactor conditions (i.e. temperature and pressure and feed rate) are generally adjusted such that in catalytic reactor 109 $NH_3$ formed or added to reactor 109 and HCl remain dissociated and in the gas phase. However when the reactor effluent leaves reactor 109 and as the reactor effluent is cooled, solid $NH_4Cl$ deposits out of the gas phase with the deposition temperature dependent on the partial pressures of $NH_3$ and HCl.

Figure 2:
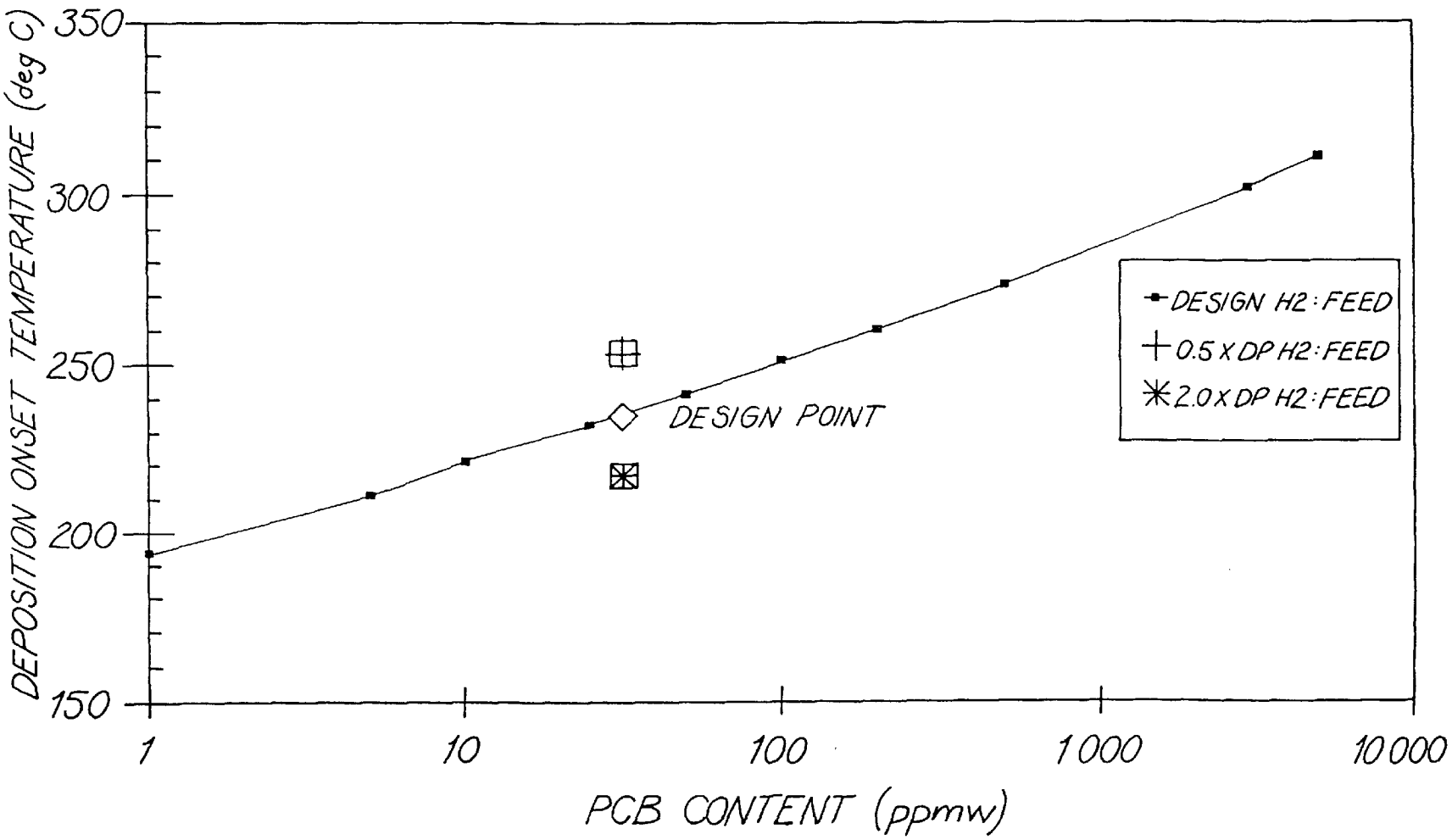
FIG. 2 depicts the temperature at which ammonium chloride deposits as a function of chlorine content in a feed oil at a of pressure 3.5 MPa.

While reactor pressure, $H_2$ and hydrogen chloride scavenger (eg $NH_3$) flowrates will typically be operated over a fairly narrow range, deposition temperature is primarily dependent on the chlorine content of the feed (which may vary considerably between individual solvents such as transformer oils). For example, a chlorine content of 19.1 ppmw is about equivalent to 32 ppmw PCB as hexachlorobiphenyl and the estimated deposition temperature is around 235° C. It is important that for a given chlorine (or other halide) content in the feed solvent, values of temperature and pressure are chosen such that there is no deposition of ammonium chloride (or other ammonium halide) or other acid neutralisation product, on the catalyst. Such deposition would firstly reduce catalyst activity by blocking active sites and eventually cause physical blockage of the reactor itself. The outlet of reactor effluent exchanger 105 is maintained at around this temperature to avoid deposition in the absence of liquid water. Wash water is introduced downstream of exchanger 105 at a sufficient rate to ensure the existence of sufficient liquid water to wash the oil and dissolve the $NH_4Cl$. As feed chlorine content increases the temperature at which $NH_4Cl$ deposition decreases requiring an increase in the exchanger 105 outlet temperature which in turn results in an increased wash water requirement and increased load on the high pressure vent condenser 103. Estimated sensitivity of deposition temperature to feed of deposition temperature to feed chlorine content is shown in FIG. 2. Some progressive fouling of reactor effluent heat exchanger 105 can be tolerated and detailed design should ensure that the unit can operate for the duration of processing the maximum transformer volumes without a need for cleaning.

Removal of $NH_4Cl$ deposits can most likely be normally carried out without disassembly at the completion of a run by allowing a reduced rate of oil at reduced $H_2$ pressure to flow through the exchanger 105 at near reactor temperature. $NH_4Cl$ could then be volatilised and subsequently removed in the wash water in the normal way.

Processing objectives for the mobile treatment plant are focused on the following main areas:

- Selection of a design processing rate consistent with treating a broad range of transformer sizes, in terms of oil volume, with minimum transformer downtime and providing the ability to treat as high a proportion of the transformer oil inventory as possible onsite.
- Regeneration of transformer oils by hydrogenation of oxidation and other oil ageing related components and destruction of residual PCBs where transformers have previously contained these materials at some level during normal service, or have been cross contaminated during oil refining or topping up activities. Key regeneration objectives are the full recovery of the electrical properties of the mineral oil, high yield of recovered oil for return to service, elimination of PCBs, where present in the oil, to levels below those where the oil would be regarded as a scheduled waste if removed from service.
- Minimisation of treatment plant effluents and emissions overall, and constraint of emissions during on-site operations to carefully controlled discharge of low volume of combustion gas and treated waste water. Small volumes of waste oil and caustic solutions from gas cleaning operation are contained within the unit, while on-site and disposed of separately to appropriate facilities.

In designing the process flowsheet for the plant depicted in FIG. 1, operating conditions and process performance have been based on experimental for processing of a particular sample of PCB contaminated transformer oil.

Details of the feed oil, experimental process performance, derived plant performance parameters and target oil quality data are outlined below.

Feed Oil Characteristics

Characteristics for the feed oil used in experimental runs defining the design performance data are those of sample HT14-Feed and are as follows:

Physical Properties and Composition

1. Boiling range as D-86 simulation based on GC analysis is given in Table BM1.1.

TABLE BM1.1

| FEED OIL DISTILLATION RANGE | | |
|---|---|---|
| | PERCENT OFF (vol %) | BOILING POINT |
| | IBP | 308.1 |
| | 10 | 338.6 |
| | 20 | 348.3 |
| | 30 | 352.9 |
| | 50 | 360.5 |
| | 70 | 367.8 |
| | 80 | 370.5 |
| | 90 | 382.1 |
| | FBP | 405.3 |
| 2. | Oil Density = | 870 kg/m$^3$ @ 20° C. |
| 3. | Composition: | |
| | Sulphur content = | 400 mg/kg |
| | Nitrogen content = | 12.9 mg/L |
| | Chlorine content = | 19.1 mg/kg. |

Electrical and other properties considered key parameters in the specifications for transformer oils are shown in Table BM1.3 along with product oil analyses and target values.

Process Conditions

Optimised processing conditions were selected from a broad series of runs, and tested in the experimental rig. This optimised data as represented by sample HT16.3 has been taken as the design basis for the process and is presented below.

Reactor Operating Conditions

| | |
|---|---|
| Pressure = | 3.5 MPag |
| Temperature = | 330° C. |
| Weight Hourly Space Velocity = | 3.0 h$^{-1}$ |
| Hydrogen Consumption by Reaction = | $2.389 \times 10^{-2}$ kg $H_2$/kg feed oil |
| Hydrogen at Reactor Inlet = | $2.007 \times 10^{-2}$ kg $H_2$/kg feed oil |
| Ammonia at Reactor Inlet = | $6.121 \times 10^{-4}$ kg $NH_3$/kg feed oil |
| Removal of Heteroatoms from Oil: | |
| Sulphur elimination = | 91.24% |
| Chlorine elimination = | 99.68% |
| Nitrogen elimination = | 44.2% |
| Product Oil Characterisics | |

Product oil boiling range is given as the bottom oil before vacuum degassing. The boiling range as a D-86 simulation from GC analysis data is given in Table BM1.2.

TABLE BM1.2

| PRODUCT OIL BOILING RANGE (BEFORE DE-GASSING) | |
|---|---|
| PERCENT OFF (vol %) | BOILING POINT (° C.) |
| IBP | 269.1 |
| 10 | 322.5 |
| 20 | 335.4 |
| 30 | 342.6 |
| 50 | 354.0 |
| 70 | 364.2 |
| 80 | 368.1 |
| 90 | 380.5 |
| FBP | 404.7 |
| Oil Composition: | |
| Sulphur content = | 35 mg/kg |
| Nitrogen content = | 7.2 mg/L |
| Chlorine content = | 0.06 mg/kg |

Total PCB content measured for 2 product oil samples from runs other than HT-16.3 (for reactor conditions 5.0 MPag, WHSV 1.0, 320° C.) was less than 10 ppb in both samples. PCB destruction is therefore likely to be significantly greater than the measured chlorine elimination from the oil.

| | |
|---|---|
| Oil yield after vacuum degassing = | 99.57% on feed oil in experiment HT-16.3. |
| Flow sheet oil yield after degassing = | 99.23% feed oil |
| Comparative Electrical Properties | |

Table BM1.3 shows the key insulating oil parameters appearing in specifications as measured for the feed and product oils along with indicative target values. Product oil electrical properties were measured after vacuum degassing at 0.7 mbar and 77° C.

TABLE BM1.3

| INSULATING OIL PROPERTIES | | | | | | |
|---|---|---|---|---|---|---|
| SAMPLE | FLASH POINT (° C.) | ACIDITY (mg KOH/g) | INTERFACIAL TENSION (mN/M) | DDF (mW/VAR) | RESISTIVITY (Gohm · m) | ELECTRICAL STRENGTH (kV) |
| Feed Oil HT14 | 155 | 0.06 | 24.1 | 73.2 | 4.5 | 44 |
| Product Oil HT 16.3 | 142 | 0 | 47.2 | 0.2 | 6500 | >71 |
| Target New Oil | >130 | 0.03 max | 35 min | 5 max | 60 min | 30 min |
| Action Limits | | 0.2 | 20 | 100 | 10 | |

Results indicated for product oil based on the optimised experimental run HT-16.3 indicates that with respect to these key parameters the product oil meets the specifications set for new transformer oils. Some 26 runs were conducted in this series over a range of operating conditions. Twenty three runs met the target new oil specification with the other three failing by reduced flash point only. In these three runs reactor operating conditions included the highest temperature in conjunction with the lowest space velocities used in the trials, i.e. the most severe hydrogenation conditions in the series. Under these conditions the greater proportion of light ends produced results in an increase in volatile components remaining after vacuum distillation.

The range of operating conditions covered in the trials is as follows:

| | |
|---|---|
| Pressure range = | 2–5 MPag |
| Temperature range = | 320–360° C. |
| WHSV = | 1–3 $hour^{-1}$ |
| Feed chlorine content = | 19.1–91 ppmw |
| Product chlorine content = | 0.06–0.54 ppmw |

Control of reactor conditions around the currently identified optimum of 330° C. at 3.5 MPag and WHSV of 3.0 $hour^{-1}$ is readily achieved and could be expected to result in consistent product characteristics from a particular feed.

The process of the invention is now described with reference to the following examples:

EXAMPLE 1

Whilst the following examples exemplify a process wherein the hydrocarbon oil is a hydrocarbon transformer oil, it will be appreciated that the process of the invention has a far wider application to other similar oils.

Used hydrocarbon transformer oil, containing mixed PCBs equivalent to 20 ppm of Arochlor 1242 (8.3 ppm chlorine) was mixed with 720 ppm of triethylamine, and fed into a high pressure reactor. The reactor was a stainless steel tube 15.8 mm ID×510 mm length, containing 90 g or catalyst (Cyanamid Trilobe HDN 60, 1.6 mm extrudates) in its sulfided form. Hydrogen was co-fed into the reactor at a flow rate of 0.22 liter/gram oil. The reactor was incorporated into a high pressure system designed for extended operation. The non-gaseous reaction products were washed with water (1×6 vol %, 2×2 vol %) and analysed for total chlorine by neutron activation analysis. The starting material was similarly analysed. The treated hydrocarbon transformer oil was heated to 60° C. under a vacuum or 0.13 MPa to remove volatile products; the residue remaining (expressed as a percentage of the contaminated hydrocarbon oil feed), was the "recovered oil" in Table 1.

The results of the experiments (Table 1) show that it is clearly possible to select operating conditions such that the PCB contaminants in the hydrocarbon transformer oil are effectively destroyed without at the same time significantly affecting the hydrocarbon transformer oil itself. In particular, the results of run 6 in Table 1 indicate a 96.7% removal of chlorine, while at the same time giving a 99.2% recovery of oil. The recovered oil from runs 2 and 6 was analysed for PCBs by gas chromatography-mass spectrometry. Both samples contained less than the lower detection limit of 0.01 ppm, which represents a destruction efficiency of greater than 99.95%.

TABLE 1

SUMMARY OF EXPERIMENTS

| Run No. | Cumulative Time-on-stream (hours) | Reactor temperature (° C.) | Reactor pressure (MPa) | Space velocity ($h^{-1}$) | Chloride removal (%) | Recovered oil (wt %) |
|---|---|---|---|---|---|---|
| 1 | 11 | 350 | 5 | 1 | 99.3 | 94.5 |
| 2 | 21 | 350 | 5 | 1.5 | 98.9 | 96.4 |
| 3 | 29 | 320 | 5 | 1.5 | 97.6 | 99.1 |
| 4 | 36 | 350 | 5 | 2 | 98.3 | 97.7 |
| 5 | 45 | 320 | 5 | 1 | 99.1 | 98.9 |
| 6 | 55 | 320 | 3 | 1.5 | 96.7 | 99.2 |

The oil recovered from these experiments was tested for its suitability as hydrocarbon transformer oil using standard methods. The results (Table 2) show that product oils with extremely high specification were produced.

TABLE 2

SUMMARY OF PROPERTIES OF OILS AFTER TREATMENT

| | Dielectric dissipation factor (mwatts/var) | Resistivity (G ohm meters) | Dielectric Strength (Kv) |
|---|---|---|---|
| Specification value | <10 | >60 | >45 |
| Starting material | 470 | 1.2 | 58 |
| Run 1 | 1.6 | 796 | 84 |
| Run 2 | 1.1 | 926 | 79 |
| Run 3 | 1.1 | 1,250 | 79 |
| Run 4 | 8.7 | 376 | 59 |
| Run 5 | 0.7 | 1,850 | 79 |
| Run 6 | 6.6 | 486 | 67 |

SUMMARY

The above experiments show that the disclosed procedures:

effectively destroy polychlorinated biphenyls (commonly known as PCBs) present in hydrocarbon transformer oils.

result in a product hydrocarbon oil with excellent properties for use as a hydrocarbon transformer oil.

EXAMPLE 2

Solutions of hexachlorobenzene, DDT, and 1,2,3,4-tetrachlorodibenzodioxin (an isomer of the environmental pollutant "dioxin") in automotive diesel oil were made, the concentrations being as shown in Table 3. These solutions were mixed with 3600 ppm of triethylamine, (i.e. 500 ppm N) and fed into a high pressure reactor at a rate of 135 $gh^{-1}$. The reactor was a stainless steel tube 15.8 mm ID×510 mm length, containing 90 g of catalyst (Cyanamid Trilobe HDN 60 1.6 mm extrudates) in its sulfided form held at 350° C. Hydrogen was co-fed into the reactor at a flow rate of 0.22 liter/gram oil and a pressure of 5 MPa. The reactor was incorporated into a high pressure system specially designed for extended operation.

The non-gaseous reaction products were washed with water (1×5 vol. %, 3×2 vol. %) and analysed by gas chromatography-mass spectrometry. The results of the experiments, (Table 3) show that high levels of destruction of the chlorinated hydrocarbons were obtained in all cases. In all cases, the concentration of chlorinated hydrocarbon in the product was below the detection limit of the instrument.

TABLE 3

SUMMARY OF EXPERIMENTS

| Chlorinated hydrocarbon | Initial concentration (ppm) | Concentration in Product (ppb) | Destruction Efficiency (%) |
|---|---|---|---|
| HCB | 1340 | <5 | >99.9996 |
| DDT | 2000 | <15 | >99.9993 |
| Dioxin isomer | 46 | <0.004 | >99.9999 |

Figure 3:
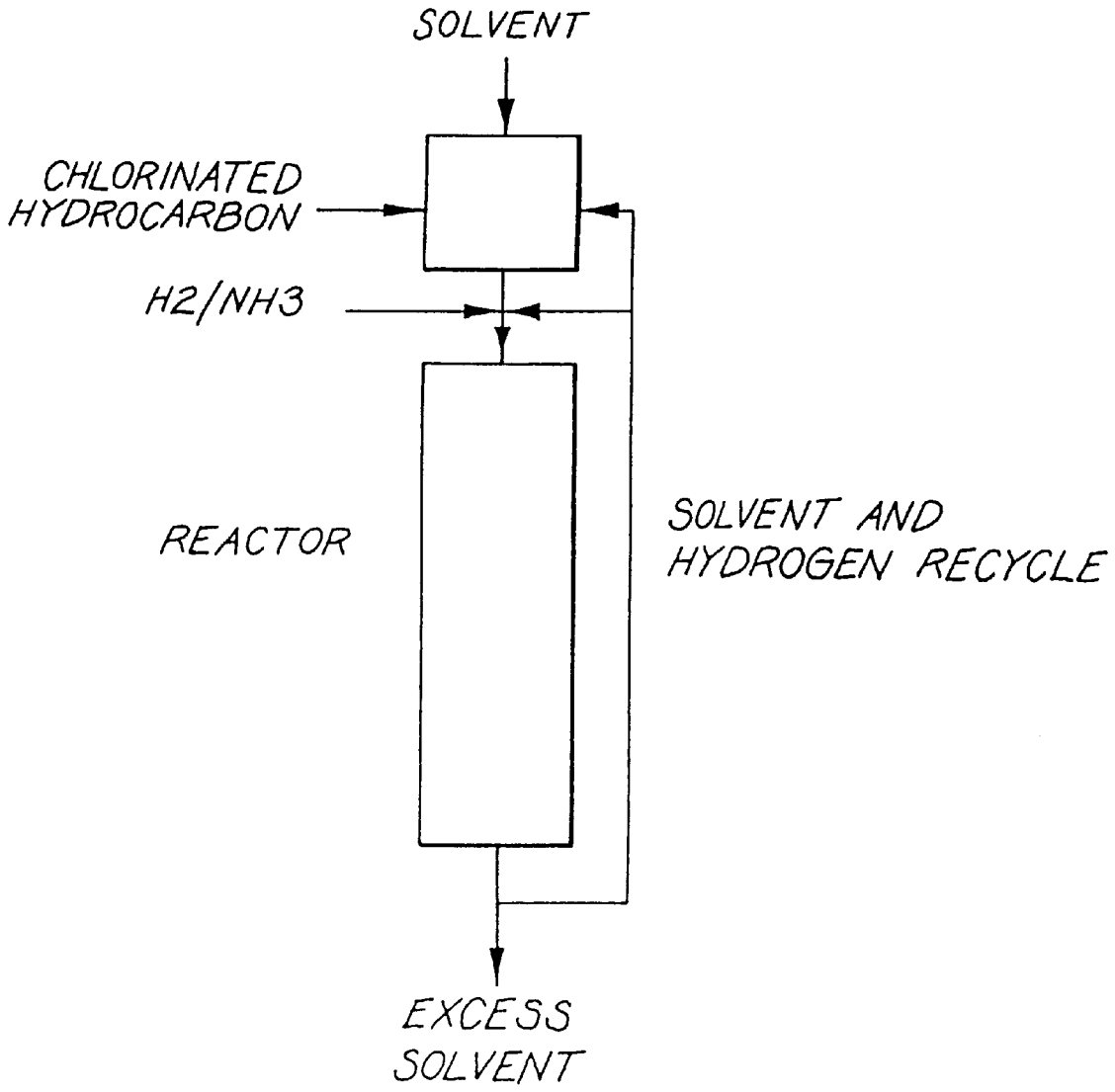
FIG. 3 depicts schematically a process flowsheet for the removal of chlorinated hydrocarbons.

Those skilled in the art will understand that a practical way of incorporating the above into a continuous process is as shown in FIG. 3. The chlorinated hydrocarbon to be destroyed is dissolved in the chosen solvent, and the solution fed to the high pressure reactor. The amine and/or ammonia is added either to the hydrogen feed, or to the chlorinated hydrocarbon solution. After leaving the catalytic reactor, the solvent, and unreacted hydrogen are recovered and recycled. Excess solvent is withdrawn from the system.

EXAMPLE 3

1. INTRODUCTION

The present inventors have discovered a process which not only reduces the PCB level of contaminated transformer oil to below the detection limit of 0.01 mg/kg, but also restores its resistivity, dielectric dissipation factor and dielectric strength to near new values. This example covers results obtained from Runs 1 to 5 (CSIRO designations HT14 to HT18, respectively.

2. EXAMPLE AIMS

The technical aims of this example were to:

Optimise the process conditions for PCB removal and regeneration of oil, desirable values of oil quality parameters being defined as (a) Dielectric Dissipation Factor 3 to $6\times10^{-3}$ (max), (b) Resistivity >200 Gohmm, (c) Dielectric Strength >60 kV, (d) Acidity 0.01 to 0.03 mg KOH/g (max), (e) Interfacial Tension >30 mN/m, and (f) PCB content <0.1 mg/kg.

3. RESULTS AND DISCUSSION

3.1 RUN 1 (HT14)

3.1.1 Feed Description and Operating Procedures

This run was carried out with used transformer oil considered as typical for regeneration. Its total chlorine level was found to be 19.1 mg/kg and PCB content, 24 mg/kg.

A description and schematic diagram of the hydrotreating apparatus used for this project given is Appendix A. It should be noted that water (5 wt % of oil feed) is injected into the product stream, maintained at 300° C. to this point, to dissolve ammonium chloride produced in the reactor, and that the entire product stream is cooled (to 30° C.) before separation of gas and liquid phases. This necessitates vacuum treatment of the product oil, in order to remove minor quantities of volatile hydrocarbons formed by cracking reactions in the reactor. In the proposed Process Development Unit ("PDU") and commercial scale designs, phase separation will be carried out at a sufficiently high temperature to keep the cracking products in the gas phase.

Triethylamine (0.3642 wt %, ie. 500 mg/kg N) was added to the oil to supply ammonia in the reactor, and approximately 15 liters of feed was processed in a 4-day continuous run. Weight hourly space velocity (WHSV, 1, 2 and 3 $h^{-1}$), catalyst temperature (320, 340 and 360° C.), and system pressure (2, 3.5 and 5 MPa) were varied systematically so that the effect of these parameters on product properties could be analysed mathematically. A constant hydrogen ratio of 2 wt % was used. In all, eleven sets of conditions were applied, including two repeats of the "centre-point", and three sub-samples (A, B and C) obtained from each. Mass and elemental balances were usually carried out on the B sample.

Sub-samples were washed with distilled water (3×1.5 vol %), to remove residual ammonium chloride and sulfide, and then vacuum treated to remove volatiles. This involved combining, the three subsamples and then heating the oil to 77° C. under a vacuum of 0.7 mbar.

3.1.2 Trace Elements and PCB in Product Oils

The sulfur, nitrogen and chlorine contents of the feed oil and products from each of the conditions (before vacuum treatment) are shown in Table 3.1, together with the operating parameters. PCB contents of selected samples are also shown, but these analyses were carried out on the oil after vacuum treatment.

Importantly, between 98.5 and 99.5% removal of chlorine was achieved. PCB analyses were carried out by gas chromatography with electron capture detection (ECD); all products contained less than the detection limit of 0.1 mg/kg. It is relevant that samples with 0.05 and 0.27 mg/kg chlorine, (samples from Runs 2 and 6 of Example 1), were both found to contain less than 0.01 mg/kg of PCB, using the more sensitive technique of isotope dilution gc-ms.

As expected, removal of sulfur (as hydrogen sulfide) was also extensive at all conditions, whereas nitrogen removal is much more difficult. The close similarity of the results from the three centre-point samples (1, 6 and 11) imply that during this run, there was negligible loss of catalyst activity.

TABLE 3.1

Elemental Composition of Product Oils - Run 1

| Sample (° C./MPa/WHSV) | Sulfur (mg/kg) | Nitrogen (mg/L) | Chlorine (mg/kg) | PCB (mg/kg) |
|---|---|---|---|---|
| HT14-1 (340/3.5/2) | 15.0 | 2.4 | 0.15 | <0.1 |
| HT14-2 (360/2/1) | 9.8 | 3.5 | 0.22 | <0.1 |
| HT14-3 (320/2/1) | 22.2 | 5.0 | 0.29 | — |
| HT14-4 (320/2/3) | 44.6 | 8.6 | 0.22 | <0.1 |
| HT14-5 (320/5/3) | 56.8 | 4.3 | 0.14 | — |
| HT14-6 (340/3.5/2) | 17.8 | 2.9 | 0.16 | <0.1 |
| HT14-7 (360/2/3) | 15.4 | 5.9 | 0.18 | — |
| HT14-8 (320/5/1) | 13.4 | 3.1 | 0.09 | <0.1 |
| HT14-9 (360/5/3) | 13.7 | 2.7 | 0.16 | — |
| HT14-10 (360/5/1) | 7.1 | 1.5 | 0.13 | <0.1 |
| HT14-11 (340/3.5/2) | 12.6 | 2.7 | 0.17 | — |
| HT14-Feed | 395 | 12.9 | 19.1 | 24 |

3.1.3 Hydrogen Consumptions

A major part of the operating cost of the proposed process is expected to arise from hydrogen consumption, so it is clearly advantageous to minimise this quantity. Consumptions during this run, calculated as the difference between hydrogen into and out of the reactor, are presented in Table 3.2. Due to the extreme difficulty of obtaining these figures, their accuracy is unlikely to be better than ±0.03 grams. It is important to note that these quantities include the 0.022 grams consumed by the triethylamine in its conversion into ammonia and ethane, plus hydrogen dissolved in the product oil at operating pressure.

TABLE 3.2

Hydrogen Consumptions - Run 1

| Sample (° C./MPa/WHSV) | Hydrogen Consumption (g $H_2$/100 g Feed) |
|---|---|
| HT14-1 (340/3.5/2) | 0.220 |
| HT14-2 (360/2/1) | −0.174 |
| HT14-3 (320/2/1) | 0.176 |
| HT14-4 (320/2/3) | 0.122 |
| HT14-5 (320/5/3) | 0.228 |
| HT14-6 (340/3.5/2) | 0.196 |
| HT14-7 (360/2/3) | −0.005 |
| HT14-8 (320/5/1) | 0.329 |
| HT14-9 (360/5/3) | 0.265 |
| HT14-10 (360/5/1) | 0.373 |
| HT14-11 (340/3.5/2) | 0.232 |

A regression equation, which assumes first order reaction in a plug flow reactor and includes diffusion and interaction effects, was applied to this data. The resulting formula, which predicts the observed hydrogen consumptions to within 0.03 grams, is shown below.

$$H=-7.98+4727.6/K+5.087\ \ln P+1.646\ \ln SV-905.5(\ln SV)/K-0.1612\ \ln SV\ \ln P-2880(\ln P)/K$$

where, H=hydrogen consumption in g/100 g of feed, K=temperature in °K.

3.1.4 Vacuum Treatment of Product Oils

Yields from distillation of the combined product subsamples of each of the eleven conditions are shown in Table 3.3. "Residue" is the oil remaining after removal of volatiles, as described in Section 3.1.1. "Distillate" was material collected at dry-ice temperature, while the loss is attributed to materials not condensable at these conditions, such as hydrocarbons lighter than about $C_6$. The final column gives the overall yield of vacuum treated oil, and is based on 100 g of oil fed into the hydrotreater excluding the added triethylamine. The results clearly show that high temperatures and low space velocities cause extensive cracking of the oil (eg. samples 2 and 10) while very high yields of useful oil can obtained at most conditions.

TABLE 3.3

Distillation Data - Run 1

| Sample | Residue (g/100 g Product Oil) | Distillate (g/100 g Product Oil) | Loss (g/100 g Product Oil) | Yield (g/100 g Feed Oil) |
|---|---|---|---|---|
| HT14-1 | 97.73 | 2.04 | 0.23 | 97.55 |
| HT14-2 | 94.12 | 5.41 | 0.47 | 93.06 |
| HT14-3 | 99.21 | 0.66 | 0.14 | 99.07 |
| HT14-4 | 99.73 | 0.19 | 0.08 | 99.67 |
| HT14-5 | 99.72 | 0.13 | 0.15 | 99.75 |
| HT14-6 | 98.96 | 0.89 | 0.15 | 98.77 |
| HT14-7 | 98.19 | 1.58 | 0.23 | 97.80 |
| HT14-8 | 99.25 | 0.61 | 0.14 | 99.33 |
| HT14-9 | 98.16 | 1.57 | 0.27 | 97.91 |
| HT14-10 | 97.76 | 4.80 | 0.45 | 94.40 |
| HT14-11 | 98.72 | 1.10 | 0.18 | 98.58 |

3.1.5 Electrical and Other Properties of Vacuum Treated Oils

The vacuum treated oils and raw feed oil were analysed; the results are shown in Table 3.4. DDF, resistivity and electrical strength all show remarkable improvement over the feed values. However, there is little apparent correlation between these properties and the processing conditions. It is possible that inconsistencies in sample preparation or contamination may have occurred, but the most likely explanation is that polarisation of the samples, noted later during analysis of Run 2 samples (Section 3.2.5), was not allowed for. This phenomenon can severely affect resistivity and DDF measurements.

The interfacial tension and acidity results show that very efficient destruction of polar oxidation products present in the oil has been achieved. The considerable variation in the flash point data, with most samples falling below the 140° C. minimum, indicates that distillation to a final temperature of 77° C. is not satisfactory.

TABLE 3.4

Electrical Properties of Vacuum Treated Oils - Run 1

| Sample (° C./MPa/WHSV) | Flash Point (° C.) | Acidity (mgKOH/g) | Interfacial tension (mN/m) | DDF (mW/VAR) | Resistivity (Gohmm) | Electrical Strength (kV) |
|---|---|---|---|---|---|---|
| HT14-1 (340/3.5/2) | 136 | 0.01 | 45.5 | 1.1 | 841 | 75 |
| HT14-2 (360/2/1) | 131 | 0.01 | 43.9 | 1.9 | 129 | 79 |
| HT14-3 (320/2/1) | 138 | 0.01 | 46.1 | 0.9 | 484 | 81 |
| HT14-4 (320/2/3) | 143 | <0.01 | 46.7 | 3.5 | 275 | 76 |
| HT14-5 (320/5/3) | 142 | 0.01 | 45.1 | 2.6 | 289 | 79 |
| HT14-6 (340/3.5/2) | 141 | <0.01 | 47.5 | 1.8 | 470 | 77 |
| HT14-7 (360/2/3) | 130 | 0.02 | 40.3 | 2.1 | 265 | 82 |
| HT14-8 (320/5/1) | 140 | <0.01 | 49.6 | 0.8 | 761 | 76 |
| HT14-9 (360/5/3) | 132 | 0.01 | 48.0 | 1.0 | 876 | 87 |
| HT14-10 (360/5/1) | 128 | <0.01 | 48.2 | 1.8 | 528 | 80 |
| HT14-11 (340/3.5/2) | 132 | <0.01 | 45.2 | 0.4 | 969 | 85 |
| HT14-Feed | 155 | 0.06 | 24.1 | 73.2 | 4.5 | 44 |

3.1.6 Mass and Elemental Balances

Mass balances for Run 1 are shown in Table 3.5. With reference to "components out", oil refers to the yield after washing with water, while hydrogen and the individual hydrocarbons are from the off-gas analyses. Hydrogen sulfide and ammonia figures are from off-gas plus combined wash water analyses; hydrogen chloride is calculated from the chloride concentration in the wash water only.

Excellent total recovery figures were obtained in all cases, averaging 99.74%. The most significant losses occur during water washing of the oil, and when the oil is discharged from the hydrotreater. The latter is due to gases and light hydrocarbons, dissolved in the oil at system pressure, escaping from solution when the pressure is reduced to atmospheric.

The recoveries of chlorine shown in Table 3.8 are clearly erratic, although perhaps fortuitously, they average just over 100%. This results from the fact that the apparatus was not designed originally for this project. There is a considerable distance between the end of the catalyst bed and the point at which water is injected into the product stream, providing the opportunity for solid ammonium chloride to deposit from the gas phase onto the exit line, before being washed out later. There is some evidence to support this explanation, because the recoveries are lowest at three of the highest pressure conditions (5, 8 and 9), when deposition would be favoured, and are highest at the two low pressure/high space velocity conditions (4 and 7).

TABLE 3.5

Mass Balance Data - Run 1

| Sample | HT14-1B | HT14-2B | HT14-3B | HT14-4B | HT14-5B | HT14-6B | HT14-7C | HT14-8B | HT14-9B | HT14-10B | HT14-11B |
|---|---|---|---|---|---|---|---|---|---|---|---|
| Component In (g/100 g Feed) | | | | | | | | | | | |
| Oil | 99.64 | 99.64 | 99.64 | 99.64 | 99.64 | 99.64 | 99.64 | 99.64 | 99.64 | 99.64 | 99.64 |
| Triethylamine | 0.3624 | 0.3624 | 0.3624 | 0.3624 | 0.3624 | 0.3624 | 0.3624 | 0.3624 | 0.3624 | 0.3624 | 0.3624 |
| Hydrogen | 1.994 | 1.945 | 1.937 | 1.987 | 2.026 | 1.992 | 2.001 | 2.033 | 1.996 | 1.981 | 2.014 |
| TOTAL IN | 101.9937 | 101.9447 | 101.9369 | 101.9867 | 102.0263 | 101.9918 | 102.0012 | 102.0326 | 101.9961 | 101.9814 | 102.0141 |
| Component Out (g/100 g Feed) | | | | | | | | | | | |
| Oil | 99.44 | 98.51 | 99.50 | 99.57 | 99.67 | 99.45 | 99.24 | 99.72 | 99.39 | 99.27 | 99.50 |
| Methane | 0.0264 | 0.1160 | 0.0117 | 0.0054 | 0.0044 | 0.0162 | 0.0384 | 0.0104 | 0.0307 | 0.0805 | 0.0185 |
| Ethane | 0.2919 | 0.4027 | 0.2874 | 0.2981 | 0.2420 | 0.2868 | 0.3293 | 0.2509 | 0.2709 | 0.3176 | 0.2918 |
| Propane | 0.0618 | 0.2111 | 0.0336 | 0.0151 | 0.0077 | 0.0358 | 0.0814 | 0.0199 | 0.0515 | 0.1013 | 0.0449 |
| i-Butane | 0.0145 | 0.0629 | 0.0072 | 0.0036 | 0.0012 | 0.0066 | 0.0193 | 0.0040 | 0.0102 | 0.0218 | 0.0088 |
| n-Butane | 0.0159 | 0.0645 | 0.0101 | 0.0045 | 0.0027 | 0.0093 | 0.0236 | 0.0045 | 0.0125 | 0.0231 | 0.0112 |
| Pentanes | 0.0132 | 0.0393 | 0.0024 | 0.0067 | 0.0064 | 0.0090 | 0.0160 | 0.0077 | 0.0125 | 0.0196 | 0.0105 |
| Hexanes | 0.0016 | 0.0106 | 0.0004 | 0.0000 | 0.0000 | 0.0000 | 0.0019 | 0.0097 | 0.0107 | 0.0021 | 0.0098 |
| Hydrogen Sulfide | 0.0290 | 0.0377 | 0.0293 | 0.0273 | 0.0292 | 0.0340 | 0.0323 | 0.0285 | 0.0347 | 0.0323 | 0.0322 |
| Ammonia | 0.0510 | 0.0538 | 0.0582 | 0.0592 | 0.0568 | 0.0603 | 0.0619 | 0.0521 | 0.0626 | 0.0682 | 0.0606 |
| Hydrogen Chloride (aq) | 0.0020 | 0.0023 | 0.0027 | 0.0048 | 0.0005 | 0.0016 | 0.0041 | 0.0003 | 0.0004 | 0.0028 | 0.0007 |
| Hydrogen | 1.7730 | 2.1180 | 1.7610 | 1.8640 | 1.7980 | 1.7950 | 2.0060 | 1.7050 | 1.7320 | 1.6070 | 1.7810 |
| TOTAL OUT | 101.7204 | 101.6289 | 101.7037 | 101.8589 | 101.8186 | 101.7043 | 101.8542 | 101.8130 | 101.6085 | 101.5466 | 101.7704 |
| Recovery (%) | 99.73 | 99.69 | 99.77 | 99.87 | 99.80 | 99.72 | 99.86 | 99.78 | 99.62 | 99.57 | 99.76 |

Recoveries of sulfur in gas, water and oil phases are shown in Table 3.6. Overall recoveries are moderately good.

Nitrogen recoveries (Table 3.7) are considerably better than the sulfur figures. This is due to the excellent solubility of ammonia in water, which also accounts for the majority of the nitrogen being found in the aqueous phase. It should be noted that in this run, most of the liberated nitrogen is in the form of ammonia and ammonium sulfide; theoretically, only about 2.8 mg of ammonium chloride is formed per 100 g of feed.

TABLE 3.6

Sulfur Recoveries - Run 1.

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Sulfur Recovery (%) |
|---|---|---|---|---|---|---|
| HT14-1B | 6.10 | 21.07 | 1.49 | 28.66 | 39.36 | 72.8 |
| HT14-2B | 10.23 | 25.12 | 0.96 | 36.31 | 39.36 | 92.3 |
| HT14-3B | 8.63 | 18.90 | 2.21 | 29.75 | 39.36 | 75.6 |
| HT14-4B | 8.54 | 17.05 | 4.44 | 30.03 | 39.36 | 76.3 |
| HT14-5B | 5.40 | 22.06 | 5.66 | 33.07 | 39.36 | 84.0 |
| HT14-6B | 7.69 | 24.24 | 1.77 | 33.71 | 39.36 | 85.6 |
| HT14-7B | 11.17 | 19.19 | 1.53 | 31.88 | 39.36 | 81.0 |
| HT14-8B | 5.91 | 20.79 | 1.34 | 28.04 | 39.36 | 71.2 |
| HT14-9B | 6.66 | 25.94 | 1.36 | 33.97 | 39.36 | 86.3 |
| HT14-10B | 4.97 | 25.37 | 0.70 | 31.05 | 39.36 | 78.9 |
| HT14-11B | 7.88 | 22.36 | 1.25 | 31.49 | 39.36 | 80.0 |

TABLE 3.7

Nitrogen Recoveries - Run 1.

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Nitrogen Recovery (%) |
|---|---|---|---|---|---|---|
| HT14-1B | 0.82 | 41.15 | 0.27 | 42.24 | 51.45 | 82.1 |
| HT14-2B | 2.06 | 42.23 | 0.39 | 44.67 | 51.45 | 86.8 |
| HT14-3B | 1.81 | 46.09 | 0.56 | 48.46 | 51.45 | 94.2 |
| HT14-4B | 2.72 | 46.01 | 0.96 | 49.69 | 51.45 | 96.6 |
| HT14-5B | 1.15 | 45.59 | 0.48 | 47.23 | 51.45 | 91.8 |
| HT14-6B | 1.89 | 47.76 | 0.32 | 49.97 | 51.45 | 97.1 |
| HT14-7B | 2.06 | 48.86 | 0.66 | 51.57 | 51.45 | 100.3 |
| HT14-8B | 0.82 | 42.04 | 0.35 | 43.17 | 51.45 | 83.9 |
| HT14-9B | 0.90 | 50.64 | 0.30 | 51.84 | 51.45 | 100.8 |
| HT14-10B | 0.74 | 55.37 | 0.17 | 56.28 | 51.45 | 109.4 |
| HT14-11B | 1.65 | 48.26 | 0.30 | 50.14 | 51.45 | 97.5 |

TABLE 3.8

Chlorine Recoveries - Run 1.

| Sample | Aqueous Phase (mg/100 g Feed) | Oil Phase (mg/100 g Feed) | Total Cl Out (mg/100 g Feed) | Total In (mg/100 g Feed) | Chlorine Recovery (%) |
|---|---|---|---|---|---|
| HT14-1B | 1.98 | 0.015 | 1.99 | 1.90 | 104.8 |
| HT14-2B | 2.26 | 0.022 | 2.28 | 1.90 | 119.9 |
| HT14-3B | 2.62 | 0.029 | 2.65 | 1.90 | 139.3 |
| HT14-4B | 4.62 | 0.022 | 4.64 | 1.90 | 244.4 |
| HT14-5B | 0.46 | 0.014 | 0.47 | 1.90 | 24.8 |
| HT14-6B | 1.56 | 0.016 | 1.58 | 1.90 | 83.1 |
| HT14-7B | 3.95 | 0.018 | 3.97 | 1.90 | 208.8 |
| HT14-8B | 0.33 | 0.009 | 0.34 | 1.90 | 18.1 |
| HT14-9B | 0.43 | 0.016 | 0.45 | 1.90 | 23.4 |
| HT14-10B | 2.68 | 0.013 | 2.69 | 1.90 | 141.6 |
| HT14-11B | 0.69 | 0.017 | 0.71 | 1.90 | 37.3 |

3.2 RUN 2 (HT15)

3.2.1 Feed Description and Operating Parameters

The purpose of this run was to determine the effects (if any) on product quality of a much larger concentration of PCB in the feed, equivalent to the highest likely to be encountered in practice. Accordingly, 200 mg/kg of pure PCB (Type 1016, drained from a Plessy Type APF 265 OR capacitor) was added to the same feed mix used in Run 1, and the same set of operating conditions repeated. However, an additional condition (340° C./3.5 MPa/WHSV3) was included at the end of the run.

3.2.2 Trace Elements and PCB in Product Oils

The sulfur, nitrogen and chlorine contents of the feed oil and products from each condition (before vacuum treatment) are shown in Table 3.9, together with PCB results for selected samples after vacuum treatment. The results are broadly similar to those from Run 1 (Table 3.1), although there are strong indications that nitrogen removal efficiency was partly lost early in this run (compare results of conditions 1, 6 and 11 for both runs). This may have been a result of the low pressure, high temperature condition 2, which would have favoured coke formation on the catalyst.

The chlorine contents of the oils are very similar to those of Run 1, even though the feed concentration was almost five times higher, implying that even higher PCB concentrations could be treated successfully. Again, the PCB levels were below the detection limit, translating to >99.95% destruction even at the mildest condition (HT15-4). It should be noted that the chlorine content of sample 6 was 0.72 mg/kg when first tested. However, after an additional water wash the value reported, which is in line with those of samples 1 and 11, was obtained. Unfortunately this sample, which clearly contained residual ammonium chloride, was vacuum treated and submitted to electrical testing in its original condition.

Figure 4:
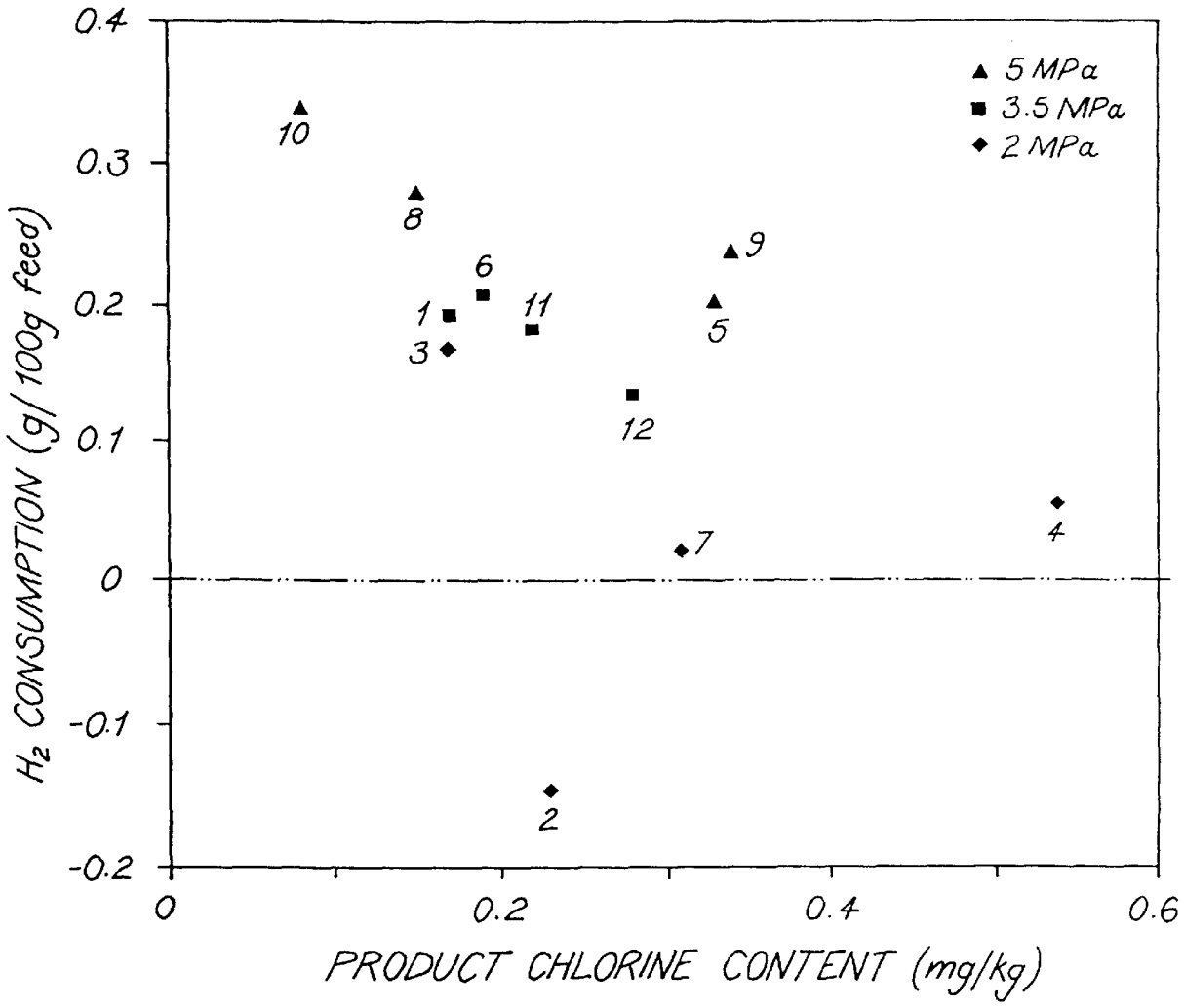
FIG. 4 is a graph of hydrogen consumption vs product chlorine content—Run 2.

Hydrogen consumptions in this run (next Section) are plotted against product chlorine content in FIG. 4. This shows a clear trend of increasing chlorine removal efficiency with increasing hydrogen consumption. However, to achieve a particular chlorine content, more hydrogen is consumed at 5 MPa than at 3.5 or 2 MPa.

TABLE 3.9

Elemental Composition of Product Oils - Run 2.

| Sample (°C./MPa/WHSV) | Sulfur (mg/kg) | Nitrogen (mg/L) | Chlorine (mg/kg) | PCB (mg/kg) |
|---|---|---|---|---|
| HT15-1 (340/3.5/2) | 16.9 | 2.5 | 0.17 | <0.1 |
| HT15-2 (360/2/1) | 14.6 | 6.4 | 0.23 | <0.1 |
| HT15-3 (320/2/1) | 12.7 | 2.8 | 0.17 | — |
| HT15-4 (320/2/3) | 42.9 | 6.5 | 0.54 | <0.1 |
| HT15-5 (320/5/3) | 70.0 | 4.3 | 0.33 | — |
| HT15-6 (340/3.5/2) | 29.3 | 4.8 | 0.19 | <0.1 |

TABLE 3.9-continued

Elemental Composition of Product Oils - Run 2.

| Sample (°C./MPa/WHSV) | Sulfur (mg/kg) | Nitrogen (mg/L) | Chlorine (mg/kg) | PCB (mg/kg) |
|---|---|---|---|---|
| HT15-7 (360/2/3) | 16.5 | 5.1 | 0.31 | — |
| HT15-8 (320/5/1) | 20.8 | 2.6 | 0.15 | <0.1 |
| HT15-9 (360/5/3) | 19.3 | 3.0 | 0.34 | — |
| HT15-10 (360/5/1 | 7.6 | 2.6 | 0.08 | <0.1 |
| HT15-11 (340/3.5/2) | 17.8 | 4.9 | 0.22 | — |
| HT15-12 (340/3.5/3) | 29.4 | 6.4 | 0.28 | — |
| HT15-Feed | 395 | 12.9 | 91 | 224 |

3.2.3 Hydrogen Consumptions

Hydrogen consumptions during this run, in which two sampling periods per condition were usually assessed, are shown in Table 3.10. Although the differences may be within experimental error, these figures are consistently lower than the corresponding consumptions from Run 1. At this stage, we cannot say whether this is an effect of the higher PCB content of the Run 2 feed.

TABLE 3.10

Hydrogen Consumptions - Run 2.

| Sample (°C./MPa/WHSV) | Hydrogen Consumption (g $H_2$/100 g Feed) |
|---|---|
| HT15-1B (340/3.5/2) | 0.194 |
| HT15-1C (340/3.5/2) | 0.167 |
| HT15-2B (360/2/1) | −0.146 |
| HT15-2C (360/2/1) | −0.106 |
| HT15-3B (320/2/1) | 0.169 |
| HT15-3C (320/2/1) | 0.162 |
| HT15-4B (320/2/3) | 0.055 |
| HT15-4C (320/2/3) | 0.065 |
| HT15-5B (320/5/3) | 0.203 |
| HT15-5C (320/5/3) | 0.193 |
| HT15-6B (340/3.5/2) | 0.209 |
| HT15-6C (340/3.5/2) | 0.214 |
| HT15-7B (360/2/3) | 0.021 |
| HT15-7C (360/2/3) | −0.007 |
| HT15-8B (320/5/1) | 0.281 |
| HT15-8C (320/5/1) | 0.307 |
| HT15-9B | 0.238 |
| HT15-9C | 0.240 |
| HT15-10A | 0.339 |
| HT15-11C | 0.183 |
| HT15-12B | 0.135 |
| HT15-12C | 0.139 |

3.2.4 Vacuum Treatment of Product Oils

To maintain a firm basis for comparison with the Run 1 results, the oils from Run 2 were vacuum treated to the same end point (77° C.), even though it was realised the flash points would not all meet specification. The results are presented in Table 3.11, and are very similar to those obtained in Run 1. This implies that the higher concentration of hydrogen chloride generated has not effected the degree of cracking of the oil, because of the presence of excess hydrogen chloride scavenger.

TABLE 3.11

Distillation Data - Run 2

| Sample | Residue (g/100 g Product Oil) | Distillate (g/100 g Product Oil) | Loss (g/100 g Product Oil) | Yield (g/100 g Feed Oil) |
|---|---|---|---|---|
| HT15-1 | 98.73 | 1.07 | 0.20 | 98.62 |
| HT15-2 | 95.20 | 4.39 | 0.41 | 94.13 |
| HT15-3 | 99.24 | 0.65 | 0.11 | 99.09 |
| HT15-4 | 99.73 | 0.19 | 0.08 | 99.52 |
| HT15-5 | 99.73 | 0.16 | 0.10 | 9973 |
| HT15-6 | 98.97 | 0.87 | 0.16 | 98.94 |
| HT15-7 | 98.07 | 1.71 | 0.22 | 97.51 |
| HT15-8 | 99.27 | 0.61 | 0.12 | 99.23 |
| HT15-9 | 97.98 | 1.76 | 0.25 | 97.91 |
| HT15-10 | 94.49 | 5.04 | 0.47 | 94.22 |
| HT15-11 | 98.65 | 1.17 | 0.18 | 98.57 |
| HT15-12 | 99.12 | 0.75 | 0.13 | 99.13 |

3.2.5 Electrical and Other Properties of Vacuum Treated Oils

During these analyses it was who noted that the treated oils polarised during the resistivity test. Consequently, voltage was applied to each sample once only, at 90° C., rather than the usual practice of determining the resistance at several temperatures between ambient and 90° C. Importantly, DDF was determined before the resistivity tests. The electrical strength figures are the average of six determinations, one or more of which exceeded the maximum test voltage of 90 kV for all product oils.

The results (Table 3.12) indicate extremely high quality, superior to typical new oil in almost all cases. Excellent correlations between hydrogen consumptions and both DDF and resistivity were found, and are plotted as FIGS. 5 and 6 respectively. For convenience, resistivity data were treated as conductivity. As noted in Section 3.2.2, sample 6 contained about 0.8 mg/kg of ammonium chloride, and this would have been the cause of its much poorer DDF, relative to the equivalent samples 1 and 11. Results from sample 6 are omitted from the graphs.

Figure 5:
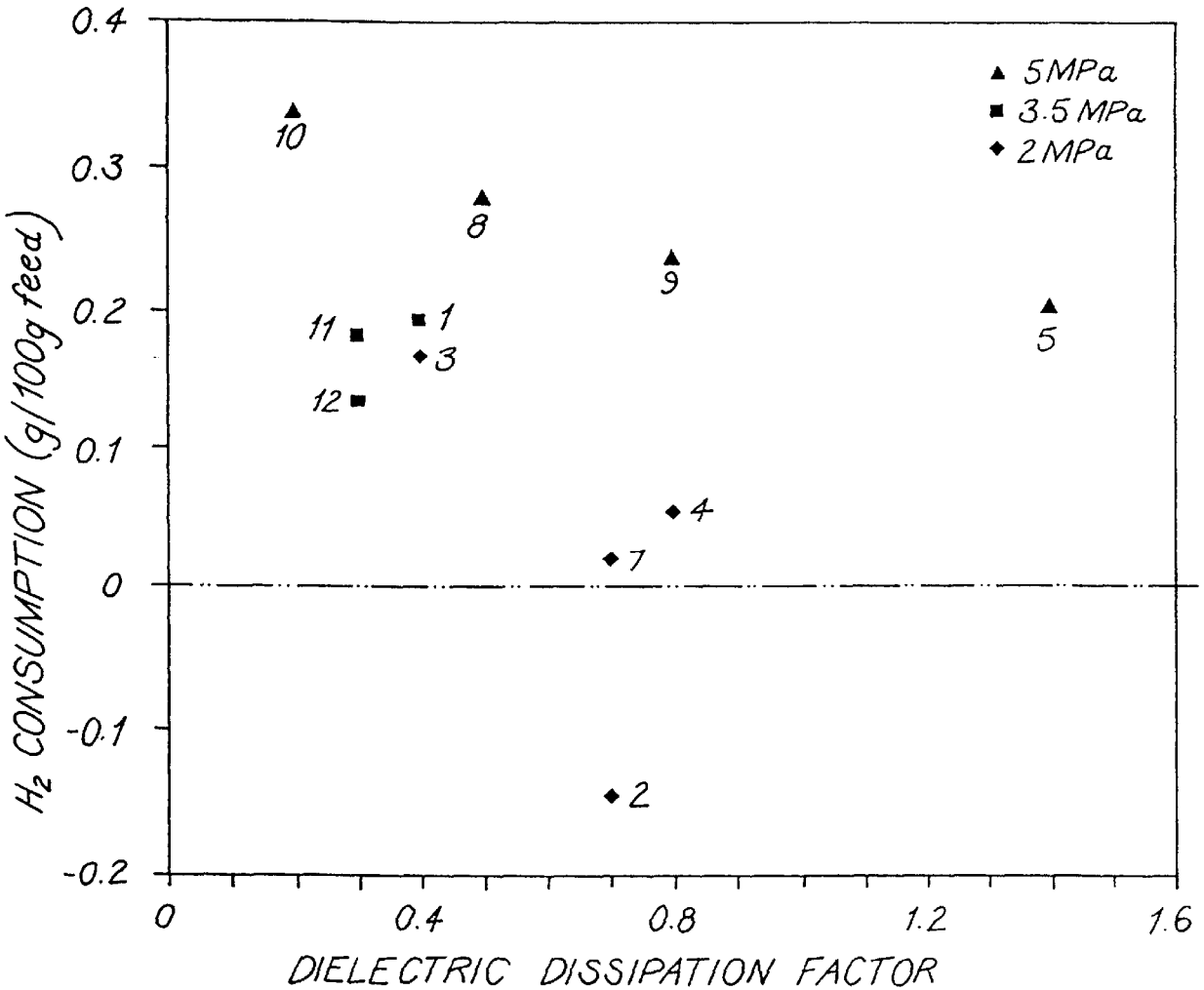
FIG. 5 is a graph of hydrogen consumption vs dielectric dissipation factor—run 2.
Figure 6:
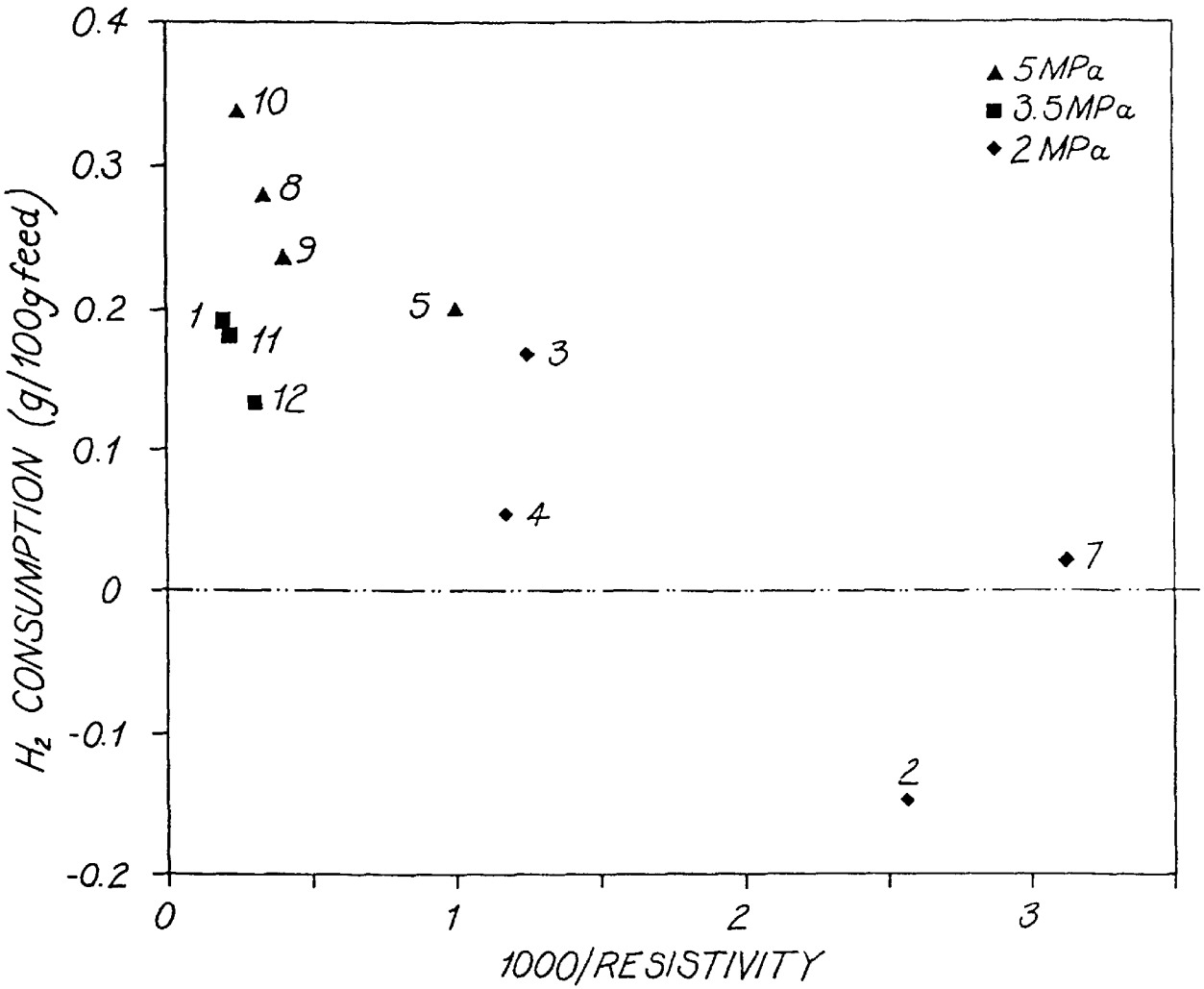
FIG. 6 is a graph of hydrogen consumption vs reciprocal resistivity—run 2.

The most important conclusions to be drawn from FIGS. 5 and 6 is that high quality oils are obtained with lower hydrogen consumptions at 2 and 3.5 MPa than at 5 MPa. For the best resistivities, an operating pressure of 3.5 MPa is clearly preferred.

The flash point figures are broadly similar to those from Run 1. In this case, unused sample 12 was retreated under vacuum up to a final temperature of 97° C. and retested. The new flash point was 148° C.

TABLE 3.12

Electrical Properties of Vacuum Treated Oils - Run 2.

| Sample (°C./MPa/WHSV) | Flash Point (°C.) | Acidity (mgKOH/g) | Interfacial tension (mN/m) | DDF (mW/VAR) | Resistivity (Gohmm) | Electrical Strength (kV) |
|---|---|---|---|---|---|---|
| HT15-1 (340/3.5/2) | 134 | Nil | 46.8 | 0.4 | 5000 | >90 |
| HT15-2 (360/2/1) | 124 | Nil | 43.8 | 0.7 | 390 | >83 |
| HT15-3 (320/2/1) | 136 | <0.01 | 46.0 | 0.4 | 800 | >90 |
| HT15-4 (320/2/3) | 140 | Nil | 45.9 | 0.8 | 850 | >78 |
| HT15-5 (320/5/3) | 142 | Nil | 46.8 | 1.4 | 1000 | >84 |
| HT15-6 (340/3.5/2) | 134 | <0.01 | 45.7 | 2.3 | 2400 | >89 |
| HT15-7 (360/2/3) | 130 | <0.01 | 46.2 | 0.7 | 320 | >68 |
| HT15-8 (320/5/1) | 136 | Nil | 46.3 | 0.5 | 3000 | >90 |
| HT15-9 (360/5/3) | 130 | Nil | 47.3 | 0.8 | 2500 | >89 |
| HT15-10 (366/5/1) | 128 | Nil | 46.0 | 0.2 | 4100 | NA |
| HT15-11 (340/3.5/2) | 132 | Nil | 42.6 | 0.3 | 4400 | >84 |
| HT15-12 (340/3.5/3) | 134 | Nil | 46.4 | 0.3 | 3200 | >84 |
| HT15-Feed | 153 | 0.04 | 22.1 | 72.1 | 4.3 | 64 |

> One or more of the six determinations exceeded the maximum test voltage of 90 kV.

3.2.6 Mass and Elemental Balances

Mass balances for this run (shown in Table 3.13) are very similar to those of Run 1, averaging 99.73%.

TABLE 3.13

Mass Balance Data - Run 2.

| Sample | HT15-1B | HT15-2C | HT15-3B | HT15-4B | HT15-5B | HT15-6B |
|---|---|---|---|---|---|---|
| Component In (g/100 g Feed) | | | | | | |
| Oil | 99.638 | 99.638 | 99.638 | 99.638 | 99.638 | 99.638 |
| Triethylamine | 0.3624 | 0.3624 | 0.3624 | 0.3624 | 0.3624 | 0.3624 |
| Hydrogen | 2.0026 | 1.9352 | 2.0158 | 2.0019 | 1.9936 | 2.0051 |
| TOTAL IN | 102.0025 | 101.9352 | 102.0158 | 102.0018 | 101.9936 | 102.0051 |
| Component Out (g/100 g Feed) | | | | | | |
| Oil | 99.52 | 98.52 | 99.49 | 99.42 | 99.63 | 99.60 |
| Methane | 0.0185 | 0.1095 | 0.0106 | 0.0054 | 0.0053 | 0.0132 |
| Ethane | 0.2933 | 6.3847 | 0.2554 | 0.2656 | 0.2480 | 0.2394 |
| Propane | 0.0441 | 0.1965 | 0.0318 | 0.140 | 0.0069 | 0.0303 |
| i-Butane | 0.0088 | 6.0568 | 0.0071 | 0.0036 | 0.0016 | 0.0068 |
| n-Butane | 0.0120 | 0.0632 | 0.0107 | 0.0053 | 0.0029 | 0.0084 |
| Pentanes | 0.0143 | 0.0345 | 0.0004 | 0.0030 | 0.0064 | 0.0036 |
| Hexanes | 0.0048 | 0.0087 | 0.0002 | 0.0002 | 0.0040 | 0.0004 |
| Hydrogen Sulfide | 0.0257 | 0.0253 | 0.0274 | 0.0215 | 0.0178 | 0.0285 |
| Ammonia | 0.0480 | 0.0447 | 0.0396 | 0.0440 | 0.0431 | 0.0438 |
| Hydrogen Chloride (aq) | 0.0009 | 0.0024 | 0.0027 | 0.0070 | 0.0051 | 0.0095 |
| Hydrogen | 1.8089 | 2.0412 | 1.8464 | 1.9466 | 1.7911 | 1.7961 |
| TOTAL OUT | 101.7994 | 101.4874 | 101.7223 | 101.7362 | 101.7623 | 101.7800 |
| Recovery (%) | 99.80 | 99.56 | 99.71 | 99.74 | 99.77 | 99.78 |
| Component In (g/100 g Feed) | | | | | | |
| Oil | 99.638 | 99.638 | 99.638 | 99.638 | 99.638 | 99.638 |
| Triethylamine | 0.3624 | 0.3624 | 0.3624 | 0.3624 | 0.3624 | 0.3624 |
| Hydrogen | 2.0108 | 2.0248 | 1.9930 | 1.9871 | 2.0115 | 2.0076 |
| TOTAL IN | 102.0108 | 102.0248 | 101.9930 | 101.9871 | 102.0115 | 102.0076 |
| Component Out (g/100 g Feed) | | | | | | |
| Oil | 99.07 | 99.60 | 99.56 | 99.35 | 99.55 | 99.65 |
| Methane | 0.0320 | 0.0094 | 0.0274 | 0.0734 | 0.0165 | 0.0109 |
| Ethane | 6.2758 | 0.2336 | 0.2432 | 0.2603 | 0.2577 | 0.2682 |
| Propane | 0.0775 | 0.0189 | 0.0486 | 0.0882 | 0.0431 | 0.0303 |
| i-Butane | 0.0204 | 0.0035 | 0.0103 | 0.0227 | 0.0103 | .0071 |
| n-Butane | 0.0249 | 0.0050 | 0.0118 | 0.0200 | 0.0108 | 0.0092 |
| Pentanes | 0.0134 | 0.0080 | 0.0104 | 0.0126 | 0.0048 | 0.0102 |
| Hexanes | 0.0022 | 0.0033 | 0.0004 | 0.0023 | 0.0006 | 0.0049 |

TABLE 3.13-continued

Mass Balance Data - Run 2.

| Sample | HT15-1B | HT15-2C | HT15-3B | HT15-4B | HT15-5B | HT15-6B |
|---|---|---|---|---|---|---|
| Hydrogen Sulfide | 0.0268 | 0.0294 | 0.0219 | 0.0283 | 0.0275 | 0.0288 |
| Ammonia | 0.0505 | 0.0453 | 0.0482 | 0.0515 | 0.0502 | 0.0501 |
| Hydrogen Chloride (aq) | 0.0121 | 0.0048 | 0.0109 | 0.0080 | 0.0089 | 0.0117 |
| Hydrogen | 1.9901 | 1.7443 | 1.7546 | 1.6484 | 1.8297 | 1.8724 |
| TOTAL OUT | 101.5958 | 101.7056 | 101.7477 | 101.5658 | 101.8101 | 101.9537 |
| Recovery (%) | 99.59 | 99.69 | 99.76 | 99.59 | 99.86 | 99.95 |

For no obvious reason, recoveries of both sulfur and nitrogen (Tables 3.14 and 3.15 respectively) were inferior to the Run 1 data, although the increased losses are obviously associated with the aqueous phase (cf Tables 3.6 and 3.7).

The results in Table 3.16 show that elimination of ammonium chloride from the existing apparatus is more of a problem at the higher PCB level of this run. Clearly there was some build-up during the early stages of the run, which was then (partly) eliminated towards the finish. Overall, the chlorine recoveries average only 73%. Since a total of 13.135 kg of oil was fed in this run, a hold up of approximately 320 mg of chlorine is implied. But mass and elemental balances were performed on only one of the three samples taken at each condition, and the equilibration samples were not analysed at all, so this figure is only a very rough estimate at best.

TABLE 3.14

Sulfur Recoveries - Run 2.

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Sulfur Recovery (%) |
|---|---|---|---|---|---|---|
| HT15-1B | 8.82 | 15.29 | 1.68 | 25.79 | 39.36 | 65.5 |
| HT15-2C | 12.86 | 10.84 | 1.44 | 25.17 | 39.36 | 63.9 |
| HT15-3B | 9.20 | 16.52 | 1.26 | 26.98 | 39.36 | 68.5 |
| HT15-4B | 8.07 | 12.10 | 4.27 | 24.44 | 39.36 | 62.1 |
| HT15-5B | 4.97 | 11.76 | 6.97 | 23.71 | 39.36 | 60.2 |
| HT15-6B | 7.04 | 19.68 | 2.92 | 29.64 | 39.36 | 75.3 |
| HT15-7B | 10.04 | 15.15 | 1.64 | 26.83 | 39.36 | 68.2 |
| HT15-8B | 5.63 | 21.95 | 2.07 | 29.65 | 39.36 | 75.3 |
| HT15-9B | 7.51 | 13.07 | 1.92 | 22.50 | 39.36 | 57.2 |
| HT15-10A | 5.16 | 21.43 | 0.76 | 27.35 | 39.36 | 69.5 |
| HT15-11B | 8.73 | 17.11 | 1.77 | 27.61 | 39.36 | 70.2 |
| HT15-12B | 9.67 | 17.33 | 2.93 | 29.92 | 39.36 | 76.0 |

TABLE 3.15

Nitrogen Recoveries - Run 2.

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Nitrogen Recovery (%) |
|---|---|---|---|---|---|---|
| HT15-1B | 1.32 | 38.20 | 0.28 | 39.80 | 51.46 | 77.4 |
| HT15-2C | 2.72 | 34.02 | 0.70 | 37.44 | 51.46 | 72.8 |
| HT15-3B | 1.98 | 30.58 | 0.31 | 32.87 | 51.46 | 63.9 |
| HT15-4B | 2.14 | 34.96 | 0.72 | 36.92 | 51.46 | 71.8 |
| HT15-5B | 0.82 | 34.66 | 0.48 | 35.97 | 51.46 | 69.9 |
| HT15-6B | 0.90 | 35.15 | 0.53 | 36.59 | 51.46 | 71.1 |
| HT15-7B | 1.48 | 40.09 | 0.57 | 42.14 | 51.46 | 81.9 |
| HT15-8B | 0.66 | 36.63 | 0.29 | 37.58 | 51.46 | 73.0 |
| HT15-9B | 1.07 | 38.58 | 0.33 | 39.98 | 51.46 | 77.7 |
| HT15-10A | 0.49 | 41.90 | 0.28 | 42.68 | 51.46 | 83.0 |
| HT15-11B | 1.15 | 40.18 | 0.55 | 41.88 | 51.46 | 81.4 |
| HT15-12B | 1.98 | 39.23 | 0.71 | 41.91 | 51.46 | 81.5 |

TABLE 3.16

Chlorine Recoveries - Run 2.

| Sample | Aqueous Phase (mg/100 g Feed) | Oil Phase (mg/100 g Feed) | Total Out (mg/100 g Feed) | Total In (mg/100 g Feed) | Chlorine Recovery (%) |
|---|---|---|---|---|---|
| HT15-1B | 0.89 | 0.017 | 0.91 | 9.10 | 10.0 |
| HT15-2C | 2.31 | 0.023 | 2.33 | 9.10 | 25.6 |
| HT15-3B | 2.59 | 0.017 | 2.61 | 9.10 | 28.7 |
| HT15-4B | 6.60 | 0.054 | 6.65 | 9.10 | 73.1 |
| HT15-5B | 4.81 | 0.033 | 4.84 | 9.10 | 53.2 |
| HT15-6B | 8.95 | 0.019 | 8.97 | 9.10 | 98.6 |
| HT15-7B | 11.48 | 0.031 | 11.51 | 9.10 | 126.5 |
| HT15-8B | 4.57 | 0.015 | 4.58 | 9.10 | 50.4 |
| HT15-9B | 0.28 | 0.034 | 10.32 | 9.10 | 113.4 |
| HT15-10A | 7.56 | 0.008 | 7.57 | 9.10 | 83.2 |
| HT15-11B | 8.40 | 0.022 | 8.43 | 9.10 | 92.6 |
| HT15-12B | 11.03 | 0.028 | 11.06 | 9.10 | 121.2 |

3.3 RUN 3 (HT16)

3.3.1 Feed Description and Operating Parameters

This run was to be carried out over an extended period at the optimum processing conditions (as indicated from the results of Runs 1 and 2), to test catalyst stability and provide about 25 liters of product oil for further evaluation. The feed mix was the same as in Run 1, ie with no added PCB.

The results of Run 2, correlating hydrogen consumption with chlorine content and electrical properties of product oils, clearly showed that 3.5 MPa was the preferred operating pressure. The highest quality oils were in fact produced at the centre-point condition of that run, ie at 340° C./3.5 MPa/WHSV 2, while at WHSV 3 (sample HT15-12), the quality was still very high. It was decided that for Run 3, conditions slightly milder than HT15-12 should be used. Because space velocities much above 3 are experimentally difficult to perform in the current apparatus, and lower temperatures give less oil cracking (higher yields of oil after distillation), the logical conditions to choose for Run 3 were 330° C./3.5 MPa/WHSV 3.

For each sampling period, ten 40 min collections were combined as a bulk sample (approximately 2 liters), followed by a subsample (2×40 min) for determination of mass and elemental balances.

This run had to be terminated prematurely, just after the fourth bulk sample had been collected, due to a leak in a fitting just below the water injection point. The most likely cause was the hammering effect produced by the rapid vaporisation of the injected water drops; there was no sign of chloride induced corrosion found during a later inspection. As part of the shutdown, the feed and hydrogen were both turned off while the catalyst was at temperature and the pressure reduced to ambient. As a consequence, a significant amount of coke might have been deposited on the catalyst.

3.3.2 Trace Elements and PCB in Product Oils

The sulfur, nitrogen and chlorine contents of the feed oil and mass balance subsamples are shown in Table 3.17 chlorine contents of the four bulk samples are also included. Clearly, the chlorine figures are extremely good. The PCB contents, which were obtained from samples after vacuum treatment, are again below the detection limit.

TABLE 3.17

Elemental Composition of Product Oils - Run 3

| Sample (Time on stream, h) | Sulfur (mg/kg) | Nitrogen (mg/L) | Chlorine (mg/kg) | PCB (mg/kg) |
|---|---|---|---|---|
| HT16-1 | 33.0 | 7.3 | 0.06 | <0.1 |
| HT16-2 | 38.0 | 7.0 | 0.17 | — |
| HT16-3 | 35.0 | 7.2 | 0.06 | <0.1 |
| HT16-Feed | 395 | 12.9 | 19.1 | 24 |

3.3.3 Hydrogen Consumptions

The hydrogen consumptions for this run shown in Table 3.18 are all greater than the predicted value of 0.186 wt %, but probably within the combined errors of measurement and calculation (but see Section 3.5.3).

TABLE 3.18

Hydrogen Consumptions - Run 3

| Sample | Hydrogen Consumption (g $H_2$/100 g Feed) |
|---|---|
| HT16-1 | 0.203 |
| HT16-2 | 0.247 |
| HT16-3 | 0.238 |

3.3.4 Vacuum Treatment of Product Oils

Vacuum treatment was carried out on combined bulk and mass balance subsamples (where available), to an end point of 87° C. From the results of the redistillation of sample HT15-12, reported in Section 3.2.5, this temperature was expected to give flash points around 142° C., ie just above the specified minimum for transformer oils. This gave overall yields averaging more than 99.5%, as shown in Table 3.19.

TABLE 3.19

Distillation Data - Run 3

| Sample | Residue (g/100 g Product Oil) | Distillate (g/100 g Product Oil) | Loss (g/100 g Product Oil) | Yield (g/100 g Feed Oil) |
|---|---|---|---|---|
| HT16-1 | 99.45 | 0.43 | 0.12 | 99.60 |
| HT16-2 | 99.50 | 0.40 | 0.11 | 99.48 |
| HT16-3 | 99.53 | 0.37 | 0.10 | 99.55 |
| HT16-4 | 99.55 | 0.35 | 0.10 | Not available |

3.3.5 Electrical and Other Properties of Vacuum Treated Oils

The results shown in Table 3.20 indicate very good quality oils. The resistivity values are extremely high, much better than the result for HT15-12 (3200 Gohmm), even though the reaction conditions were milder. This may be a result of the much lower chlorine content of the feed and products, but could also be due to the higher distillation temperature resulting in a drier product.

The flash point figures are very close to what was expected, and show that the vacuum treatment parameters can be tailored to fit a desired flash point value.

TABLE 3.20

Electrical Properties of Vacuum Treated Oils - Run 3

| Sample | Flash Point (° C.) | Acidity (mgKOH/g) | Interfacial tension (mN/m) | DDF at 90° C. (mW/VAR) | Resistivity (Gohmm) | Electrical Strength (kV) |
|---|---|---|---|---|---|---|
| HT16-1 | 142 | 0.00 | 47.2 | 0.2 | 6500 | >71 |
| HT16-2 | 142 | 0.00 | 45.5 | 0.5 | 5500 | >88 |
| HT16-3 | 144 | 0.00 | 38.2 | 0.5 | 5500 | >90 |
| HT16-4 | 144 | 0.00 | 47.4 | 0.3 | 7000 | 71 |
| HT16-Feed | 155 | 0.06 | 24.1 | 73.2 | 4.5 | 44 |

>One or more of the six determinations exceeded the maximum test voltage of 90 kV.

3.3.6 Mass and Elemental Balances

Mass balances for this run are shown in Table 3.21. The unrealistic 100% recovery for sample HT16-1 is thought to result from an error in weighing the product oil; the corresponding bulk sample yield was approximately 0.15% lower.

TABLE 3.21

Mass Balance Data - Run 3

| Sample | HT16-1 | HT16-2 | HT16-3 |
|---|---|---|---|
| Component in (g/100 g Feed) | | | |
| Oil | 99.6376 | 99.6376 | 99.6376 |
| Triethylamine | 0.3624 | 0.3624 | 0.3624 |
| Hydrogen | 2.0062 | 2.0045 | 1.9995 |
| TOTAL IN | 102.0062 | 102.0045 | 101.9995 |
| Component Out (g/100 g Feed) | | | |
| Oil | 99.7937 | 99.6213 | 99.6585 |
| Methane | 0.0069 | 0.0073 | 0.0069 |
| Ethane | 0.2731 | 0.2651 | 0.2604 |
| Propane | 0.0192 | 0.0167 | 0.0155 |
| i-Butane | 0.0038 | 0.0035 | 0.0031 |
| n-Butane | 0.0045 | 0.0049 | 0.0039 |
| Pentanes | 0.0069 | 0.0040 | 0.0041 |
| Hexanes | 0.0006 | 0.0011 | 0.0011 |
| Hydrogen Sulfide | 0.0381 | 0.0386 | 0.0392 |
| Ammonia | 0.0562 | 0.0569 | 0.0568 |
| Hydrogen Chloride (aq) | 0.0019 | 0.0046 | 0.0007 |
| Hydrogen | 1.8032 | 1.7573 | 1.7616 |
| TOTAL OUT | 102.0080 | 101.7813 | 101.8116 |
| Recovery (%) | 100.00 | 99.78 | 99.82 |

Sulfur and nitrogen recoveries are shown in Tables 3.22 and 3.23 respectively. All are satisfactory numbers.

The chlorine recoveries shown in Table 3.24 are clearly erratic, averaging far more than 100%. In this run, the water washings from the four bulk samples were combined and analysed for chlorine, so that an overall chlorine recovery figure could be obtained. This revealed that over the entire run, 142 mg of "extra" chlorine exited the reactor. This excess must be from the chlorine not recovered in Run 2, where an estimated 320 mg was left behind (Section 3.2.6).

TABLE 3.22

Sulfur Recoveries - Run 3

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Sulfur Recovery (%) |
|---|---|---|---|---|---|---|
| HT16-1 | 7.07 | 28.64 | 3.29 | 39.00 | 39.35 | 99.1 |
| HT16-2 | 6.77 | 29.62 | 3.79 | 40.17 | 39.35 | 102.1 |
| HT16-3 | 6.62 | 30.52 | 3.49 | 40.62 | 39.35 | 103.2 |

TABLE 3.23

Nitrogen Recoveries - Run 3

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Nitrogen Recovery (%) |
|---|---|---|---|---|---|---|
| HT16-1 | 1.97 | 44.25 | 0.82 | 47.04 | 51.44 | 91.4 |
| HT16-2 | 1.64 | 45.24 | 0.78 | 47.67 | 51.44 | 92.7 |
| HT16-3 | 1.23 | 45.56 | 0.81 | 47.60 | 51.44 | 92.5 |

TABLE 3.24

Chlorine Recoveries - Run 3

| Sample | Aqueous Phase (mg/100 g Feed) | Oil Phase (mg/100 g Feed) | Total Out (mg/100 g Feed) | Total In (mg/100 g Feed) | Chlorine Recovery (%) |
|---|---|---|---|---|---|
| HT16-1 | 1.84 | 0.006 | 1.85 | 1.75 | 105.5 |
| HT16-2 | 4.50 | 0.017 | 4.52 | 1.75 | 258.0 |
| HT16-3 | 0.64 | 0.006 | 0.65 | 1.75 | 36.8 |

3.4 RUN 4 (HT17)

3.4.1 Feed Description and Operating Parameters

The original plan for this run was to process approximately 10 liters of feed containing 200 mg/kg of added PCB, at the same conditions as Run 3. Because of the premature termination of Run 3, however, which had been intended to test relatively long term catalyst stability, it was decided to at least double the duration of Run 4. If anything, the much higher PCB content of this feed would provide a greater challenge to the catalyst.

In all, approximately 22 liters of feed was processed over a 73 hour period, and the product collected following the same procedure as for Run 3 to give nine samples and subsamples. The only unsatisfactory aspect of the run was an increasingly obvious leak (undetectable at the time) in the outlet gas flow device. This resulted in offgas flow measurements which were clearly too low from sample 5 onwards (giving unreasonably high hydrogen consumptions), but gas results from samples 2 to 4 are also suspect.

3.4.2 Trace Elements and PCB in Product Oils

Figure 7:
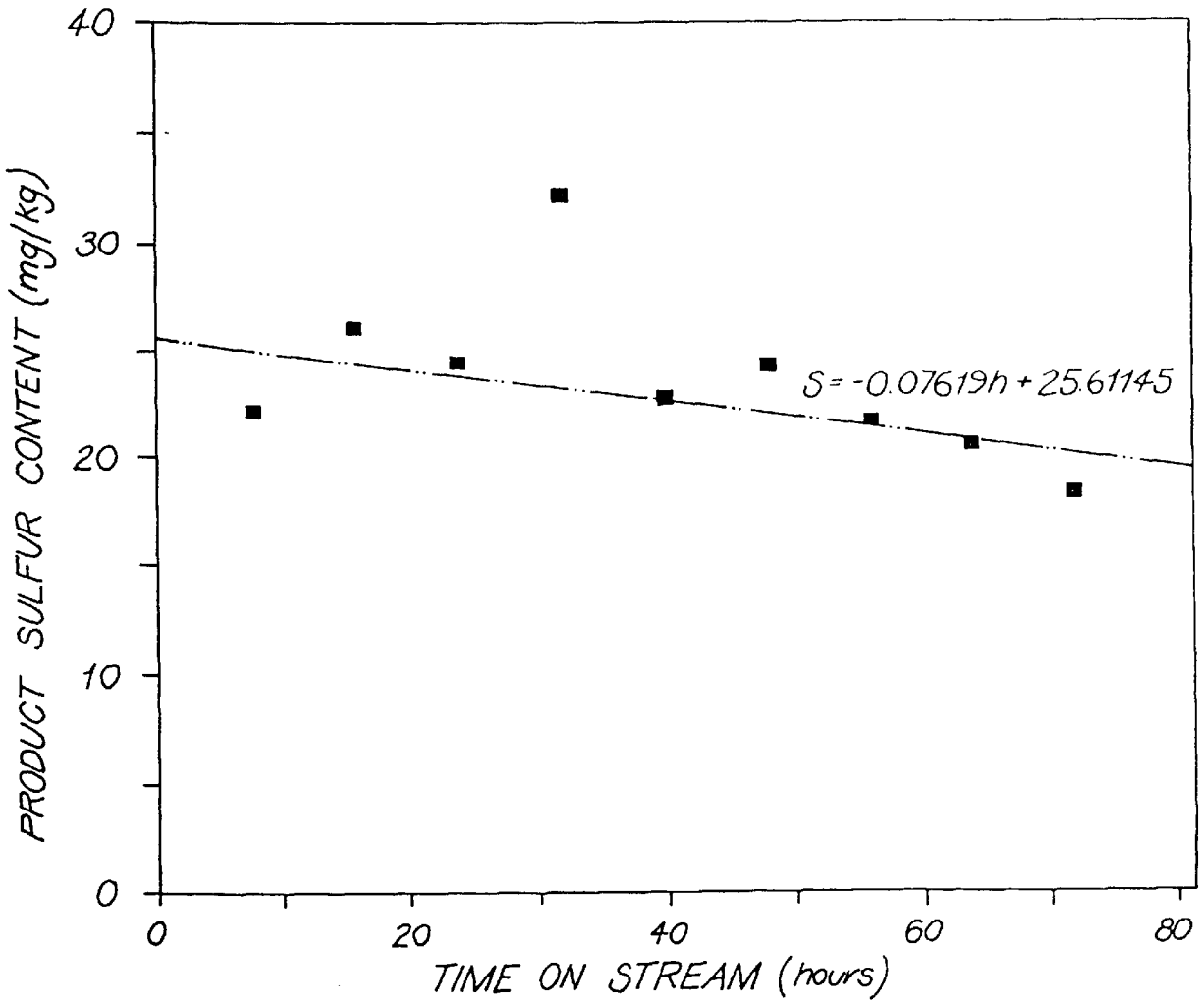
FIG. 7 is a graph of product sulfur content vs time on stream—run 4.
Figure 8:
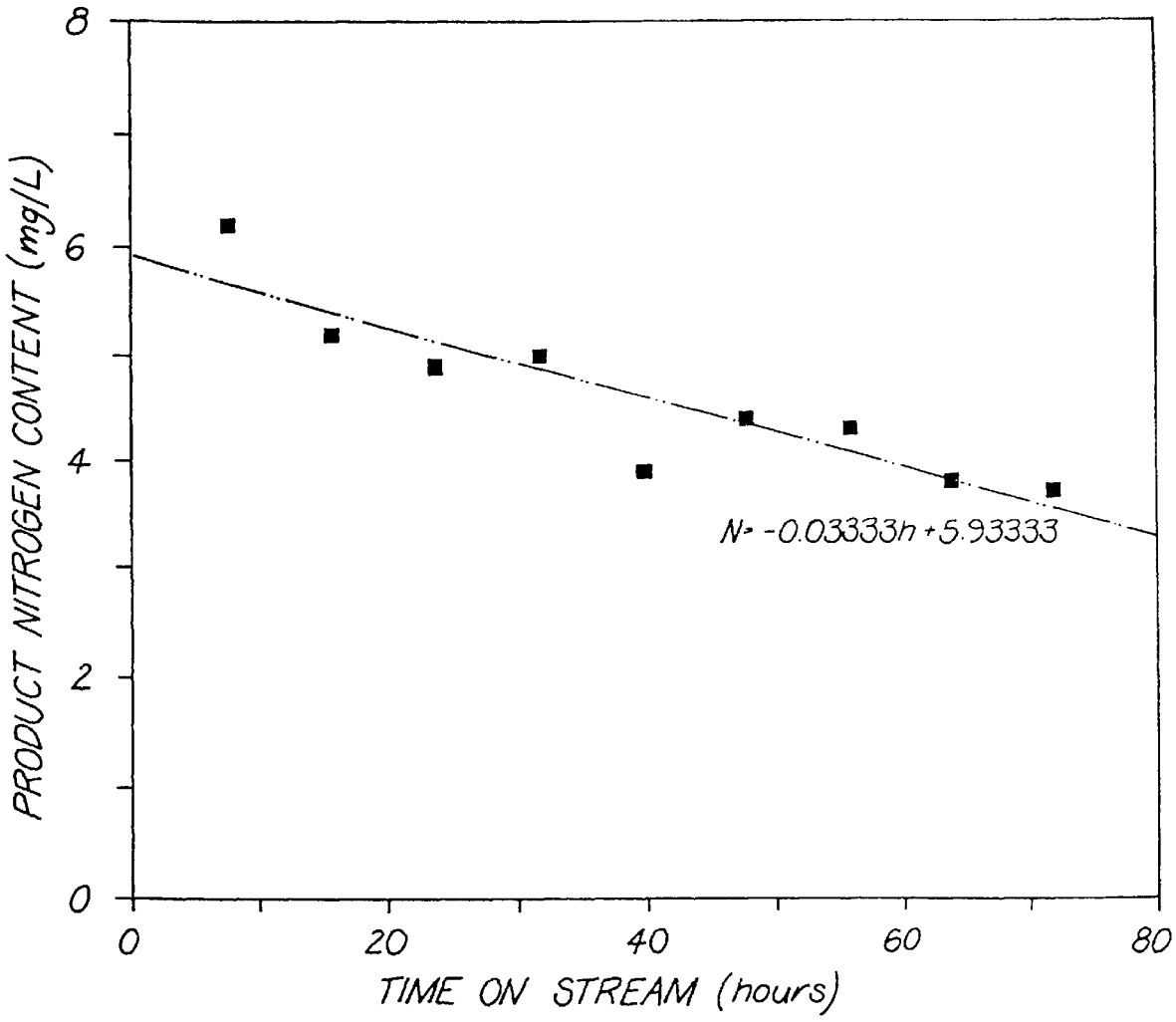
FIG. 8 is a graph of product nitrogen content vs time on stream—run 4.
Figure 9:
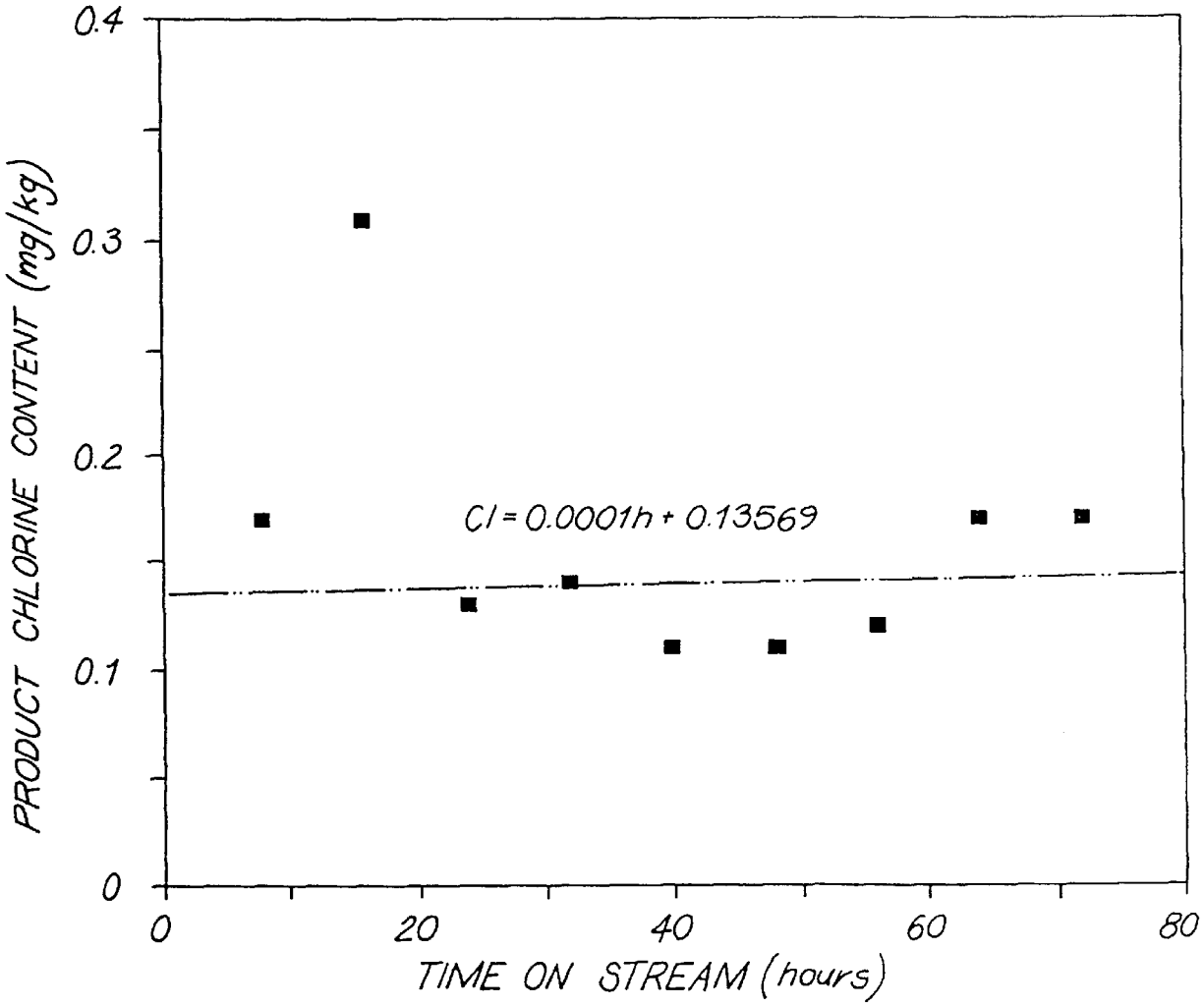
FIG. 9 is a graph of product chlorine content vs time on stream—run 4.

The sulfur, nitrogen and chlorine contents of the nine oil subsamples from this run are shown in Table 3.25, and are plotted against time on stream in FIGS. 7 to 9.

FIG. 8 shows that the catalyst unexpectedly gained nitrogen removal activity during the run. This may be attributable to removal of coke laid down when Run 3 was terminated (Section 3.3.1) because the acid sites involved in nitrogen removal are very susceptible to coking.

It is difficult to make a judgement on the sulfur data depicted in FIG. 7 because of the scatter. Similarly, the chlorine data, excluding sample 2 which was clearly either contaminated or incompletely washed, gave a linear regression result which implied an increase in product chlorine content of 0.1 mg/kg every 1000 hours.

As with all other samples analysed previously, PCB content of the Run 4 samples were below the 0.1 mg/kg detection limit.

TABLE 3.25

Elemental Composition of Product Oils - Run 4.

| Sample | Sulfur (mg/kg) | Nitrogen (mg/L) | Chlorine (mg/kg) | PCB (mg/kg) |
|---|---|---|---|---|
| HT17-1 (8) | 22.1 | 6.2 | 0.17 | <0.1 |
| HT17-2 (16) | 26.1 | 5.2 | 0.31 | — |
| HT17-3 (24) | 24.4 | 4.9 | 0.13 | <0.1 |
| HT17-4 (32) | 32.2 | 5.0 | 0.14 | — |
| HT17-5 (40) | 22.7 | 3.9 | 0.11 | <0.1 |
| HT17-6 (48) | 24.2 | 4.4 | 0.11 | — |
| HT17-7 (56) | 21.6 | 4.3 | 0.12 | <0.1 |
| HT17-8 (64) | 20.5 | 3.8 | 0.17 | — |
| HT17-9 (72) | 18.3 | 3.7 | 0.17 | <0.1 |
| HT17-Feed | 395 | 12.9 | 92 | 224 |

3.4.3 Hydrogen Consumptions

Hydrogen consumptions during this run are shown in Table 3.26. As explained in Section 3.4.1, a problem with the offgas measurement device prevented useful data from being obtained from sample 5 onwards, with results for samples 2 to 4 also being suspect. Consequently, in order to get an estimate of hydrogen consumptions and mass balances from samples 5 to 9, it was assumed that the offgas flow-rate was the same as for sample 1. If these assumptions are accepted, hydrogen consumptions during this and the previous run are very similar.

TABLE 3.26

Hydrogen Consumptions - Run 4.

| Sample | Hydrogen Consumption (g $H_2$/10 g Feed) |
|---|---|
| HT17-1 | 0.218 |
| HT17-2 | 0.264 |
| HT17-3 | 0.266 |

TABLE 3.26-continued

Hydrogen Consumptions - Run 4.

| Sample | Hydrogen Consumption (g $H_2$/10 g Feed) |
|---|---|
| HT17-4 | 0.257 |
| HT17-5 | 0.220 |
| HT17-6 | 0.221 |
| HT17-7 | 0.223 |
| HT17-8 | 0.222 |
| HT17-9 | 0.220 |

3.4.4 Vacuum Treatment of Product Oils

Vacuum treatment of combined bulk and mass balance subsamples was carried out exactly as in Run 3. This gave overall yields averaging more than 99.5%, as shown in Table 3.27.

TABLE 3.27

Distillation Data - Run 4

| Sample | Residue (g/100 g Product Oil) | Distillate (g/100 g Product Oil) | Loss (g/100 g Product Oil) | Yield (g/100 g Feed Oil) |
|---|---|---|---|---|
| HT17-1 | 99.54 | 0.34 | 0.12 | 99.65 |
| HT17-2 | 99.52 | 0.38 | 0.10 | 99.45 |
| HT17-3 | 99.50 | 0.40 | 0.09 | 99.55 |
| HT17-4 | 99.49 | 0.41 | 0.11 | 99.49 |
| HT17-5 | 99.51 | 0.38 | 0.10 | 99.52 |
| HT17-6 | 99.52 | 0.38 | 0.10 | 99.57 |
| HT17-7 | 99.53 | 0.37 | 0.10 | 99.51 |
| HT17-8 | 99.53 | 0.37 | 0.10 | 99.48 |
| HT17-9 | 99.51 | 0.39 | 0.10 | 99.48 |

3.4.5 Electrical and Other Properties of Vacuum Treated Oils

The results shown in Table 3.28 indicate that the high quality of these oils has been maintained for the duration of the run. The resistivity values are significantly lower than the results from Run 3 (Table 3.20), but are more in line with what was expected. Most other results are comparable with those of Run 3.

TABLE 3.28

Electrical Properties of Vacuum Treated Oils - Run 4.

| Sample | Flash Point (°C.) | Acidity (mgKOH/g) | Interfacial tension (mN/m) | DDF at 90° C. (mW/VAR) | Resistivity (Gohmm) | Electrical Strength (kV) |
|---|---|---|---|---|---|---|
| HT17-1 | 144 | 0.00 | 46.8 | 0.5 | 3600 | >85 |
| HT17-2 | 142 | 0.00 | 48.3 | 0.7 | 3200 | >88 |
| HT17-3 | 144 | 0.00 | 48.4 | 0.5 | 3800 | >90 |
| HT17-4 | 142 | 0.00 | 46.2 | 0.5 | 3600 | >81 |
| HT17-5 | I40 | 0.00 | 46.8 | 0.5 | 3000 | >88 |
| HT17-6 | 142 | 0.00 | 47.3 | 0.4 | 3800 | >79 |
| HT17-7 | 140 | 0.00 | 47.6 | 0.5 | 2900 | >90 |
| HT17-8 | 140 | 0.00 | 47.3 | 9.4 | 2900 | >89 |
| HT17-9 | 142 | 0.00 | 46.5 | 0.6 | 3400 | >90 |
| HT17-Feed | 153 | 0.04 | 22.1 | 72.1 | 4.3 | 64 |

> One or more of the six determinations exceeded the maximum test voltage of 90 kV.

3.4.6 Catalyst Lifetime Predictions from Run 4 Data

By analysing changes in product quality with time-on-stream in an extended run, it is possible to make estimates of the time at which a certain property would reach a predetermined value. Several of the key properties of the Run 4 samples are plotted against time-on-stream in FIGS. 10 to 13.

Figure 10:
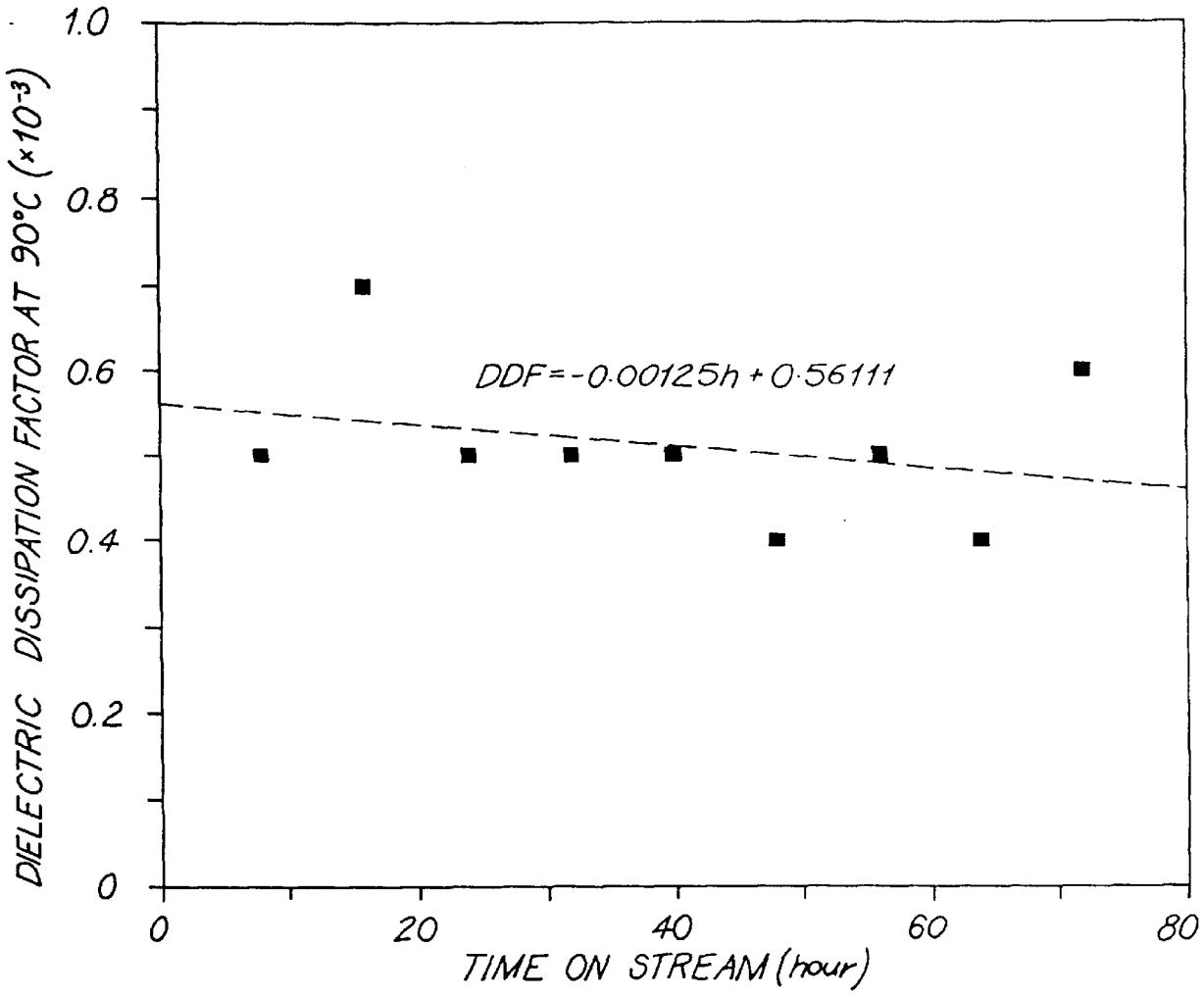
FIG. 10 is a graph of dielectric dissipation factor vs time on stream—run 4.
Figure 11:
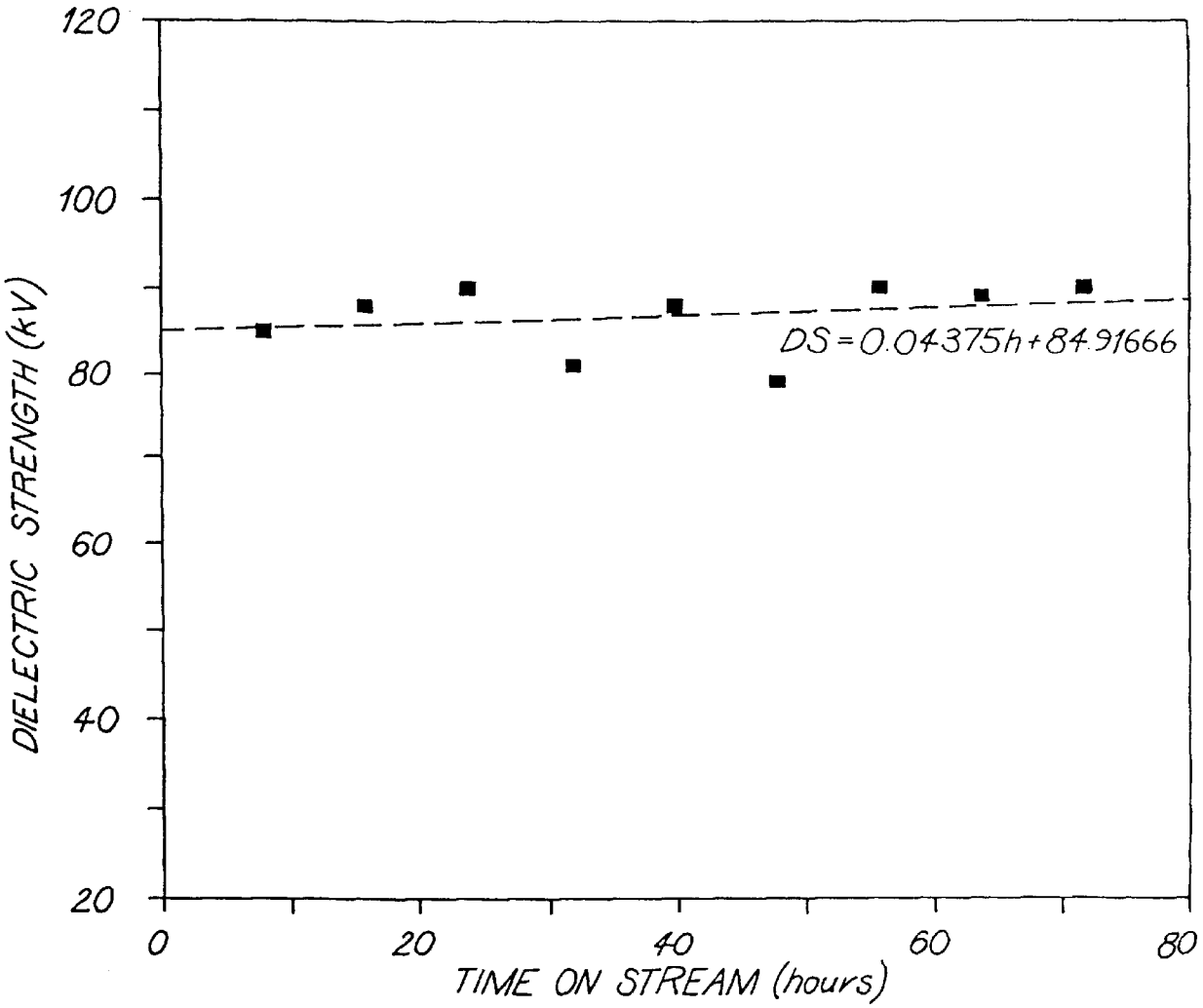
FIG. 11 is a graph of dielectric strength vs time on stream—run 4.

Linear regression analysis of the DDF and dielectric strength data shown in FIGS. 10 and 11, respectively, suggest increasing quality in these parameters during the run. However, there is considerable scatter in these data, most likely due to the very poor repeatability accepted for these measurement procedures.

Figure 12:
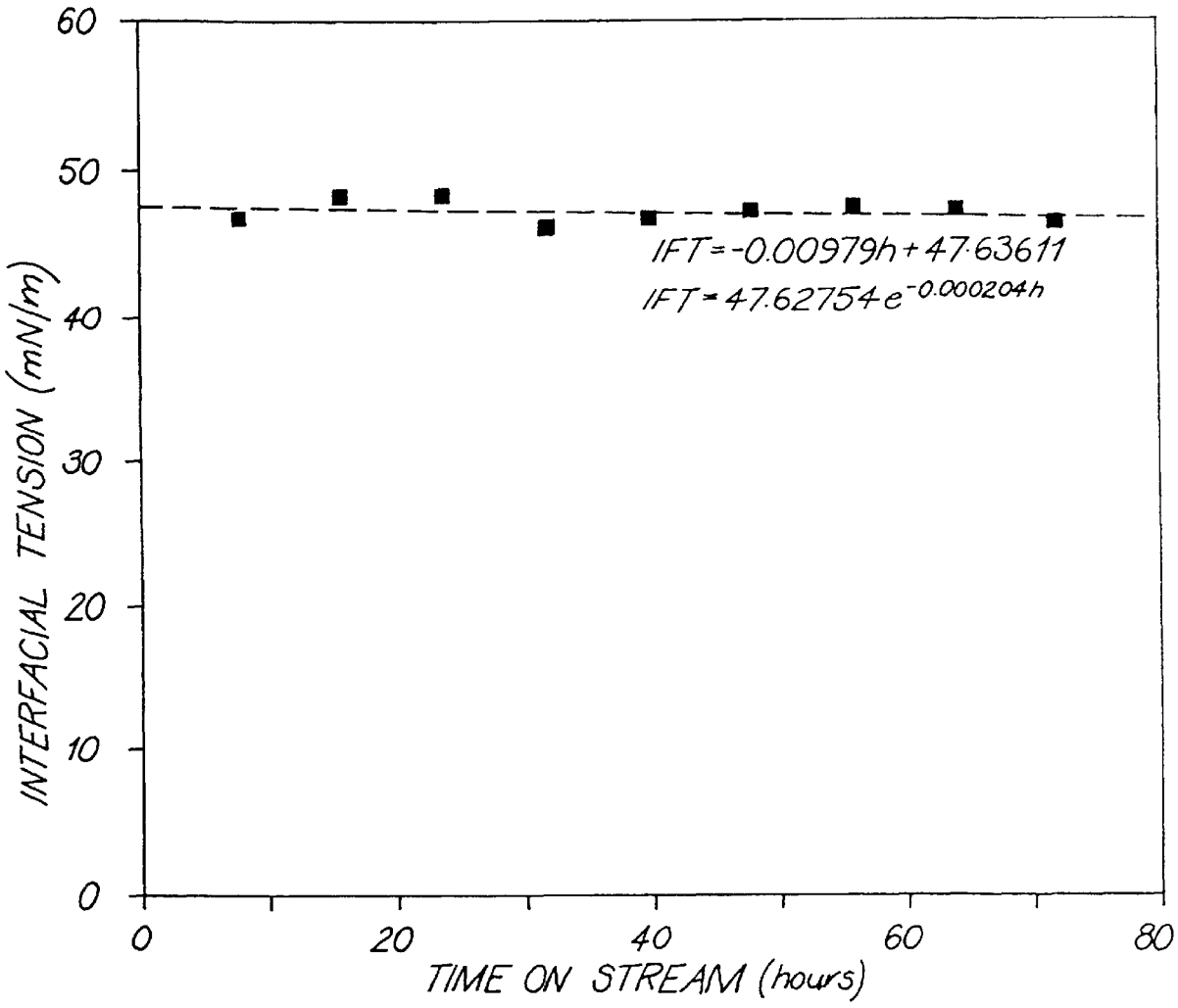
FIG. 12 is a graph of interfacial tension vs time on stream—run 4.

The interfacial tension results plotted in FIG. 12 are much more reliable, being derived from a procedure (ISO 6295) with a stated variation in repeatability of 2% or less. Linear and exponential regression equations gave equally good correlations, and from these it was possible to estimate how long it would take before the product IFT fell to 30 mN/m. These times were 75 and 94 days, respectively.

Figure 13:
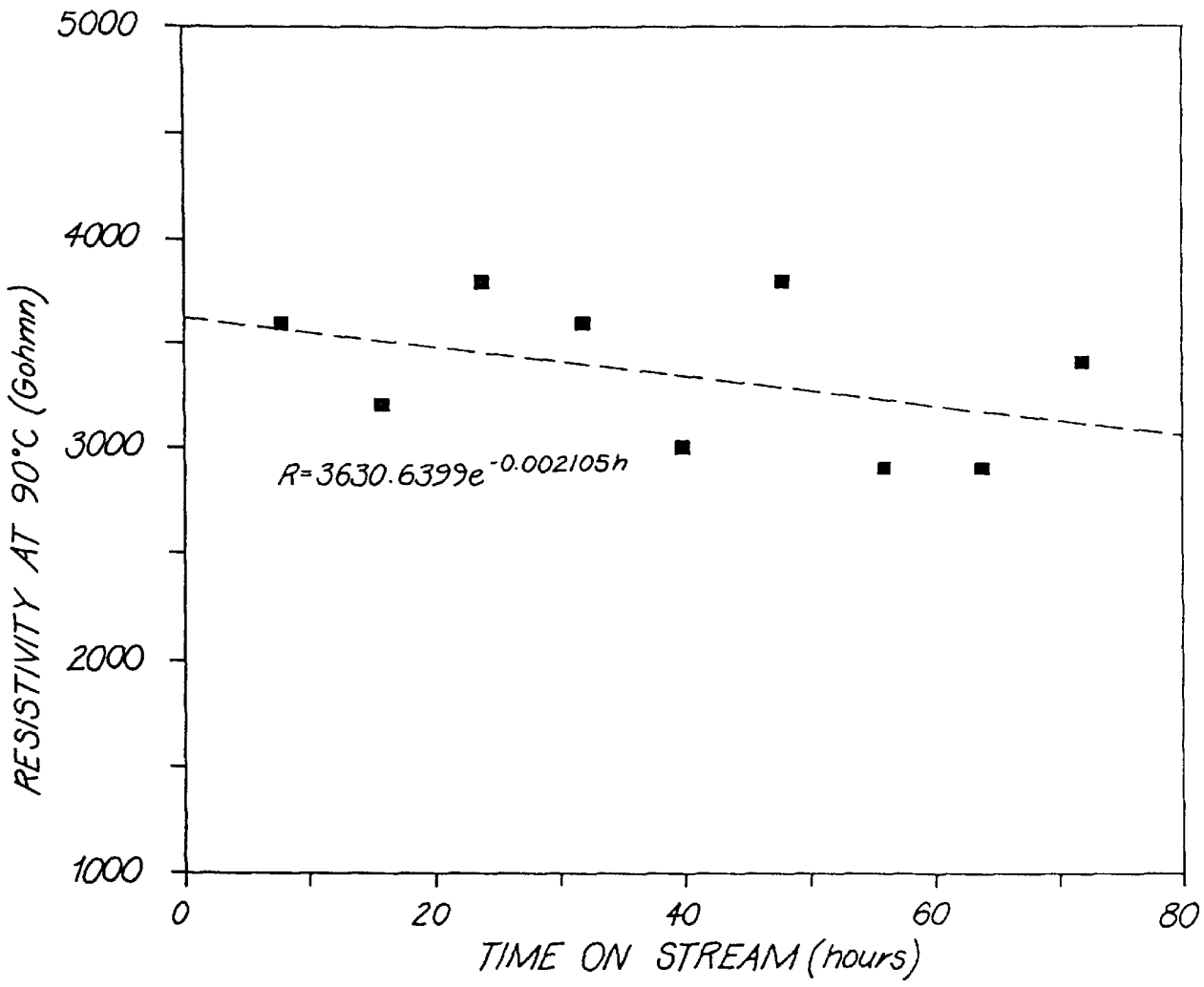
FIG. 13 is a graph of resistivity vs time on stream—run 4.

Like DDF and dielectric strength measurements, the resistivity procedure is subject to very poor repeatability (±20% below 10 Gohmm, but unknown above). Nevertheless, the data plotted in FIG. 13 shows the expected trend, and an exponential regression was carried out. Although subject to considerable uncertainty, this predicted that product resistivity would fall to 200 Gohmm after 57 days on stream.

Several points need to be considered regarding these estimates of catalyst run life. First, the regression analyses assume that the data are correct, ie that there is no error in their measurement. Second, they apply to this feed, when processed at the conditions of this run. Third, predictions from data obtained early in a catalyst's life usually underestimate true lifetime, because deactivation rates are then at their highest. At the start of Run 4, the catalyst charge had already been used for more than 11 days, which would normally be considered enough to have passed the initial rapid deactivation phase. Because several different feeds and processing conditions had been used, however, this may not have been so. Most importantly, catalyst deactivation during hydrotreating, leading to deterioration of product qualities at constant operating conditions, is entirely normal. In oil refineries, this is always compensated by slowly increasing the operating temperature, often by only a few degrees a year, to obtain constant product quality. This is the easiest option in practice, but it is also possible to decrease the feed space velocity to achieve the same effect.

3.4.7 Mass and Elemental Balances

Mass balances for this run are shown in Table 3.29. As was done to obtain hydrogen consumptions, the offgas flow-rate for samples 5 to 9 had to be estimated in order to complete these calculations. Total recoveries average 99.81%. As stated in Section 3.1.6, the most significant losses occur during water washing of the oil, and when the oil is discharged from the hydrotreater; the latter being due to gases and light hydrocarbons dissolved in the oil at system pressure escaping from solution when the pressure is reduced to atmospheric. However, apparent losses due to an unmeasured element in the oil, namely oxygen, are also important. It is appropriate at this stage to quantify some of these losses. Literature data (D. K. Matsumoto and C. N. Satterfield, Ind. Eng. Chem. Process Des. Dev., 1985,24, 1297–1300) indicate that at 30° C. and 3.5 MPa, hydrogen dissolved in the oil is around 0.018 g/100 g. The triethylamine in 100 g of feed produces 0.323 g of ethane, yet only an average of 0.255 g appears in the offgas. It is reasonable to expect the 0.068 g discrepancy to be dissolved in the product at system pressure and, like the hydrogen, lost during depressurisation and collection. Average measured weight loss during oil washing was 0.025 g/100 g, a quantity attributable to both evaporation of highly volatile products and mechanical losses. Together, these three sources of evaporative and mechanical loss account for 0.111 g.

The amount of water recovered from washing the oils was always greater than the total quantity put in. After allowing for the contained ammonia, hydrogen sulfide and hydrogen chloride, this excess averaged 0.079 g/100 g. This quantity, which is not included in the mass balance tables, completes the tally of "missing" material. Part of this extra water is likely to be moisture in the feed oil, but the majority would originate from hydrogenation of oxidised oil species. Neither the moisture nor the total oxygen contents of the feed oil have been measured, and as far as we are aware, no Australian laboratory can measure organic oxygen at levels below 0.5%. It should be noted that the acidity of the feed oil (taking the value of 0.06 mg KOH/g that was found) corresponds to an oxygen content of only 0.0034%, implying that most oxidised species are not acids.

TABLE 3.29

Mass Balance Data - Run 4.

| Sample | HT17-1 | HT17-2 | HT17-3 | HT17-4 |
|---|---|---|---|---|
| Component in (g/100 g Feed) | | | | |
| Oil | 99.6376 | 99.6376 | 99.6376 | 99.6376 |
| Triethylamine | 0.3624 | 0.3624 | 0.3624 | 0.3624 |
| Hydrogen | 2.0084 | 2.0191 | 2.0107 | 2.0045 |
| TOTAL IN | 102.0084 | 102.0191 | 102.0107 | 102.0045 |
| Component out (g/100 g Feed) | | | | |
| Oil | 99.7432 | 99.5732 | 99.6870 | 99.6408 |
| Methane | 0.0115 | 0.0109 | 0.0100 | 0.0106 |
| Ethane | 0.2609 | 0.2557 | 0.2507 | 0.2488 |
| Propane | 0.0164 | 0.0167 | 0.0179 | 0.0158 |
| i-Butane | 0.0033 | 0.0035 | 0.0032 | 0.0035 |
| n-Butane | 0.047 | 0.0050 | 0.0052 | 0.0042 |
| Pentanes | 0.0025 | 0.0029 | 0.0029 | 0.0019 |
| Hexanes | 0.0012 | 0.0008 | 0.0013 | 0.0004 |
| Hydrogen Sulfide | 0.0403 | 0.0410 | 0.0394 | 0.0389 |
| Ammonia | 0.0540 | 0.0543 | 0.0611 | 0.0565 |
| Hydrogen Chloride (aq) | 0.0010 | 0.0068 | 0.0103 | 0.0052 |
| Hydrogen | 1.7907 | 1.7550 | 1.7442 | 1.7474 |
| TOTAL OUT | 101.9295 | 101.7254 | 101.8331 | 101.7738 |
| Recovery (%) | 99.92 | 99.71 | 99.8.3 | 99.77 |

TABLE 3.29

| Sample | HT17-5 | HT17-6 | HT17-7 | HT17-8 | HT17-9 |
|---|---|---|---|---|---|
| Component in (g/100 g Feed) | | | | | |
| Oil | 99.6376 | 99.6376 | 99.6376 | 99.6376 | 99.6376 |
| Triethylamine | 0.3624 | 0.3624 | 0.3624 | 0.3624 | 0.3624 |
| Hydrogen | 1.9879 | 1.9978 | 1.9907 | 1.9989 | 2.0316 |
| TOTAL IN | 101.9879 | 101.9978 | 101.9907 | 101.9989 | 102.0316 |
| Component out (g/100 g Feed) | | | | | |
| Oil | 99.6416 | 99.6838 | 99.6161 | 99.5920 | 99.6068 |
| Methane | 0.0112 | 0.0110 | 0.0104 | 0.0106 | 0.0110 |
| Ethane | 0.2543 | 0.2593 | 0.2509 | 0.2542 | 0.2566 |
| Propane | 0.0162 | 0.0168 | 0.0165 | 0.0162 | 0.0183 |
| i-Butane | 0.0034 | 0.0037 | 0.0036 | 0.0033 | 0.0040 |
| n-Butane | 0.0042 | 0.0048 | 0.0044 | 0.0048 | 0.0050 |
| Pentanes | 0.0012 | 0.0020 | 0.0012 | 0.0020 | 0.0029 |
| Hexanes | 0.0002 | 0.0003 | 0.0010 | 0.0002 | 0.0011 |
| Hydrogen Sulfide | 0.0387 | 0.0398 | 0.0369 | 0.0376 | 0.0389 |
| Ammonia | 0.0595 | 0.0580 | 0.0588 | 0.0575 | 0.0587 |
| Hydrogen Chloride (aq) | 0.0109 | 0.0080 | 0.0094 | 0.0079 | 0.0094 |
| Hydrogen | 1.7680 | 1.7766 | 1.7674 | 1.7764 | 1.8121 |
| TOTAL OUT | 101.8093 | 101.8640 | 101.7765 | 101.7625 | 101.8246 |
| Recovery (%) | 99.82 | 99.87 | 99.79 | 99.77 | 99.80 |

Sulfur and nitrogen recoveries are shown in Tables 3.30 and 3.31. All are satisfactory numbers.

The chlorine recoveries shown in Table 3.32 are, except for the first sample, very good. In this run, the water layers from the nine bulk samples were combined as "bulk primary water" and the three water washes of each combined as "bulk washings", so that together with the washings from the mass balance subsamples, an overall chlorine balance could be obtained. The 19,397 g of feed containing 92±2 mg/kg Cl used in this run implies a total chlorine in of 1785±39 mg. Chlorine out was found to be: bulk primary water, 1338±31 mg; bulk washings, 32±1 mg; subsample washings, 240±5 mg; and total oil, 5±1 mg. This represents an overall recovery of 90.5±4.3%.

TABLE 3.30

Sulfur Recoveries - Run 4.

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Sulfur Recovery (%) |
|---|---|---|---|---|---|---|
| HT17-1 | 6.77 | 31.06 | 2.20 | 40.03 | 39.35 | 101.7 |
| HT17-2 | 6.07 | 32.40 | 2.60 | 41.07 | 39.35 | 104.4 |
| HT17-3 | 6.08 | 30.91 | 2.43 | 39.42 | 39.35 | 100.2 |
| HT17-4 | 5.55 | 30.98 | 3.21 | 39.74 | 39.35 | 101.0 |
| HT17-5 | 6.58 | 29.73 | 2.26 | 38.57 | 39.35 | 98.0 |
| HT17-6 | 5.42 | 31.92 | 2.41 | 39.76 | 39.35 | 101.0 |
| HT17-7 | 5.49 | 29.15 | 2.15 | 36.79 | 39.35 | 93.5 |
| HT17-8 | 5.31 | 29.93 | 2.04 | 37.28 | 39.35 | 94.7 |
| HT17-9 | 5.84 | 30.68 | 1.82 | 38.34 | 39.35 | 97.4 |

TABLE 3.31

Nitrogen Recoveries - Run 4.

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Nitrogen Recovery (%) |
|---|---|---|---|---|---|---|
| HT17-1 | 1.65 | 42.79 | 0.69 | 45.13 | 51.29 | 88.0 |
| HT17-2 | 1.28 | 43.36 | 0.58 | 45.22 | 51.29 | 88.2 |
| HT17-3 | 1.15 | 49.13 | 0.55 | 50.83 | 51.29 | 99.1 |

TABLE 3.31-continued

Nitrogen Recoveries - Run 4.

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Nitrogen Recovery (%) |
|---|---|---|---|---|---|---|
| HT17-4 | 1.11 | 45.40 | 0.56 | 47.07 | 51.29 | 91.8 |
| HT17-5 | 1.32 | 47.60 | 0.43 | 49.35 | 51.29 | 96.2 |
| HT17-6 | 1.21 | 46.55 | 0.49 | 48.25 | 51.29 | 94.1 |
| HT17-7 | 1.10 | 47.30 | 0.49 | 48.88 | 51.29 | 95.3 |
| HT17-8 | 1.34 | 46.15 | 0.43 | 47.71 | 51.29 | 93.0 |
| HT17-9 | 1.24 | 47.06 | 0.42 | 48.72 | 51.29 | 95.0 |

TABLE 3.32

Chlorine Recoveries - Run 4.

| Sample | Aqueous Phase (mg/100 g Feed) | Oil Phase (mg/100 g Feed) | Total Out (mg/100 g Feed) | Total Cl In (mg/100 g Feed) | Chlorine Recovery (%) |
|---|---|---|---|---|---|
| HT17-1 | 0.94 | 0.017 | 0.95 | 9.20 | 10.3 |
| HT17-2 | 6.59 | 0.031 | 6.62 | 9.20 | 72.0 |
| HT17-3 | 10.06 | 0.013 | 10.07 | 9.20 | 109.5 |
| HT17-4 | 5.01 | 0.014 | 5.03 | 9.20 | 54.6 |
| HT17-5 | 10.63 | 0.011 | 10.65 | 9.26 | 115.7 |
| HT17-6 | 7.77 | 0.011 | 7.78 | 9.20 | 84.6 |
| HT17-7 | 9.13 | 0.012 | 9.14 | 9.20 | 99.3 |
| HT17-8 | 7.64 | 0.017 | 7.66 | 9.20 | 83.2 |
| HT17-9 | 9.17 | 0.617 | 9.19 | 9.20 | 99.9 |

3.5 RUN 5 (HT18)

3.5.1 Feed Description and Operating Parameters

In this run, feed containing 1000 mg/kg of added PCB was used. With this quantity, there was a risk of blocking the reactor exit lines with ammonium chloride so a run of only 12 hours was planned. Because of the very high quality of the Run 3 and Run 4 samples, and a desire to obtain products with detectable levels of PCB, the space velocity was increased from 3 to $4h^{-1}$. In the event, a rapidly increasing pressure differential between the reactor inlet and outlet developed after only 5.5 hours on stream, and the run had: to be terminated with only five 360 g samples collected. However, this was sufficient product for analysis.

3.5.2 Trace Elements and PCB in Product Oils

The sulfur, nitrogen, chlorine and PCB results are shown in Table 3.33. Because of the milder conditions of this run compared to Runs 3 and 4, and the much greater feed PCB level, it is not surprising that, with the exception of PCB, the figures are significantly higher. The fact that the product PCB level is still below the detection limit of 0.1 mg/kg implies that in earlier runs, they must have been extremely low. A sample of HT18-1B was analysed for PCB by isotope dilution gc-ms, to obtain a more sensitive result. The PCB content was found to be below the detection limit of 0.008 mg/kg, which represents a destruction efficiency of greater than 99.9992%.

TABLE 3.33

Elemental Composition of Product Oils - Run 5

| Sample | Sulfur (mg/kg) | Nitrogen (mg/L) | Chlorine (mg/kg) | PCB (mg/kg) |
|---|---|---|---|---|
| HT18-1B | 49.4 | 5.8 | 0.29 | <0.1 |
| HT18-2B | 51.2 | 5.9 | 0.28 | — |
| HT18-Feed | 12.9 | 395 | 410 | 1024 |

3.5.3 Hydrogen Consumptions

The two hydrogen consumption results from this run shown in Table 3.34 are very close to the 0.170 g predicted from the equation in Section 3.1.3. This prompts the question of whether the leak in the offgas flow device which became obvious in the early stages of Run 4 had in fact been present earlier, during Run 3. The apparently "normal" hydrogen consumptions in those two runs were considerably greater than expected, and a small leak would account for this.

TABLE 1.14

Hydrogen Consumptions - Run 5

| Sample | Hydrogen Consumption (g $H_2$/100 g Feed) |
|---|---|
| HT18-1B | 0.185 |
| HT18-2B | 0.151 |

3.5.4 Vacuum Treatment of Product Oils

Vacuum treatment was carried out on combined samples HT18-1A, 1B and 1C, and on HT18-1A plus 1B to an end point of 87° C. Despite the fact that 0.04 to 0.10% more is lost through PCB removal, the residue yields shown in Table 3.35 are significantly higher than those of Runs 3 and 4. This is attributable to less cracking at the higher space velocity of this run, and indicates that the much greater hydrogen chloride concentration has had no significant effect, being completely neutralised by the excess of hydrogen chloride scavenger.

TABLE 3.35

Distillation Data - Run 5

| Sample | Residue (g/100 g Product Oil) | Distillate (g/100 g Product Oil) | Loss (g/100 g Product Oil) | Yield (g/100 g Feed Oil) |
|---|---|---|---|---|
| HT18-1 | 99.62 | 0.25 | 0.13 | 99.60 |
| HT18-2 | | 0.31 | 0.14 | 99.93 |

3.5.5 Electrical and Other Properties of Vacuum Treated Oils

Because this run was at milder conditions than previous runs, the product qualities shown in Table 3.36 are generally lower. Resistivity seems to be the property most effected, although interfacial tension is also significantly lower. Using the equations generated from Run 4, and allowing for the different space velocities, it can be estimated that run length under these conditions would be about half that at space velocity $3h^{-1}$. However, this ignores the possible effect of the high chlorine content of this feed.

TABLE 3.36

Electrical Properties of Vacuum Treated Oils - Run 5

| Sample | Flash Point (°C.) | Acidity (mgKOH/g) | Interfacial tension (mN/m) | DDF (mW/VAR) | Resistivity (Gohmm) | Electrical Strength (kV) |
|---|---|---|---|---|---|---|
| HT18-1 | 140 | <0.01 | 39.9 | 0.7 | 1900 | >82 |
| HT18-2 | 144 | <0.01 | 44.1 | 0.7 | 2200 | >90 |
| HT18-Feed | 153 | 0.04 | 22.1 | 72.1 | 4.3 | 64 |

> One or more of the six determinations exceeded the maximum test voltage of 90 kV.

3.5.6 Mass and Elemental Balances

Mass balance data for this run are shown in Table 3.37. The oil yield for sample HT18-2B must be an error, probably in reading the feed tank weight during the forced shutdown.

TABLE 3.37

Mass Balance Data — Run 5

| Sample | HT18-1B | HT18-2B |
|---|---|---|
| Component in (g/100 g Feed) | | |
| Oil | 99.6376 | 99.6376 |
| Hydrogen | 1.9909 | 1.9994 |
| Triethylamine | 0.3624 | 0.3624 |
| TOTAL IN | 101.9909 | 101.9994 |
| Component out (g/100 g Feed) | | |
| Oil | 99.6164 | 100.1517 |
| Methane | 0.0047 | 0.0054 |
| Ethane | 0.2564 | 0.2630 |
| Propane | 0.0150 | 0.0148 |
| i-Butane | 0.0033 | 0.0033 |
| n-Butane | 0.0053 | 0.0064 |
| Pentanes | 0.0041 | 0.0011 |
| Hexanes | 0.0008 | 0.0005 |
| Hydrogen Sulfide | 0.0356 | 0.0363 |
| Ammonia | 0.0531 | 0.0497 |
| Hydrogen Chloride (aq) | 0.0198 | 0.0153 |
| Hydrogen | 1.8055 | 1.8489 |
| TOTAL OUT | 101.8200 | 102.3963 |
| Recovery (%) | 99.83 | 100.39 |

Nitrogen, sulfur and chlorine recoveries are shown in Tables 3.38 to 3.40. More than half of the chlorine fed into the reactor was not recovered in this run, the loss totalling just over 400 mg. It should be noted that the estimated ammonium chloride deposition temperature for this run is 280° C., very close to the nominal 300° C. at which the reactor effluent is maintained before water injection. Hold-up of chlorine as ammonium chloride also explains the lower nitrogen recoveries, compared with Runs 3 and 4.

TABLE 3.38

Sulfur Recoveries — Run 5

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Sulfur Recovery (%) |
|---|---|---|---|---|---|---|
| HT18-1B | 7.47 | 25.91 | 4.92 | 38.30 | 39.32 | 97.41 |
| HT18-2B | 8.02 | 26.07 | 5.13 | 39.22 | 39.32 | 99.75 |

TABLE 3.39

Nitrogen Recoveries — Run 5

| Sample | Gas Phase (mg/100 g Feed) | Aqueous Phase (mg/100 g Feed) | Oil Phase (mg/100 g Feed) | Total Out (mg/100 g Feed) | Total In (mg/100 g Feed) | Nitrogen Recovery (%) |
|---|---|---|---|---|---|---|
| HT18-1B | 0.86 | 42.85 | 0.65 | 44.36 | 51.28 | 86.51 |
| HT18-2B | 0.91 | 40.00 | 0.67 | 41.58 | 51.28 | 81.08 |

TABLE 3.40

APPENDIX A
Chlorine Recoveries — Run 5

| Sample | Aqueous Phase (mg/100 g Feed) | Oil Phase (mg/100 g Feed) | Total Out (mg/100 g Feed) | Total In (mg/100 g Feed) | Chlorine Recovery (%) |
|---|---|---|---|---|---|
| HT18-1A | 13.56 | 0.03 | 13.59 | 41.00 | 33.13 |
| HT18-1B | 19.21 | 0.03 | 19.24 | 41.00 | 46.92 |
| HT18-1C | 23.37 | 0.04 | 23.41 | 41.00 | 57.09 |
| HT18-2A | 19.69 | 0.03 | 19.72 | 41.00 | 48.10 |
| HT18-2B | 14.84 | 0.03 | 14.86 | 41.00 | 36.25 |

APPENDIX A

CSIRO PILOT HYDROTREATER

A 1.1 Description of the CSIRO Pilot Hydrotreater

Figure 14:
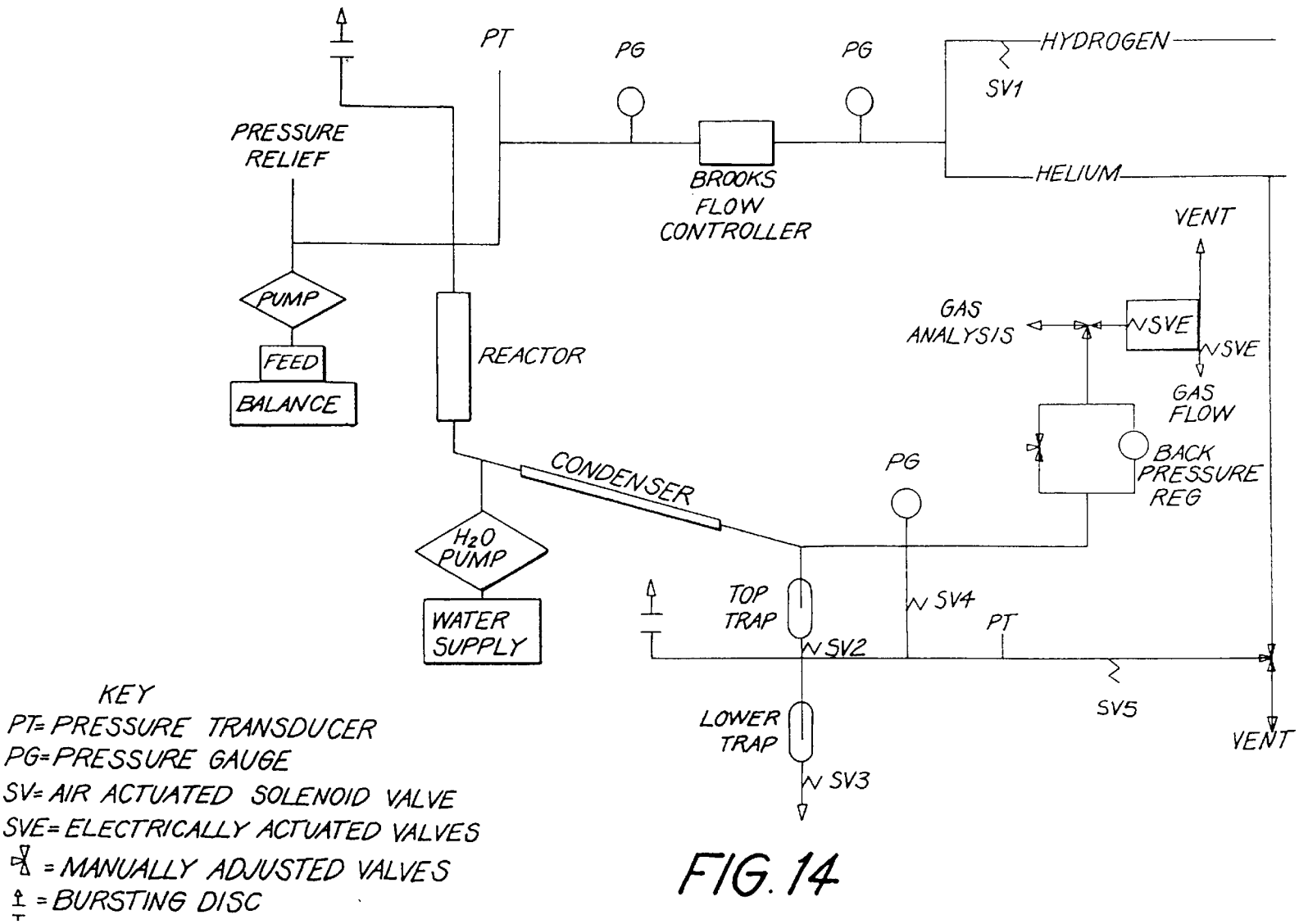
FIG. 14 depicts schematically a pilot plant system used in various experiments.
Figure 15:
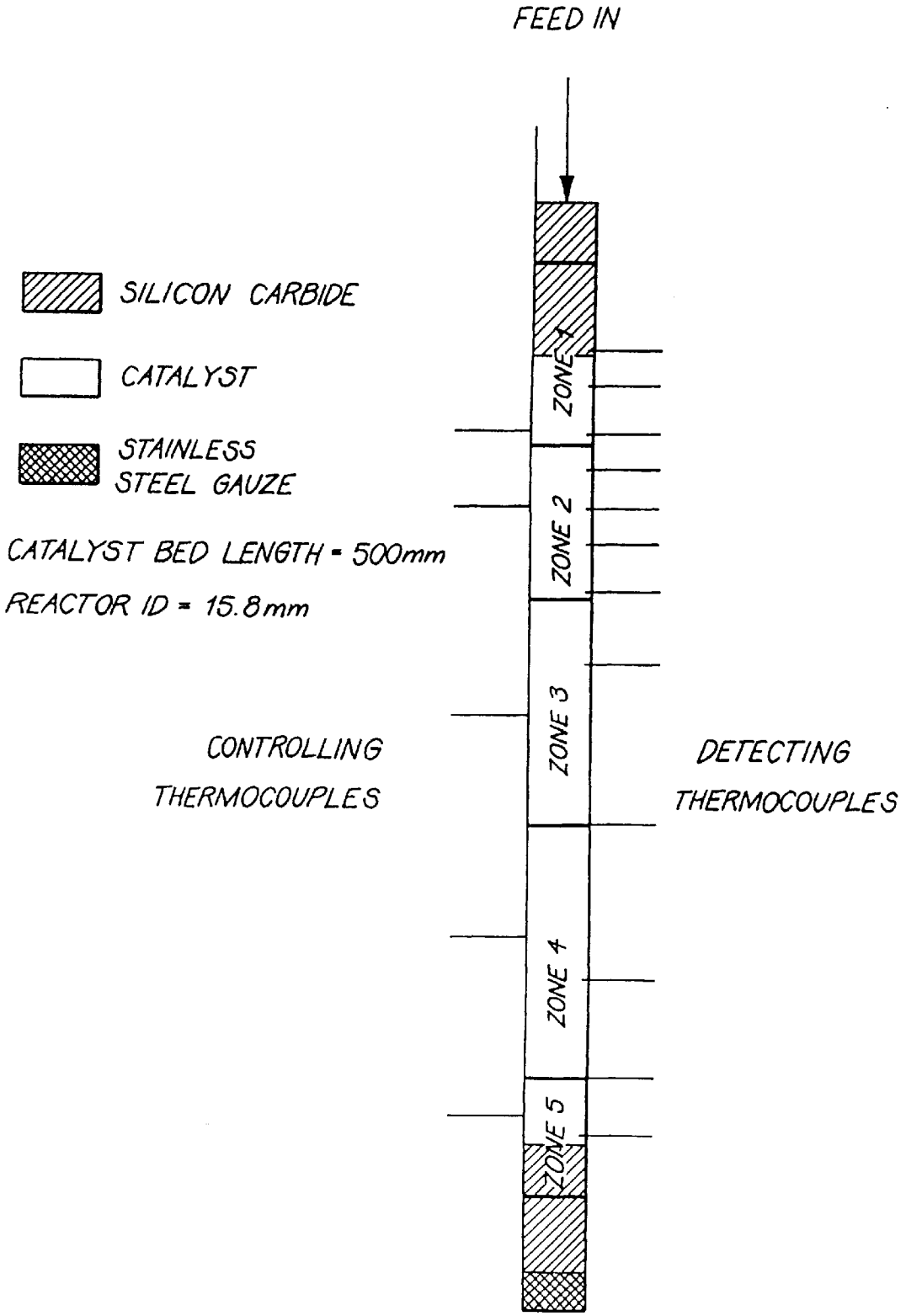
FIG. 15 depicts schematically a catalytic reactor used in various experiments.

A schematic diagram of the hydrotreater is given in FIG. 14. The reactor, FIG. 15, consists of five heated zones, each having individual controllers. A series of detecting thermocouples, embedded in the catalyst enabled the temperature gradient to be monitored while the rig was operational.

The reactor was packed with 90 g of catalyst (Cyanamid HDN-60 1.6 mm Trilobes) dispersed along the reactor length between heating zones 1 and 5, the remaining volume of reactor was packed with silicon carbide (1.4 mm), the packing material was supported from the bottom by a stainless steel gauze cylinder. The catalyst was presulfided as described in Section A 1.3.

Hydrogen is pressurised and delivered to the hydrotreater, its flow rate being regulated by the Brooks Flow Controller. Feed is pumped into the system and passes through the heated catalyst bed. Water (normally 5 wt % of feed oil) is injected into the product stream at the exit of the reactor to dissolve ammonium chloride produced in the reaction. The temperature of this region is maintained at 300° C. The product stream is then cooled to 30° C. prior to separation of the liquid and gaseous phases.

To enable discharge of liquid products without disturbing the system pressure, a series of air actuated solenoid valves were incorporated into the rig design. During normal operation SV3 and SV5 are closed, and products collect in the lower trap. To withdraw the sample, SV2 and SV4 are closed, isolating the lower trap, SV5 is opened and the pressure vented to approximately 1.4 MPa. SV5 is closed, SV3 opened and the retained pressure used to expel the liquid products. SV3 is then closed, SV5 is reopened and the lower trap repressurised with helium to operational pressure. SV2 and SV4 are then reopened. The temperature of the lower trap was kept at 30° C.

During hydrotreating, off-gas samples were collected for analysis. These samples were collected into 5 L cyanamide gas bags down stream of the back pressure regulator by manually switching the valve from 'vent' to 'gas collection'.

The gas flow out of the hydrotreater was also measured at this point using a Lapszewicz gas flow device (J. A. Lapszewicz, "Device for measurement of volumetric flow rates", Meas. Sci. Technol. 2 (1991) 815–817). Computer controlled solenoids directed the gas flow from 'vent' to 'measure', by using infra red emitters and sensors the gas flow was determined by displacement of a known volume of water at atmospheric pressure.

After the last sample was collected, heating zones 1 to 5 were turned off, and the feed was changed to toluene. When the temperature was such that the highest zone was 200° C., the feed and water pumps were turned off and a slow depressurisation of the system affected through the back pressure regulator. At a pressure of 0.1 MPa, the system was flushed with helium by pressurising to 1 MPa through the Brooks Flow Controller and then depressurising through the back pressure regulator.

A 1.2 Safety Mechanisms

The hydrotreating rig was designed with an elaborate series of safety mechanisms which close the system down in the event of certain alarm conditions being activated. These include:

(a) A temperature reaching 50° C. above the set value; (b) Pressures above or below values determined by the operating conditions; (c) An earth leak greater than 30 mA; (d) Hydrogen levels within the surrounds reaching 20% of the lower explosive limit; (e) Ventilation failure; and (f) Mains power failure.

In the event of an alarm condition being activated, a simultaneous shutdown of heaters, feed, water injection and hydrogen flow (at SV1) occurs.

A 1.3 Catalyst Activation

Catalyst activation was carried out under hydrogen at a pressure of 5 MPa. The feed used was 850 g toluene, to which 51 g of dimethyldisulfide had been added. After pressurising the system and establishing the hydrogen flow, feed was introduced at a rate of 84.5 $ghr^{-1}$. The temperature was then incremented 25° C. every 30 minutes to 250° C., and held at this point until hydrogen sulfide could be detected in the off-gas using Drager tubes. After detection of the hydrogen sulfide, the temperature was increased in stages of 25° C. (ensuring a breakthrough of $H_2S$ each time) to 350° C.

The temperature was held at 350° C. for 2 hours, and then decreased to 200° C., at which point the feed and heaters were turned off. The hydrogen flow was stopped when the temperature reached 100° C., and the system left at 5 MPa overnight.

A 1.4 Pre Run Preparation of Hydrotreater

Prior to each hydrotreating trial the entire system was pressure tested to 10 MPa with helium. When commencing a trial, hydrogen pressure was gradually increased to the initial working pressure, and the flow set at the required rate. The temperature was increased step-wise to 200° C. over a 40 minute interval, at which time the feed and water pumps were turned on, and was then incremented in 20° C. steps until the initial condition temperature was reached. The time at which the detecting thermocouples indicated a stable temperature had been reached was called time zero and timing of the first equilibration sample begun.

APPENDIX B

HYDROTREATER OPERATION

B.1. Runs 1 and 2 (HT14 and HT15)

Trials 14 and 15 employed a factorial experimental design, varying temperature, pressure and space velocity around a centre point of 340° C./3.5 MPa/2.0 $hr^{-1}$, which to assess the catalyst aging was carried out at the beginning, middle and end of these trials.

The feed used in Run 1, was a typical oil for regeneration. The total chlorine level and PCB content of the oil were 19.1 mg/kg and 24 mg/kg respectively.

The feed used in Run 2 was the same feed oil used in Run 1, with an added 200 mg/kg of PCB. The PCB used was Type 1016, drained from a Plessy Type APF 265 OR capacitor.

The order in which different conditions were carried out is given below:

| Condition | Temperature/Pressure/Space velocity (° C./MPa/$hr^{-1}$) |
|---|---|
| 1 | 340/3.5/2 |
| 2 | 360/2/1 |
| 3 | 320/2/1 |
| 4 | 320/2/3 |
| 5 | 320/5/3 |
| 6 | 340/3.5/2 |
| 7 | 360/2/3 |
| 8 | 320/5/1 |
| 9 | 360/5/3 |

-continued

| Condition | Temperature/Pressure/Space velocity (° C./MPa/hr$^{-1}$) |
|---|---|
| 10 | 360/5/1 |
| 11 | 340/3.5/2 |

In Run 2, a twelfth condition was introduced (340/3.5/3).

At the commencement of Runs 1 and 2, an equilibration interval of 2 hours was allowed, during which time 4 samples were taken. After these equilibration samples were collected, 3 steady state samples were collected, (A, B and C) each in 2 sub-parts, over a period (determined by the space velocity) to yield the required weight of sample for analysis. After collection of the three steady state samples, condition parameters were changed and the system again allowed to stabilize for a period determined by the space velocity prior to collection of the next steady state samples.

Following sample collection, the samples were washed with millipore water distilled from potassium permanganate (3×1.5 vol %) to liberate any residual hydrogen sulfide, ammonia and ammonium chloride. Off-gas analysis was carried out on sub-sample part two of the second and third steady-state samples of each condition. In Trial 14, the gas flow out of the system was measured during the first part of the first steady-state sample. In Run 2, the gas flow was measured during the first sub-sample of each steady-state sample.

Chlorine, nitrogen and sulfur analyses were normally executed on the second (B) sample prior to combination of samples A, B and C for distillation.

B.2. Run 3 (HT16)

Run 3 was to be an extended run at the optimum processing conditions (indicated by the results of Runs 1 and 2) designed to both test catalyst stability and to produce sufficient volumes of oil for larger scale test work. The feed to be used in Run 3 was the same as that used in Run 1, that is, with no added PCB.

At the commencement of this trial, two equilibration samples were collected before steady state conditions were assumed. Steady state samples were collected at 40 minute intervals, the first ten parts being combined as a bulk sample. The next two 40 minute samples were combined in a separate bottle as a sub-sample. The sub samples were used for the determination of mass and elemental balances.

After collection the samples were washed with millipore water distilled from potassium permanganate solution. (3×1.5 vol %).

Gas flow measurements during Run 3 were taken during the collection of part i of each subsample, samples for off-gas analysis were collected during the collection of part ii.

This run was terminated prematurely after part x of the fourth bulk sample had been collected due to a minor leak below the water injection point.

B.3. Run 4 (HT17)

As mentioned in the previous section, Run 3 was terminated prematurely, therefore, the intended test of catalyst stability was unable to be determined. For this reason the intended length of Run 4 was increased. The feed for this run contained 200 mg/kg added PCB.

At the commencement of this Trial, two equilibration samples were collected before steady state conditions were assumed. Steady state samples were collected at 40 minute intervals, the first 10 parts being combined as a bulk sample. The next two forty minute samples were combined in a separate bottle as a sub-sample. The sub samples were used for the determination of mass and elemental balances.

Gas flow measurements during Run 4 were taken during the collection of part i of each subsample, samples for off-gas analysis were collected during the collection of part ii. After collection the samples were washed with millipore water distilled from potassium permanganate solution. (3×1.5 vol %).

APPENDIX C

ANALYTICAL METHODS

C.1. Acidity

Acidity measurements were carried out according to IP 1 "Determination of Acidity. Method A—Total Acidity". An acidity result of "0.00" means the indicator did not change colour when added to the test sample. A result of <0.01 indicates that the acidity was less than the minimum aliquot of titrant.

C.2. Ammonia

Gas samples for analysis were collected from the hydrotreater at the collection point shown in FIG. 14. 5 L of gas was collected as close to the end of the relevant sampling period as possible. Ammonia levels were determined using a Drager Tube.

C.3. Chlorine

These analyses were carried out by NAA. Approximately 0.8 g of sample was irradiated for 1 minute, a decay time of 2 minutes was used with a count time of 200 seconds.

C.4. Corrosive Sulfur Tests

ASTM D 1275 "Standard Test Method for Corrosive Sulfur in Electrical Insulating Oils" was used for these analyses, which were carried out at 140° C. for 19 hours.

C.5. Dielectric Dissipation Factor

Dielectric dissipation factors were obtained by using IEC 247, "Measurement of relative permittivity, dielectric dissipation factor and d.c. resistivity of insulating liquids" (see Appendix A).

C.6. Dielectric Strength

Dielectric strength measurements were made according to AS 1767/75 "Insulating Oils for Transformers and Switchgear" Appendix C "Method for Test of Electric Strength".

C.7. Flash Point

IP 34, "Determination of Closed Flashpoint—Pensky Martens Method" was used to obtain the flash points quoted in this report.

C.8. Hydrogen Consumption

Hydrogen consumptions were calculated using the difference between the gas flow in, measured on the calibrated Brooks Flow Controller, and the gas flow out, measured on the Lapszewicz device described in Appendix A 1.1. Allowances were made for the volume of gas displaced by the accumulating liquid.

C.9. Hydrogen Sulfide

Gas samples for analysis were collected from the hydrotreater at the collection point shown in FIG. 14. 2 to 3 L of gas was collected as close to the end of the relevant sampling period as possible. Hydrogen sulfide analysis was performed using a Drager Tube.

C.10. Interfacial Tension

ISO 6295 "Determination of Interfacial Tension of Oil against Water—Ring Method" was used to determine the flash points.

C.11. Nitrogen by Chemiluminescent Determination

Nitrogen analyses on oil samples were obtained by chemiluminescent determination on an Antek nitrogen detector. 0.5 $\mu$L aliquots were injected into the quartz furnace at 1000° C. in an oxygenated atmosphere, the nitrogen is converted to $NO_2$ which is reacted with ozone, producing metastable nitrogen dioxide, as this relaxes the light emitted is detected by a photomultiplier tube.

C.12. Nitrogen as Ammonia by Titrimetric Analysis

Nitrogen analysis on the aqueous samples from Runs 3, 4 and 5 was carried out following the direct method described by Vogel+. One amendment was made to this procedure, that was, the sodium hydroxide solution instead of being added from the dropping funnel, was added directly to the flask.

+Vogel, A. I. "Text Book of Quantitative Inorganic Analysis Including Elementary Instrumental Analysis." 3rd Ed, 1961 Longmans, Page 254.

C.13. Off-gas Analysis

Gas samples for analysis were collected from the hydrotreater at the collection point shown in FIG. 14. 5 L of gas was collected as close to the end of the relevant sampling period as possible. Ammonia and hydrogen sulfide determinations on the sample were performed prior to analysis by GC. The GC analysis was executed on a Varian 6000 Gas Chromatograph fitted with the following columns;

1. Porapak QC acetone washed (mesh 80/100) 12'×⅛" SS
2. Molecular Sieve 5A (mesh 40/60) 6'×⅛" SS Instrumental parameters were:

Injector temperature: 160° C.; TCD Detector temperature: 220° C.; Filament temperature 250° C.; Sensitivity Range: 0.05; Flow 30 ml/min; Injection volume 250 μL.

Depending on the condition of the molecular sieve, the temperature program varied slightly between Trials, but was close to or actually 50° C. for 6 minutes then 10° C./min to 140° C., 140° C. for 4 minutes 10° C./min to 220° C. and held 7 minutes.

C.14. PCB Analysis

PCB determinations were carried out using Gas Chromatography with an Electron Capture Detector according to method EO 3.

C.15. Resistivity

Resistivity was measured according to IEC 247, "Measurement of relative permittivity, dielectric dissipation factor and d.c. resistivity of insulating liquids" (Appendix A).

C.16. Simulated Distillation

Simulated distillation analysis of feed and product oils were carried out using a Varian 3400 gas chromatograph. Analysis were performed based on ASTM D2887 method and the following instrument set-up was adopted:

Column Type: SGE 25 m QC5/BP1 1.0 with 1 m retention gap; Temperature: 0° C. to 320° C. (10 min) at 15° C./min; Flow rate: column at 5 cc/min; make-up at 20 cc/min.

Injector Type: on-column injection, Temperature: 300° C.

Detector Type: FID at sensitivity range $10^{-9}$; Temperature: 320° C.; Flow rate: Hydrogen at 30 cc/min; Air at 300 cc/min.

Boiling-point distribution of the oil analysed was obtained by processing slice data from the chromatography run. This calculation was conducted using Lotus-123 software on an IBM-PC.

C17. Organic Sulfur

Trace level organic sulfur determinations were made by reduction with Raney nickel. The hydrogen sulfide liberated when acid is added is titrated with mercuric acetate solution. Prior to analyses the samples were subjected to extensive pre-treatment to remove possible contaminants. They were initially shaken for 5 minutes with cadmium chloride solution, centrifuged and than washed with 3×1 mL aliquots of water, this removes any residual hydrogen sulfide. The samples were then shaken with 2–3 drops of mercury for a further 5 minutes to remove any elemental sulfur present. The sample was then centrifuged and decanted.

All water used for washing samples was deionised and distilled from potassium permanganate, and all glassware used was washed with sodium hydroxide and nitric acid solutions.

EXAMPLE 4

Two different contaminated transformer oils, (Starting Material A and Starting Material B) were subjected to mild hydrogenation in a packed bed catalytic reactor (catalyst (Cyanamid Trilobe HDN 60 1.6 mm extrudates) in its sulfided form held at 320–330° C.). Under these conditions hydrogen reacted with heteroatoms in the oil itself, and also with PCBs and other chlorinated hydrocarbons present. Oxygen present in compounds resulting from ageing of the oil in service was converted to water. Any PCBs and other chlorinated species were converted to hydrogen chloride and light hydrocarbons. Trace amounts of basic organic amines, such as triethylamine, and/or ammonia were fed to the reactor to ensure that the hydrochloric acid produced did not lead to degradation of the catalyst and to reduce hydrocarbon cracking reactions. In the downstream process, gases and light hydrocarbons were separated from the regenerated transformer oil, and the product oil was washed with distilled water to remove chlorides formed as a reaction product of PCB destruction.

The process was carried out on a laboratory scale using an existing small scale (6 kg/day) continuous reactor facility at the CSIRO. A total of 500 hours on stream have been completed. Typical results for oil regeneration and PCB removal are shown in Table 4.1 and Table 4.2 respectively.

TABLE 4.1

Example of regeneration of the electrical properties of degraded transformer oils

| | Dielectric property | | | | |
|---|---|---|---|---|---|
| | Dielectric dissipation (mwatts/var) | Resistivity (Gohm-m) | Dielectric strength (kV) | Acidity (mg KOH/g) | Interfacial tension (mN/m) |
| Desired value | <6 | >200 | >60 | <0.03 | >30 |
| Starting material A | 470 | 1.2 | 58 | NA | NA |
| Starting material B | 72.1 | 4.3 | 64 | 0.04 | 22.1 |
| Product A | 1.1 | 925 | 79 | NA | NA |
| Product B | 0.7 | 2050 | 86 | <0.01 | 42 |

TABLE 4.2

Typical results for PCB destruction in transformer oils

| | Feed PCB (g/tonne) | Product PCB (g/tonne) |
|---|---|---|
| Product A | 12.5 | <0.010 |
| Product B | 1024 | <0.008 |

This laboratory scale study showed that:

The process is very effective in restoring the dielectric properties of the oil, and oil yields in excess of 99% were achieved routinely.

The process is extremely effective for the destruction of PCBs, reducing feed concentrations as high as 1000 ppm to levels below the detection limit of about 10 parts per billion, corresponding to a single pass decontamination factor of >99.999%.

The process can be adapted and used to destroy other chlorinated toxic materials such as DDT, dioxin and HCB with single pass decontamination factors >99.999%.

The process will be suitable for a number of other applications, including destruction of highly toxic materials formed as by-products in the manufacture of magnesium and titanium metals.

REFERENCES

1. ANON New Scientist, p. 24, Jun. 22, 1991
2. C. J. Rogers, A. Kornell, H. I. Sparks, Proceedings or the 1st National Hazardous and Sold Waste Convention, Sydney, Mar. 29–Apr. 2, 1992. Vol. 1, p.8.1–8.8.
3. B. F Hagh and D. T. Allan, Innovative Hazardous Waste Treatment Technology (Physical and Chemical Processes), Series 1990, 2, P.45–53.
4. U.S. Pat. No. 4,749,817 (1988)
5. U.S. Pat. No. 2,007,668 (1978)
6. U.S. Pat. No. 4,927,520 (1990)
7. U.S. Pat. No. 4,923,590 (1990)
8. U.S. Pat. No. 4,719,007 (1988)
9. U.S. Pat. No. 4,775,475 (1988)

It will be appreciated by persons skilled in the art that numerous variations and/or modifications may be made to the invention without departing from the spirit and scope of the invention as broadly described. The present embodiments are, therefore, to be considered in all respects as illustrative and not restrictive.

INDUSTRIAL APPLICABILITY

The processes of the present invention have widespread application to the regeneration of Australia's and other countries' transformer oil inventory. The total inventory in Australia is about 240 million liters of which more than 30% is contaminated with PCBs above 0.1 ppm. It is expected that the quantity of oil requiring regeneration will rise from around 1.7 million liters pa at present to around 4.6 million liters pa by the year 2000. The major attraction of this technology is that it can be used to treat all of this oil, irrespective of the level of PCB contamination.

Another application of the technology will be for the clean up of capacitors contaminated with PCBs. This market is estimated to be a minimum of 210 tonnes of PCBs.

A further application of this new technology relates to the destruction of PCBs and similar compounds formed during the production of magnesium and titanium metals. It is expected that production of magnesium metal will become a major new Australian industry, based on the recently discovered Kunwarara magnesite deposit. It is being developed with substantial federal and state government support. Current plans envisage production of up to 240,000 tonnes of magnesium metal per annum. Such a size plant will produce substantial quantities of PCBs, HCBs and other similar chlorinated organic compounds. At present, the disposal of so much waste is a major problem. The process of the present invention is ideally suited for destroying this waste and could, moreover, be easily integrated into the overall process flowsheet.

We claim:

1. A process for removal of halide from a halide containing organic compound in a solvent of hydrocarbon or oil, the process comprising the steps of:

exposing a solvent of hydrocarbon or oil having a halide containing organic compound, in the presence of hydrogen and a hydrogen halide scavenger, to a catalyst which is capable, in the presence of hydrogen, of converting the halide in the halide containing organic compound to hydrohalic acid, at a pressure and at an elevated temperature and for a time sufficient to convert the halide in the halide containing organic compound to hydrohalic acid; and neutralizing the resulting hydrohalic acid with the hydrogen halide scavenger.

2. The process of claim 1 further comprising the step of: neutralizing any catalyst acid sites with the hydrogen halide scavenger.

3. The process of claim 1 further comprising the step of: removing the exposed solvent from the catalyst; and separating non solvent materials from the exposed solvent.

4. The process of claim 1 wherein at the pressure and the elevated temperature:

the neutralizing of the resulting hydrohalic acid with hydrogen halide scavenger results in a neutralization product(s) that does not substantially precipitate on the catalyst, and wherein the process further comprises the steps of:

removing the exposed solvent from the catalyst; and separating non solvent materials from the exposed solvent.

5. The process of claim 1 wherein at the pressure and the elevated temperature:

the neutralizing of the resulting hydrohalic acid with hydrogen halide scavenger results in a neutralization product(s) comprising a neutralization product(s) selected from the group consisting of vaporized ammonium halide and dissociated ammonia and gaseous hydrohalic acid, that does not substantially precipitate on the catalyst, and wherein the process further comprises the steps of:

removing the exposed solvent from the catalyst; and separating non solvent materials from the exposed solvent.

6. The process of claim 1, wherein said halide containing organic compound is a polychlorinated biphenyl.

7. A process for simultaneous removal of halide from a halide containing organic compound and reduction of an oxygen containing organic compound in a solvent of hydrocarbon or oil, the process comprising the steps of:

exposing a solvent of hydrocarbon or oil having a halide containing organic compound and an oxygen containing organic compound, in the presence of hydrogen and a hydrogen halide scavenger, to a catalyst which is capable, in the presence of hydrogen, of:

i) converting the halide in the halide containing organic compound to hydrohalic acid; and ii) reducing the oxygen containing organic compound;

at a pressure and at an elevated temperature and for a time sufficient:

a) to convert the halide in the halide containing organic compound to hydrohalic acid; and b) to reduce the oxygen containing compound; and neutralizing the resulting hydrohalic acid formed in (a) with the hydrogen halide scavenger.

8. The process of claim 7 further comprising the step of: neutralizing any catalyst acid sites with the hydrogen halide scavenger.

9. The process of claim 7 further comprising the step of: removing the exposed solvent from the catalyst; and separating non solvent materials from the exposed solvent.

10. The process of claim 7 wherein at the pressure and the elevated temperature:

the neutralizing of the resulting hydrohalic acid with hydrogen halide scavenger results in a neutralization product(s) that does not substantially precipitate on the catalyst, and wherein the process further comprises the steps of:

removing the exposed solvent from the catalyst; and separating non solvent materials from the exposed solvent.

11. The process of claim 7 wherein at the pressure and the elevated temperature:

the neutralizing of the resulting hydrohalic acid formed with hydrogen halide scavenger results in a neutralization product(s) comprising a neutralization product(s) selected from the group consisting of vaporized ammonium halide and dissociated ammonia and gaseous hydrohalic acid, that does not substantially precipitate on the catalyst, and wherein the process further comprises the steps of:

removing the exposed solvent from the catalyst; and separating non solvent materials from the exposed solvent.

12. The process of claim 7, wherein said halide containing organic compound is a polychlorinated biphenyl.

13. A process for removal of a halide from a halide containing organic compound, the process comprising the steps of:

dissolving the halide containing organic compound in a solvent of hydrocarbon or oil;

exposing the solvent having a halide containing organic compound, in the presence of hydrogen and a hydrogen halide scavenger, to a catalyst which is in the presence of hydrogen, of converting the halide in the halide containing organic compound to hydrohalic acid, at a pressure and at an elevated temperature and for a time sufficient to convert the halide in the halide containing organic compound to hydrohalic acid; and neutralizing the resulting hydrohalic acid with the hydrogen halide scavenger.

14. The process of claim 13 further comprising the step of: neutralizing any catalyst acid sites with the hydrogen halide scavenger.

15. The process of claim 13 further comprising the step of: removing the exposed solvent from the catalyst; and separating non solvent materials from the exposed solvent.

16. The process of claim 13 wherein at the pressure and the elevated temperature:

the neutralizing of the resulting hydrohalic acid with hydrogen halide scavenger results in a neutralization product(s) that does not substantially precipitate on the catalyst, and wherein the process further comprises the steps of:

removing the exposed solvent from the catalyst; and separating non solvent materials from the exposed solvent.

17. The process of claim 13 wherein at the pressure and the elevated temperature:

the neutralizing of the resulting hydrohalic acid with hydrogen halide scavenger results in a neutralization product(s) comprising a neutralization product(s) selected from the group consisting of vaporized ammonium halide and dissociated ammonia and gaseous hydrohalic acid, that does not substantially precipitate on the catalyst, and wherein the process further comprises the steps of:

removing the exposed solvent from the catalyst; and separating non solvent materials from the exposed solvent.

18. The process of claim 13, wherein said halide containing organic compound is a polychlorinated biphenyl.

19. A process for reduction of an oxygen containing organic compound in a solvent of hydrocarbon or oil, the process comprising the steps of:

exposing a solvent of hydrocarbon or oil having an oxygen containing organic compound, in the presence of hydrogen and acid scavenger, to a catalyst which is capable, in the presence of hydrogen, of:

i) reducing the oxygen containing organic compound;

at a pressure and at an elevated temperature and for a time sufficient to reduce the oxygen containing organic compound; and neutralizing any acid in the exposed solvent and any catalyst acid sites with the acid scavenger.

20. The process of claim 19 further comprising the step of: removing the exposed solvent from the catalyst; and separating non solvent materials from the exposed solvent.

21. The process of claim 19, wherein said oxygen containing organic compound is a compound resulting from aging of transformer oil.

22. A process for removal of halide from a halide containing organic compound in a solvent of hydrocarbon or oil, the process comprising the steps of:

exposing a halide containing organic compound in a solvent of hydrocarbon or oil, in the presence of hydrogen and a nitrogen containing compound, to a catalyst which is capable, in the presence of hydrogen, of converting the halide in the halide containing organic compound to hydrohalic acid, at a pressure and at an elevated temperature and for a time sufficient to convert the halide in the halide containing organic compound to hydrohalic acid; and neutralizing the resulting hydrohalic acid with the nitrogen containing compound at a pressure and at an elevated temperature to form a hydrohalic acid neutralization product that does not substantially precipitate on said catalyst.

23. The process of claim 22 further comprising the steps of adding a compound to said solvent, wherein said compound is transformed into a nitrogen containing compound under the conditions of said process.

24. The process of claim 22 further comprising the step of: neutralizing any catalyst acid sites with the nitrogen containing compound.

25. The process of claim 22 further comprising the step of: removing the exposed solvent from the catalyst; and separating non-solvent materials from the exposed solvent.

26. The process of claim 22 wherein said neutralizing of the hydrohalic acid formed with the nitrogen containing compound results in a neutralization product(s) comprising a neutralization product(s) selected from the group consisting of vaporized ammonium halide and dissociated ammonia and gaseous hydrohalic acid, and the process further comprises the steps of:

removing the exposed solvent from the catalyst; and separating non-solvent materials from the exposed solvent.

27. The process of claim 22 wherein the pressure is in the range from about 0.1 MPa to about 50 MPa and the elevated temperature is in the range from about 200 to about 500° C.

28. The process of claim 22 wherein the pressure is in the range from about 1 MPa to about 10 MPa and the elevated temperature is in the range of from about 275 to 375° C.

29. The process of claim 22 wherein the solvent comprises transformer oil.

30. The process of claim 22 wherein the halide is chloride.

31. The process of claim 22 wherein the nitrogen containing compound comprises ammonia.

32. The process of claim 22 wherein the pressure is in the range of from about 1 MPa to about 10, MPa and the elevated temperature is in the range of from about 300 to about 375° C., the solvent comprises transformer oil, the halide is chloride—and the nitrogen containing compound comprises ammonia.

33. The process of claim 22 wherein the pressure and elevated temperature are maintained at a level at which the neutralization product remains substantially in the gaseous phase or disassociated in the gaseous phase such that the catalyst remains substantially uncontaminated by the neutralization products.

34. The process of claim 22, wherein said halide containing organic compound is a polychlorinated biphenyl.

35. A process for simultaneous removal of halide from a halide containing organic compound and reduction of an oxygen containing organic compound in a solvent of hydrocarbon or oil, the process comprising the steps of:

exposing a halide containing organic compound and an oxygen containing organic compound in a solvent of hydrocarbon or oil, in the presence of hydrogen and a nitrogen containing compound, to a catalyst which is capable, in the presence of hydrogen, of:

(i) converting the halide in the halide containing organic compound to hydrohalic acid; and (ii) reducing the oxygen containing organic compound at a pressure and at an elevated temperature and for a time sufficient:

(a) to convert the halide in the halide containing organic compound to hydrohalic acid; and (b) to reduce the oxygen containing organic compound and neutralizing the resulting hydrohalic acid formed in (a) with said nitrogen containing compound at a pressure and at an elevated temperature to form a hydrohalic acid neutralization product that does not substantially precipitate on said catalyst.

36. The process of claim 35 further comprising the step of adding a compound to said solvent, wherein said compound is transformed into a nitrogen compound under the conditions of said process.

37. The process of claim 35 further comprising the step of: neutralizing any catalyst acid sites with the nitrogen containing compound.

38. The process of claim 35 further comprising the step of: removing the exposed solvent from the catalyst; and separating non-solvent materials from the exposed solvent.

39. The process of claim 35 wherein said neutralizing of the hydrohalic acid formed with the nitrogen containing compound results in a neutralization product(s) comprising a neutralization product(s) selected from the group consisting of vaporized ammonium halide and dissociated ammonia and gaseous hydrohalic acid, and the process further comprises the steps of: removing the exposed solvent from the catalyst; and separating non-solvent materials from the exposed solvent.

40. The process of claim 35 wherein the pressure is in the range from about 0.5 MPa to about 50 MPa and the elevated temperature is in the range from about 200 to 500° C.

41. The process of claim 35 wherein the pressure is in the range from about 1 MPa to about 10 MPa and the elevated temperature is in the range from about 275 to about 375° C.

42. The process of claim 35 wherein the solvent comprises transformer oil.

43. The process of claim 35 wherein the halide is chloride.

44. The process of claim 35 wherein the nitrogen containing compound comprises ammonia.

45. The process claim 35 wherein the pressure is in the range of from about 1 MPa to about 10 MPa and the elevated temperature is in the range of from about 300 to about 375° C., the solvent comprises transformer oil, the halide is chloride—and the nitrogen containing compound comprises ammonia.

46. The process of claim 35 wherein the pressure and elevated temperature are maintained at a level at which the neutralization product remains substantially in the gaseous phase or dissociated in the gaseous phase such that the catalyst remains substantially uncontaminated by the neutralization products.

47. The process of claim 35, wherein said halide containing organic compound is a polychlorinated biphenyl.

48. A process for removal of a halide from a halide containing organic compound, the process comprising the steps of:

dissolving a halide containing organic compound in a solvent of a hydrocarbon or oil;

exposing the solvent having a halide containing organic compound dissolved therein, in the presence of hydrogen and a nitrogen containing compound, to a catalyst which is capable, in the presence of hydrogen, of converting the halide in the halide containing organic compound to hydrohalic acid, at a pressure and at an elevated temperature and for a time sufficient to convert the halide in the halide containing organic compound to hydrohalic acid; and neutralizing the resulting hydrohalic acid with the nitrogen containing compound at a pressure and at an elevated temperature to form a hydrohalic acid neutralization product that does not substantially precipitate on said catalyst.

49. The process of claim 48 further comprising the step of adding a compound to said solvent, wherein said compound is transformed into a nitrogen containing compound under the conditions of said process.

50. The process of claim 48 further comprising the step of: neutralizing any catalyst acid sites with the nitrogen containing compound.

51. The process of claim 48 further comprising the step of: removing the exposed solvent from the catalyst; and separating non-solvent materials from the exposed solvent.

52. The process of claim 48 wherein said neutralizing of the hydrohalic acid formed with the nitrogen containing compound results in a neutralization product(s) comprising a neutralization product(s) selected from the group consisting of vaporized ammonium halide and dissociated ammonia and gaseous hydrohalic acid, and the process further comprises the steps of:

removing the exposed solvent from the catalyst; and separating non-solvent materials from the exposed solvent.

53. The process of claim 48 wherein the pressure is in the range from about 0.1 MPa to about 50 MPa and the elevated temperature is in the range from about 200 to about 500° C.

54. The process of claim 48 wherein the pressure is in the range from about 1 MPa to about 10 MPa and the elevated temperature is in the range from about 275 to about 375° C.

55. The process of claim 48 wherein the solvent comprises transformer oil.

56. The process of claim 48 wherein the halide is chloride.

57. The process of claim 48 wherein the nitrogen containing compound comprises ammonia.

58. The process of claim 48 wherein the pressure is in the range of from about 1 MPa to about 10 MPa and the elevated temperature is in the range of from about 300 to about 375° C., the solvent comprises transformer oil, the halide is chloride—and the nitrogen containing compound comprises ammonia.

59. The process of claim 48 wherein the pressure and elevated temperature are maintained at a level at which the neutralization product remains substantially in the gaseous phase or disassociated in the gaseous phase such that the catalyst remains substantially uncontaminated by the neutralization products.

60. The process of claim 59 wherein the pressure and elevated temperature are maintained at a level at which the neutralization product remains substantially in the gaseous phase or disassociated in the gaseous phase such that the catalyst remains substantially uncontaminated by the neutralization products.

61. The process of claim 59 further comprising the step of adding a compound to said spent transformer oil, wherein said added compound is transformed into a nitrogen containing compound under conditions of said process.

62. The process of claim 48, wherein said halide containing organic compound is a polychlorinated biphenyl.

63. A process for reduction of an oxygen containing organic compound in a solvent of hydrocarbon or oil, the process comprising the steps of:

exposing an oxygen containing organic compound in a solvent of hydrocarbon or oil, in the presence of hydrogen and a nitrogen containing compound, to a catalyst which is capable, in the presence of hydrogen, of reducing the oxygen containing organic compound; at a pressure and at an elevated temperature and for at time sufficient to reduce the oxygen containing organic compound; and neutralizing any acid in the exposed solvent and any catalyst acid sites with the nitrogen containing compound at a pressure and at an elevated temperature to form an acid neutralization product that does not substantially precipitate on said catalyst.

64. The process of claim 63 further comprising the step of adding a compound to said solvent, wherein said compound is transformed into a nitrogen containing compound under the conditions of said process.

65. The process of claim 63 further comprising the steps of: removing the exposed solvent from the catalyst; and separating non-solvent materials from the exposed solvent.

66. The process of claim 63 wherein the pressure is in the range from about 1 MPa to about 10 MPa and the elevated temperature is in the range of from about 275 to about 375° C.

67. The process of claim 63 wherein the solvent comprises transformer oil.

68. The process of claim 63 wherein the halide is chloride.

69. The process of claim 63 wherein the nitrogen containing compound comprises ammonia.

70. The process of claim 63 wherein the pressure and elevated temperature are maintained at a level at which the neutralization product remains substantially in the gaseous phase or dissociated in the gaseous phase such that the catalyst remains substantially uncontaminated by the neutralization products.

71. The process of claim 70 wherein the pressure and elevated temperature are maintained at a level at which the neutralization product remains substantially in the gaseous phase or dissociated in the gaseous phase such that the catalyst remains substantially uncontaminated by the neutralization products.

72. The process of claim 70 further comprising the step of adding a compound to said spent transformer oil, wherein said added compound is transformed into a nitrogen containing compound under conditions of said process.

73. The process of claim 63, wherein said oxygen containing organic compound is a compound resulting from aging of transformer oil.

74. A process for restoring the electrical properties of spent transformer oil having impaired electrical properties, the process comprising the steps of:

(a) exposing spent transformer oil, in the presence of hydrogen and a nitrogen containing compound, to a catalyst which is capable, in the presence of hydrogen, of:

(i) converting any halide in said spent transformer oil to hydrohalic acid; and (ii) reducing any oxygen containing organic compound in said spent transformer oil;

the reaction conditions and time of said exposure being sufficient to restore the electrical properties of said transformer oil;

(b) neutralizing the resulting hydrohalic acid or other acid formed in (a) with said nitrogen containing compound at a pressure and at an elevated temperature to form an acid neutralization product that does not substantially precipitate on said catalyst; and (c) recovering regenerated transformer oil obtained from step (a).

75. A process for substantially destroying polychlorinated biphenyls in spent transformer oil containing polychlorinated biphenyls, the process comprising the steps of:

(a) exposing spent transformer oil, in the presence of hydrogen and a basic nitrogen containing compound, to a catalyst which is capable, in the presence of hydrogen, of converting chlorine in said polychlorinated biphenyls to hydrochloric acid, the reaction conditions and time of said exposure being sufficient to substantially destroy said polychlorinated biphenyls;

(b) neutralizing the resulting hydrochloric acid or other acid formed in (a) with said nitrogen containing compound at a pressure and at an elevated temperature to form an acid neutralization product that does not substantially precipitate on said catalyst; and (c) recovering regenerated transformer oil obtained from step (a).

* * * * *